United States Patent [19]

Honda et al.

[11] Patent Number: 4,970,027

[45] Date of Patent: Nov. 13, 1990

[54] ELECTRICAL RESISTORS, ELECTRICAL RESISTOR PASTE AND METHOD FOR MAKING THE SAME

[75] Inventors: Toshimitsu Honda; Tadahiko Yamada; Kazuji Onikata; Shoichi Tosaka, all of Gumma, Japan

[73] Assignee: Taiyo Yuden Co., Ltd., Tokyo, Japan

[21] Appl. No.: 138,439

[22] Filed: Dec. 28, 1987

[30] Foreign Application Priority Data

| | | | |
|---|---|---|---|
| Feb. 28, 1987 | [JP] | Japan | 62-045615 |
| Apr. 30, 1987 | [JP] | Japan | 62-104416 |
| Apr. 30, 1987 | [JP] | Japan | 62-104415 |

[51] Int. Cl.[5] ..... H01B 1/06

[52] U.S. Cl. ..... 252/518; 252/520; 252/521

[58] Field of Search ..... 252/518, 521, 520; 338/22, 308, 20; 427/216, 217, 126.1, 126.2; 264/61, 60; 419/61, 64, 65; 420/429

[56] References Cited

U.S. PATENT DOCUMENTS

| | | | |
|---|---|---|---|
| 4,891,158 | 1/1990 | Hatu | 252/518 |
| 4,940,849 | 7/1990 | Morris et al. | 252/518 |

*Primary Examiner*—Josephine Barr

*Attorney, Agent, or Firm*—Birch, Stewart, Kolasch & Birch

[57] ABSTRACT

A fixed chip resistor or a thick-film electrical resistor providing in circuit boards and the like and, to an electrical resistor obtained by sintering in a non-oxidizing atmosphere, resistance pastes for producing an electrical resistor and a method for making such resistors. The aforesaid objects are achieved by the provision of an electrical resistor obtained using at least one molybdate belonging to the following groups (A) and (G) with or without a fluoride of an alkaline earth metal, and an electrical resistor paste obtained using the aforesaid components with or without a carbonate of an alkaline earth metals, (A) Molybdates of alkaline earth metals,
(B) Molybdate of zinc,
(C) Molybdate of elements Y, La, Ce, Pr, Nd, Sm, Eu, Gd, Tb, Dy, Ho, Er, Tm, Yb and Lu, and complex molybdates of two or more of said elements,
(D) Molybdate of aluminum
(E) Molybdates of elements zirconium and hafnium, and complex molybdates thereof, and
(G) Molybdates of manganese.

17 Claims, 5 Drawing Sheets

X-RAY DIFFRACTION PATTERN

X 900.000

X 900,000

ELECTRICAL RESISTORS, ELECTRICAL RESISTOR PASTE AND METHOD FOR MAKING THE SAME

BACKGROUND OF THE INVENTION

1. Field of the Invention

The present invention relates to a fixed chip resistor or a thick-film type electrical resistor provided in circuit boards and the like and, more particularly, to an electrical resistor capable of being obtained by sintering in a non-oxidizing atmosphere. The present invention also relates to a method for making such resistors.

2. Statement of the Prior Art

Electrical circuits of electronic equipment are generally constructed by mounting various electrical elements such as resistors, capacitors, diodes and transistors to circuit boards. With miniaturization of electronic equipment, however, much use has been made of circuit boards capable of increasing the density of such mounted electrical elements.

The resistors mounted to such circuit boards include a thick-film resistor formed by printing and firing a paste of a resistor material directly onto a circuit, a fixed chip resistor made by forming such a thick-film resistor across a pair of electrode terminals of a rectangular ceramic chip, and the like.

Hitherto, such a thick-film resistor has generally been formed on a circuit board in the following manner. A paste of a conductor material such as Ag or Ag-Pd is applied and fired on the surface of an alumina substrate obtained by sintering at, e.g., about 1500° C. Afterwards, a paste containing, e.g., $RuO_2$ as the main material of the resistor is applied on that surface by means of screen printing, etc., followed by firing at 750° to 850° C. and, if required, adjustment of a resistance value by means of laser trimming, etc.

However, recent heavy demands for reduction in the weight, thickness, size and cost of electronic equipment, etc. have led to intensive studies for reducing in the size and cost of circuit boards.

Referring to concrete measures to meet the former size reduction, multilayered circuit boards deserve the first mention, and formed resistors the second mention. Known examples of multilayered circuit boards include a multilayered circuitry board obtained by laminating ceramic green sheets, each having a paste of a conductor material such as Ag or Ag-Pd printed thereon, and simultaneously sintering them at 800° to 1100° C. in the air, while known examples of the formed resistor include a multilayered with a formed resistor, obtained by printing a paste of a $RuO_2$ base resistor material on a ceramic green sheet having said paste of a conductive material printed thereon, laminating such sheets, and then simultaneously sintering them.

Referring to concrete measures to achieve the latter cost reduction, multilayered circuitry boards have been put to practical use, and are obtained by using conductive materials based on inexpensive base metals such as Ni or Cu in place of those based on noble metals such as Ag or Ag-Pd, and sintering them simultaneously with green ceramic at 800° to 1100° C. in a neutral or reducing atmosphere to avoid any increase in resistance due to their oxidation, such as a nitrogen gas or a hydrogen-containing nitrogen gas. As disclosed in Japanese Patent Laid-Open (Kokai) Publication No. 56-153702 in particular, there are also known thick-film resistors, etc. which are obtained by applying a resistor material comprising $MoSi_2$—$TaSi_2$ and glass on an alumina substrate including a copper (Cu) conductor followed by a heat treatment.

Where it is intended to simultaneously reduce the size and cost of circuit boards, the $RuO_2$ base resistor material undergoes a reducing reaction, when it is sintered simultaneously with green ceramic in a nitrogen gas or hydrogen-containing nitrogen atmosphere, and it does not provide any resistor.

Simultaneously sintering of the resistor material comprising $MoSi_2$—$TaSi_2$ and glass and the green ceramic sheet in a non-oxidizing atmosphere also offers the problems that the substrate may warp due to a difference in the dislocation shrinkage curve, or may tend to swell easily due to the gas generated by the decomposing reaction of $MoSi_2$—$TaSi_2$. To solve such problems, it is known by way of example to use a resistor material comprising $MoSi_2$-salts of metal fluorides (e.g. calcium fluoride) and glass, as disclosed in Japanese Patent Laid-Open (Kokai) Publication No. 60-198703. In this example, such warping or swelling of the substrate as mentioned above is not found.

However, when allowed to stand alone in a relative humidity of 95% for 1000 hours, the thick-film resistor obtained by applying such a resistor material comprising $MoSi_2$-metal fluorides and glass on a green ceramic sheet and simultaneously sintering them shows a 5 to 10% increase in the resistance value and, hence, cannot perform its own resistor function.

Further, the conventional electrical resistors as mentioned above have posed some problem, when used as the resistor element for a circuit needing precise work, since it is impossible to decrease the temperature dependence coefficient of their resistance value to 1000 ppm/°C. or lower.

SUMMARY OF THE INVENTION

A first object of the present invention is to provide an electrical resistor which can be used as a fixed chip resistor or for general circuit boards, and can be laminated with a conductive material of a base metal and formed in a multilayered substrate.

A second object of the present invention is to provide an electrical resistor, the resistance value of which is stabilized.

A third object of the present invention is to provide an electrical resistor, in which the temperature coefficient of resistance value can be decreased.

A fourth object of the present invention is to provide an electrical resistor having excellent properties, which can be obtained even by sintering a resistor material in a reducing atmosphere.

A fifth object of the present invention is to provide an electrical resistor which can meet the reduction in both the size and cost of circuit substrates.

A sixth object of the present invention is to provide a method for making said electrical resistors, which can realize the performance thereof and further improve the properties thereof.

According to the present invention, the aforesaid objects are achieved by the provision of an electrical resistor obtained using at least one molybdate selected from the group consisting of (A) to (G) with or without a fluoride of an alkaline earth metal, and an electrical resistor paste obtained using the aforesaid components with or without a carbonate of an alkaline earth metal:

(A) Molybdates of alkaline earth metals, (B) Molybdate of zinc, (C) Molybdates of elements Y, La, Ce, Pr, Nd, Sm, Eu, Gd, Tb, Dy, Ho, Er, Tm, Yb and Lu, and complex molybdates of two or more of said elements, (D) Molybdate of aluminum (E) Molybdates of elements zirconium and hafnium, and complex molybdates thereof, and (G) Molybdates of manganese.

According to the present invention, there is also provided a method for making electrical resistors which have their properties improved by using a heat-treated resistor material, and an electrical resistor of the particulate structure obtained by the growth of acicular particles from bulk particles so as to improve its properties.

BRIEF DESCRIPTION OF THE DRAWINGS

The aforesaid and other objects and features of the present invention will become apparent from the following detailed description with reference to the accompanying drawings, which are given for the purpose of illustration alone, and in which.

DETAILED DESCRIPTION OF THE INVENTION

Figure 1:
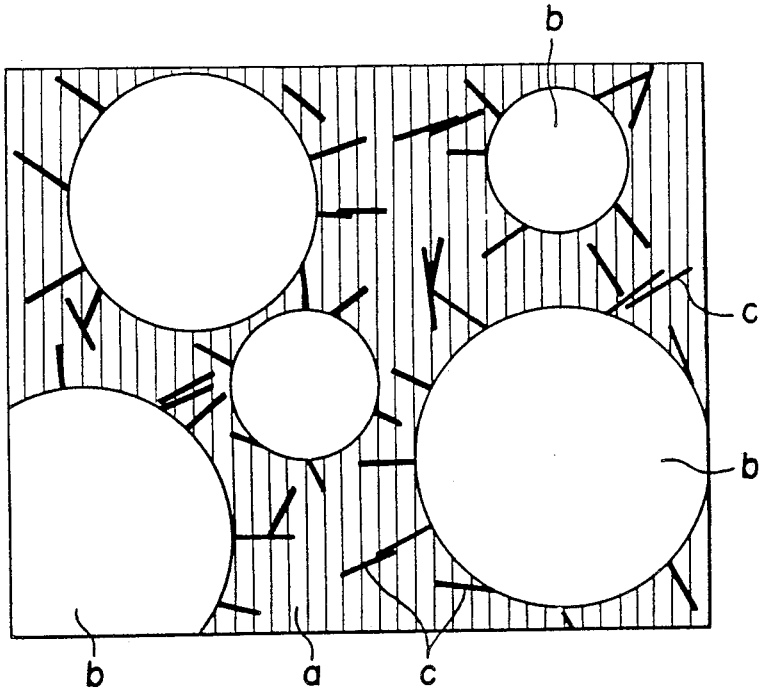
FIG. 1 is a schematic view showing the structure of the electrical resistor according to the present invention.
Figure 2:
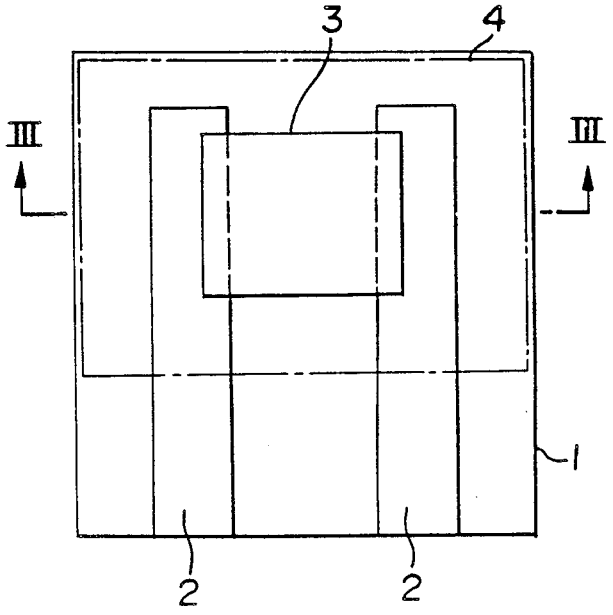
FIG. 2 is a view of one embodiment of the production of the electrical resistor according to the present invention, in which a resistive film and a conductive are applied on a substrate, and are being formed into a multilayered structure, prior to sintering.

As illustrated as an example in FIG. 1, the electrical resistor according to the present invention is of the structure wherein spherical particles b and acicular particles c are dispersed throughout glass a. In this example, the acicular particles are deposited to the spherical particles, or are allowed to be present in the vicinity thereof. A current may pass through such a structure formed by contacting particles or particles in the vicinity thereof. For instance, such a structure may be formed by the sintering treatment of bulk particles of a resistor material, thereby growing the products formed on the surfaces thereof in the acicular form.

As such a resistor body material, at least one molybdate group selected from the consisting of (A) to (G) may be used. For example, the following molybdates are representative of the invention.

(A) Molybdates of Alkaline Earth Metals

Preferable molybdates to this end are expressed in terms of the following general formulae:

$MeMoO_4$, $Me_3MoO_6$, $Me_2MoO_5$, $Me_2Mo_7$, $MeMo_4O_{13}$, $MeMo_7O_{24}$, $MeMo_3O_{10}$, $Me_2MoO_5$, $Me_2Mo_3O_{11}$ and the like wherein Me is the alkaline earth metal. For example, the following groups may be mentioned, e.g., $MgMoO_4$, $CaMoO_4$, $SrMoO_4$, $BaMoO_4$, $BaMo_2O_7$, $BaMo_4O_{13}$, $BaMo_7O_{24}$, $BaMo_3O_{10}$, $Ca_3MoO_6$, $Sr_3MoO_6$, $Ba_3MoO_6$, $Ba_2MoO_5$, $Mg_2Mo_3O_{11}$ and the like.

The following complex molybdates are also exemplified.

$(Mg_x\ Ca_y)MoO_4$, provided that $x+y=1$, $(Ca_x\ Sr_y)MoO_4$, provided that $x+y=1$, $(Mg_x\ Ba_y)MoO_4$, provided that $x+y=1$, $(Mg_x\ Ca_y\ Ba_z)MoO_4$, provided that $x+y+z=1$, $(Ca_x\ Sr_y\ Ba_z)MoO_4$, provided that $x+y+z=1$, $(Mg_x\ Ca_y\ Sr_z\ Ba_w)MoO_4$, provided that $x+y+z+w=1$ $(Ca_x\ Sr_y)MoO_6$, provided that $x+y=1$, $(Sr_x\ Ba_y)MoO_6$, provided that $x+y=1$.

(B) Molybdates of Zinc

For instance, $ZnMoO_4$, $ZnMo_2O_7$, $Zn_3Mo_2O_9$ are mentioned.

(C) Molybdates of Elements Y, La, Ce, Pr, Nd, Sm, Eu, Gd, Tb, Dy, Ho, Er, Tm, Yb and Lu and Complex Molybdates of Two or More of Said Element Examples of such molybdates are tabulated in the following table.

| Molybdates of Various Element and Complex Molybdate There of | | | | | |
|---|---|---|---|---|---|
| $Y_6MoO_{12}$ | $Y_2Mo_3O_{12}$ | | $Y_2MoO_5$ | $Y_4MoO_9$ | |
| $La_6MoO_{12}$ | $La_2Mo_3O_{12}$ | $La_2MoO_6$ | $La_2Mo_2O_9$ | $La_3Mo_2O_{10}$ | $La_2Mo_4O_{15}$ |
| | | | $La_4MoO_9$ | $La_3Mo_2O_9$ | $La_4MoO_8$ |
| $Ce_6MoO_{12}$ | | | $CeMo_2O_8$ | $Ce_2Mo_3O_{13}$ | |
| $Pr_6MoO_{12}$ | $Pr_2Mo_3O_{12}$ | $Pr_2MoO_6$ | | | |
| $Nd_6MoO_{12}$ | $Nd_2Mo_3O_{12}$ | $Nd_2MoO_6$ | $Nd_5Mo_3O_{16}$ | | |
| $Sm_6MoO_{12}$ | $Sm_2Mo_3O_{12}$ | $Sm_2MoO_6$ | $Sm_2Mo_2O_7$ | $Sm_2Mo_2O_9$ | $Sm_{18}MoO_{39}$ |
| $Eu_6MoO_{12}$ | $Eu_2Mo_3O_{12}$ | $Eu_2MoO_6$ | $EuMoO_4$ | $Eu_2Mo_2O_7$ | |
| $Gd_6MoO_{12}$ | $Gd_2MoO_{12}$ | $Gd_2MoO_6$ | $Gd_2Mo_6O_{21}$ | $Gd_2Mo_4O_{15}$ | |
| $Tb_6MoO_{12}$ | $Tb_2Mo_3O_{12}$ | $Tb_2MoO_6$ | $Tb_2Mo_2O_9$ | | |
| $Dy_6MoO_{12}$ | | $Dy_2MoO_6$ | | | |
| $Ho_6MoO_{12}$ | $Ho_2Mo_3O_{12}$ | $Ho_2MoO_6$ | $Ho_{10}Mo_2O_{21}$ | | |
| $Er_6MoO_{12}$ | | $Er_2MoO_6$ | | | |
| $Tm_6MoO_{12}$ | | $Tm_2MoO_6$ | | | |
| $Yb_6MoO_{12}$ | | | $Yb_2Mo_4O_{15}$ | | |

-continued

| Molybdates of Various Element and Complex Molybdate There of | | |
|---|---|---|
| $Lu_6MoO_{12}$ | $Lu_2Mo_3O_{12}$ | $Lu_2Mo_2O_9$ |

The following complex molybdates of two or more elements are also mentioned.

$(Y_xCe_y)MoO_{12}$, provided that $x+y=6$, $(Pr_xEy_y)MoO_{12}$, provided that $x+y=6$, $(Gd_xDy_y)MoO_{12}$, provided that $x+y=6$, $(Ho_xTm_yYb_z)MoO_{12}$, provided that $x+y+z=6$.

(D) Molybdates of Aluminium

For instance, $Al_2Mo_3O_{12}$ is mentioned.

(E) Molybdates of Elements Zirconium and Hafnium, and Molybdates of Said Elements For instance, $ZrMo_2O_3$, $HfMo_2O_8$ and $(Zr_x\ Hf_y)$-$Mo_2O_3$, provided that $x+y=1$, are mentioned.

(F) Molybdates of Elements Niobium and Tantalum

For instance, $Nb_2Mo_3O_{14}$, $Ta_2Mo_3O_{14}$ and $(Nb_x\ Ta_y)$-$Mo_3O_{14}$, provided that $x+y=1$, are mentioned.

(G) Molybdates of Manganese

For instance, $MnMoO_4$ is mentioned.

For use, at least one molybdate is selected from at least one molybdate group selected from the groups (A) to (G). When plural molbydates are selected from said at least one molybdate group, however, the single molybdates and/or complex molybdates of elements may be used.

The molybdates belonging to the aforesaid respective groups can be synthesized by the heat treatment of the oxides of the respective elements and molybdenum oxide ($MoO_3$), but may be synthesized by the heat treatment of their precursors. For instance, the molybdates of alkaline earth metals may also be synthesized by mixing substances which provide the precursors of the respective oxides of alkaline earth metals with molybdenum oxide ($MoO_3$) or its precursor in the predetermined molar ratio and heat-treating the resulting mixture. As an example, calcium carbonate ($CaCO_3$) or calcium hydroxide [$Ca(OH)_2$] which is, for instance, the precursor of CaO is mixed with molybdenum oxide ($MoO_3$) or its precursor, for instance, molybdic acid ($H_2MoO_4$) in the predetermined molar ratio, and the mixture is heat-treated. The heat-treatment conditions in this case are 600° to 1000° C. and 1 to 3 hours.

In the present invention, glass is preferably used. As such glass, use may be made of glass generally known in the art. Although the present invention is not limited to glass having a specific composition, it is to be noted that oxides such as $Pb_3O_4$, $Bi_2O_3$, $SnO_2$ and CdO may be reduced to metals which are likely to change the resistance value of resistors, when resistor materials containing them are sintered in a non-oxidizing atmosphere. Accordingly, where such a phenomenon is unpreferred, it is preferred that the glass used should not contain such oxides.

Preferable as the glass components are $SiO_2$, $B_2O_3$, ZnO, CaO, SrO, $ZrO_2$ and the like. It is preferred that the compositional ratio of such oxides are:

$SiO_2$; 12 to 33% by weight $B_2O_3$; 20 to 35% by weight

ZnO or SrO: 13 to 33% by weight

CAO: 10 to 25% by weight $ZrO_2$: 15 to 45% by weight.

To make glass from the compositions of such oxides, the respective oxides are weighed and mixed together in the aforesaid compositional ratio. The mixture is charged in a crucible, in which it is molten at a temperature of 1200° to 1500° C. Thereafter, the melt is poured in, e.g., water for rapid cooling, and the thus obtained coarse glass powders are pulverized to the desired particle size (of, e.g., 10 μm or less) by a pulverizer such as a ball mill or vibration mill to obtain glass powders.

The precursors of the respective oxides may wholly or partly be used and molten into glass. For instance, CaO (calcium oxide) and $B_2O_3$ (boron oxide) are obtained by the heat treatment of $CaCO_3$ (calcium carbonate) and boric acid ($H_3BO_3$), respectively. Hence, $CaCO_3$ and $H_2BO_3$ may be used in place of the whole or a part of CaO and $B_2O_3$. The same also holds for other componential oxides.

The fluorides of alkaline earth metals used in the present invention are expressed in terms of the general formula:

$Me'F_2$ wherein Me' is the metal. As Me', use is made of alkaline earth metals, i.e., Mg, Ca, Sr and Ba. The respective salts of these metals may preferably be used along or in admixture. In the present invention, however, the fluorides of other metals may also be used in addition to those of alkaline earth metals.

The molybdates of the elements belonging to said element groups and the glass powders obtained in the aforesaid manner are mixed together with or without the fluorides of alkaline earth metals, etc., and the mixtures may be used directly as resistor materials. In view of the resistance temperature properties of resistors, however, it is preferred to heat-treat and pulverize such mixtures and sinter the thus pulverized bodies as the resistor materials. The temperature for this heat treatment is preferably 800° to 1200° C. At a temperature departing from such a temperature range, the resistance value of the resulting resistors are apt to be influenced by delicate variations in the compositional ratio, which are caused by the operational conditions for the respective steps of processing the resistor materials into the electrical resistors. As a consequence, it is difficult to stably obtain the desired resistance value.

The heat treatment is desirously effected in a non-oxidizing atmosphere. To this end, use is preferably made of nitrogen gas or other inert gas, which may or may not contain hydrogen gas.

To prepare a fixed chip resistor or a resistor for thick-film resistors from the thus obtained resistor material powders, the powders are applied on, e.g., a ceramic green sheet, and the resulting produce is sintered. In this case, for instance, the aforesaid molybdate forming the resistor body is preferably used in the form of bulk particles such as spherical, oval or polygonal particles.

This is because it is preferably to allow the original matrixes of the acicular particles to remain in the process of the growth of the acicular particles during sintering. In order to form such a resistor body material into bulk particles, a binder such as glass may also be used.

For the purpose of applying such a resistor material comprising a molbydate and e.g., glass, a vehicle is mixed with the powders of such a resistor material so as to enable, e.g., screen printing. Prepared in this case, however, is a coating liquid to which a carbonate of an alkaline earth metal is added.

Such a carbonate may be expressed in terms of the general formula:

$$Me''CO_3$$

wherein Me'' is preferably but not exclusively the alkaline earth metal such as Mg, Ca, Sr and Ba. However, carbonates of other metals may be used.

Although varying dependent upon the type and combination f the molybdates of the elements selected from the groups (A) to (G) as already referred to, the compositional ratio of the respective components of the resistor materials should preferably be within the following range, when one or plural molbydates are selected from the same group.

| Group | Preferred Composition in weight % | | | | | | |
|---|---|---|---|---|---|---|---|
| | A | B | C | D | E | F | G |
| Molybdate | 40–95 | 65–95 | 60–95 | 45–95 | 50–95 | 55–95 | 65–95 |
| Glass Powders | 4–59 | 4–34 | 4–39 | 4–54 | 4–49 | 4–44 | 4–34 |
| Fluoride of Alkaline Earth Metal | 0.5–25 | 0.5–20 | 0.5–10 | 0.5–20 | 0.5–15 | 0.5–15 | 0.5–15 |
| Carbonate of Alkaline Earth Metal | 0.5–50 | 0.5–30 | 0.5–25 | 0.5–25 | 0.5–45 | 0.5–40 | 0.5–25 |

Otherwise, when at least one molybdate is selected from at least one molybdate group of the groups (A) to (G) as already referred to, preferred compositions are composed of 34.8 to 95.0% by weight of the molybdate, 2.1 to 49.5% by weight of glass powders, 0.3 29.9% by weight of the fluoride of an alkaline earth metal and 0.3 to 33.3% by weight of the carbonate of an alkaline earth metal.

It is noted that when the carbonate of an alkaline earth metal is not used, it is preferable to apply the following compositional ratio.

| Group | Preferred Composition in weight % | | | | | | |
|---|---|---|---|---|---|---|---|
| | A | B | C | D | E | F | G |
| Molybdate | 30–95 | 60–95 | 55–95 | 40–95 | 40–95 | 50–95 | 55–95 |
| Glass Powders | 4.5–69.5 | 4.5–39.5 | 4.5–44.5 | 4.5–59 | 4.5–54.5 | 4.5–49.5 | 4.5–44.5 |
| Fluoride of Alkaline Earth metal | 0.5–40 | 0.5–20 | 0.3–30 | 0.5–30 | 0.5–20 | 0.5–25 | 0.3–30 |

Otherwise, it is to be understood, however, that when at least one molybdate is selected from each of at least two groups of the aforesaid groups (A) to (G), preferred compositions are composed of 35.0 to 95.6% by weight of the molybdate, 2.8 to 49.9% by weight of the glass powders and 0.5 to 30.0% by weight of the fluoride of an alkaline earth metal.

An amount of the molybdate short excessively of the lower limit of the defined range and an amount of glass exceeding excessively the upper limit of the defined range are unpreferred, since the resistance value of the electrical resistor completed by sintering may become too high. On the contrary, when the amount of the said molybdate is too large and the amount of glass is too small, the binder ability of materials at the time of sintering may drop to such a degree that it is impossible to stably retain the sintered body on a circuit substrate. It is to be noted, however, that when the resistor is for instance laminated on and embedded in a circuit substrate, the molybdate and the fluoride of an alkaline earth metal may be used in an amount of not only higher than their upper limits but also 100%.

An amount of the fluoride of an alkaline earth metal either exceeding excessively the upper limit or short excessively of the lower limit may also be unpreferred, since the temperature dependence coefficient of the finished electrical resistor exceeds ±500 ppm/°C. (the absolute value of ±500 is larger than 500), when the carbonate of an alkaline earth metal is present, the value may be made not to exceed ±300 ppm/°C.

It is further noted that when it is not intended to use both the carbonate and fluoride of an alkaline earth metal, it is preferable to apply the following compositional ratio.

| Group | Preferred Composition in weight % | | | | | | |
|---|---|---|---|---|---|---|---|
| | A | B | C | D | E | F | G |
| Molybdate | 30–96 | 55–95 | 50–96 | 35–96 | 40–96 | 45–96 | 50–96 |
| Glass Powders | 4–70 | 4–45 | 4–50 | 4–65 | 4–60 | 4–55 | 4–50 |

Otherwise, it is to be understood, however, that when at least one molybdate is selected from each of at least two groups of the aforesaid groups (A) to (G), preferred compositions are composed of 50–96% by weight of the molybdate and 4 to 50% by weight of the glass powders.

It is to be noted, however, that the fluorides of an alkaline earth metal and the carbonate of an alkaline earth metal may be used in an amount of departing from the defined range, if improvements in the temperature dependence coefficient of resistance is achieved.

Preferably, the aforesaid vehicle should be burned off anywhere prior to sintering. Preferably to this end are organic vehicles, i.e., in which resins are dissolved or dispersed in organic solvents, if required, with the addition of various additives such as plasticizers and dispersants. Examples of the organic solvents include butyl carbitol acetate, butyl carbitol and turpentine oil, whilst examples of the resins include cellulose derivatives such as ethyl cellulose and nitrocellulose and other resins.

Although the proportion of the organic vehicles with the resistor material powders varies depending upon, e.g., the organic solvents and resins used, the ratio of the organic solvents to the resins to be applied should suitably be in a range of 20 to 50% by weight of the former with respect to 80 to 50% by weight of the latter. These components are pasted with the resistor material by three-roll milling.

The thus obtained resistor material paste is applied on a substrate, and is further subjected to the treatments to be described later to make a resistor. The substrate may be prepared not only by sintering a ceramic green sheet along with a conductive material and a resistor material, but also by previously sintering a ceramic green sheet and applying thereon a resistor material and a conductor material, followed by sintering. Such procedures may also be applied to the formation of laminates.

As the aforesaid ceramic green sheet, use may be made of that obtained by slip-casting a slurry, etc., said slurry being prepared by mixing the organic vehicle with an oxide mixture of ceramic constituents comprising, for instance, 35 to 45% by weight of aluminium oxide ($Al_2O_3$), 25 to 35% by weight of silicon oxide ($SiO_2$), 10 to 15% by weight of boron oxide ($B_2O_3$), 7 to 13% by weight of calcium oxide (CaO) and 7 to 10% by weight of magnesium oxide (MgO). In this case, when the molybdate of the aforesaid groups is not used with glass, an increased amount of a glassy component may be contained in the aforesaid ceramic green sheet so as to achieve an effect similar to that achieved by the use of glass. The aforesaid organic vehicles may be comprised of acrylic resins such as acryl ester, resins such as polyvinyl butyral, plasticizers such as glycerin and diethyl phthalate, dispersants such as carbonates, and solvents such as organic solvents.

It is preferred that the aforesaid resistive material paste is applied on the ceramic green sheet by means of, e.g., screen printing and, after drying, is heat-treated at 400° to 500° C. to decompose and burn the resinous component.

In this case, a paste of a conductive material of a base metal such as Ni or Cu or a noble metal such as Ag or Ag-Pd is also simultaneously applied on the ceramic green sheet in the same manner.

The paste compositions of the conductive material of a base metal such as Ni or Cu or a noble metal such as Ag or Ag-Pd are exemplified by those obtained by adding 2 to 15% by weight of glass frits to 98 to 85% by weight of the powders of the respective metals.

The resistor material and/or the conductive material are/is incorporated into the ceramic green sheet in this manner. In the case of a fixed chip resistor, by this sintering it is possible to form the conductive material and/or the thick-film resistor material simultaneously into/on the substrates. On the other hand, in the case of the laminate, another similar ceramic green sheet is further put thereon, and after repeating this process, the multilayered board is sintered.

When the conductor material of a base metal such as Ni or Cu is used as the conductor material in this case, sintering should preferably be carried out in a nonoxidizing atmosphere so as to prevent any increase in the resistance value due to its oxidation. The sintering temperature is exemplified by, e.g., 800° to 1100° C., and the sintering time is exemplified by, e.g., 0.5 to 2 hours. A nitrogen gas or other inert gases which may or may not contain a hydrogen gas may be used as the nonoxidizing atmosphere. When the conductor material of a noble metal such as Ag or Ag-Pd is used, on the other hand, sintering may be carried out in an oxidizing atmosphere of air, for instance.

The circuitry substrate having the conductor and/or resistor incorporated thereinto is completed in the manner as mentioned above. According to the present invention, however, any cracking, distortion, swelling, etc., which may be caused by sintering, are not found in the sintered substrate and the resistor, to say nothing of in the sintered substrate and the conductor, and the resistor shows a resistance value change within only ±0.1% with respect to changes in a relative humidity of 10 to 90% at 25° C. Further, even after the resistor has been allowed to stand for at least 1000 hours in a high-temperature and-humidity atmosphere, the change in its resistance value is limited to within ±2%, and the temperature-dependent coefficient of its resistance value in the case of using the fluorides can be reduced not to exceed ±500 ppm/°C., while that in the case of using the fluorides and carbonates not to exceed ±300 ppm/°C. Such effects appear to be due to the fact that the resistor is well matched with the conductor and the sintered substrate and on the basis of the unique humidity resistance of the resistor comprising the sintered body comprised of the molybdate of the aforesaid groups and glass; however, details thereon are not yet clarified. By X-ray diffraction analysis, the resistor has been found to contain the molybdate. Also, the presence of the bulk and acicular particles has been observed under a transmission type electron microscope (TEM).

In the present invention, the molybdates selected as mentioned above may be used; however, the whole or a part of the precursors of such molybdates may be used in place thereof by a heat treatment. In either cases, it is preferable that they are mixed with glass and heat-treated, and the resulting product is pulverized into a resistor material. Alternatively, the molybdates and/or their precursors may be mixed with the aforesaid vehicles, etc. without any heat treatment to prepare a paste, which is applied on, e.g., a ceramic green sheet, heat-treated for the removal of the organics, and is thereafter sintered directly into a resistor.

Referring to the glass used, it is to be understood that the mixed material of the oxides forming it may result in a sinterable state with the molybdate selected. The whole or a part of such oxides is put to a pasty state together with the molybdate selected and/or its precursor. The paste is then applied on the substrate, and the aforesaid glassy components are formed into glass in the process of either one of the steps of burning off the organics and the later sintering step. The glass is sintered with the molybdate selected and/or its precursor to thereby prepare a resistor. For instance, since CaO (calcium oxide) and $B_2O_3$ (boron oxide) that are the components of glass materials may be obtained from $CaCO_3$ (calcium carbonate) and $H_3BO_3$(boric acid) by heating, $CaCo_3$ and $H_3BO_3$ may be used in place of the whole or part of CaO and $B_2O_3$, respectively. By the resistor material referred to in the present disclosure is meant a material which may be comprised of the molybdate selected, the glass and the fluoride of an alkaline earth metal as a result of the treating processes involved.

EXAMPLES

The present invention will now be explained with reference to the following non-restrictive examples.

EXAMPLE 1

The respective components were weighed and mixed together according in the compositional ratio calculated as oxides and specified in Table 1.

TABLE 1

| | Compostional Ratio in % by Weight | | | | | |
|---|---|---|---|---|---|---|
| | $SiO_2$ | $B_2O_3$ | ZnO | CaO | SrO | $ZrO_2$ |
| Glass A | 20.0 | 29.0 | 13.0 | 11.0 | 11.0 | 17.0 |
| Glass B | 18.0 | 28.5 | 20.2 | 10.5 | — | 23.0 |

The respective mixtures of Glass A and Glass B were separately molten in alumina crucibles at 1400° C., and the obtained melts were poured in water for rapid cooling. The thus cooled products were taken out of the water, and were milled together with ethanol, and were pulverized by alumina balls into glass powders having a particle size of 10 μm or lower.

The respective molybdates belonging to the aforesaid groups (A) to (G) were synthesized from molybdenum oxide and the oxides of the respective elements. However, the molybdate of an alkaline earth metal was prepared by mixing molybdenum oxide with the carbonate of an alkaline earth metal in a molar ratio of 1:1 and heat-treating the mixture at 700° C. for 1 hour.

The powders obtained from each of Glass A and Glass B, the aforesaid molybdates and the fluorides of alkaline earth metals were weighed and mixed together in the proportions specified in the respective columns of Tables 2–9.

It is understood that Tables 2 to 8 correspond to the groups (A) to (G), and Table 9 indicates the proportions of the components selected from two or more groups.

TABLE 2

| | (Ex. 1)(Group A) Composition | | | | | | | | | | |
|---|---|---|---|---|---|---|---|---|---|---|---|
| | | | | Fluorides (wt. %) | | | | Carbonates (wt. %) | | | |
| Nos | Molybdates (wt. %) | Glass A (wt. %) | Glass B (wt. %) | $SrF_2$ | $BaF_2$ | $MgF_2$ | $CaF_2$ | $SrCO_3$ | $BaCO_3$ | $MgCO_3$ | $CaCO_3$ |
| | $MgMoO_4$ | | | | | | | | | | |
| 1 | 25 | 58.4 | — | | | | 8.3 | 8.3 | | | |
| 2 | 41.7 | 41.7 | — | | | | 8.3 | 8.3 | | | |
| 3 | 62.5 | 20.9 | — | | | | 8.3 | 8.3 | | | |
| 4 | 80 | 3.4 | — | | | | 8.3 | 8.3 | | | |
| 5 | 41.7 | — | 41.7 | | | | 8.3 | 8.3 | | | |
| 6 | 62.5 | — | 20.9 | | | | 8.3 | 8.3 | | | |
| 7 | 40 | — | 59 | | | | 0.5 | | | 0.5 | |
| 8 | 40 | — | 5 | | | | 5 | | | 50 | |
| 9 | 60 | — | 5 | | | | 30 | | | 5 | |
| 10 | 60 | — | 20 | | | | 10 | | | 10 | |
| 11 | 80 | — | 10 | | | | 5 | | | 5 | |
| 12 | 80 | — | 7 | | | | 3 | | | 10 | |
| 13 | 95 | — | 4 | | | | 0.5 | | | 0.5 | |
| 14 | 40 | — | 59 | | 0.5 | | | 0.5 | | | |
| 15 | 40 | — | 5 | | 5 | | | 50 | | | |
| 16 | 60 | — | 5 | | 30 | | | 5 | | | |
| 17 | 60 | — | 20 | | 10 | | | 10 | | | |
| 18 | 80 | — | 10 | | 5 | | | 5 | | | |
| 19 | 80 | — | 7 | | 3 | | | 10 | | | |
| 20 | 95 | — | 4 | | 0.5 | | | 0.5 | | | |
| 21 | 60 | — | 20 | | | | 10 | | | | 10 |
| 22 | 80 | — | 7 | | | | 3 | | | | 10 |
| 23 | 60 | — | 20 | | | | 10 | 10 | | | |
| 24 | 80 | — | 7 | | | | 3 | 10 | | | |
| 25 | 60 | — | 20 | | | | 10 | | 10 | | |
| 26 | 80 | — | 7 | | | | 3 | | 10 | | |
| 27 | 60 | — | 10 | | | 20 | | | | 10 | |
| 28 | 80 | — | 10 | | | 5 | | | | 5 | |
| 29 | 60 | — | 10 | 20 | | | | | | 10 | |
| 30 | 80 | — | 10 | 5 | | | | | | 5 | |
| 31 | 60 | — | 10 | | 20 | | | | | 10 | |
| 32 | 80 | — | 10 | | 5 | | | | | 5 | |
| 33 | 40 | — | 5 | 2 | 2 | 1 | | | 25 | | 25 |
| 34 | 60 | — | 20 | 5 | 5 | | | 3 | 3 | | 4 |
| | $Mg_2Mo_3O_{11}$ | | | | | | | | | | |
| 35 | 25 | — | 58.4 | | | | 8.3 | 8.3 | | | |
| 36 | 41.7 | — | 41.7 | | | | 8.3 | 8.3 | | | |
| 37 | 62.5 | — | 20.9 | | | | 8.3 | 8.3 | | | |
| 38 | 80 | — | 3.4 | | | | 8.3 | 8.3 | | | |
| 39 | 41.7 | 41.7 | — | | | | 8.3 | 8.3 | | | |
| 40 | 62.5 | 20.9 | — | | | | 8.3 | 8.3 | | | |
| 41 | 40 | — | 59 | 0.5 | | | | | | | 0.5 |
| 42 | 30 | — | 5 | 5 | | | | | | | 50 |
| 43 | 60 | — | 5 | 30 | | | | | | | 5 |
| 44 | 60 | — | 20 | 10 | | | | | | | 10 |
| 45 | 80 | — | 10 | 5 | | | | | | | 5 |
| 46 | 80 | — | 7 | 3 | | | | | | | 10 |
| 47 | 95 | — | 4 | 0.5 | | | | | | | 0.5 |
| 48 | 60 | | 20 | 10 | | | | | | 10 | |
| 49 | 80 | | 7 | 3 | | | | | | 10 | |

TABLE 2-continued (Ex. 1)(Group A)

| Nos | Molybdates (wt. %) | Glass A (wt. %) | Glass B (wt. %) | Fluorides (wt. %) $SrF_2$ | $BaF_2$ | $MgF_2$ | $CaF_2$ | Carbonates (wt. %) $SrCO_3$ | $BaCO_3$ | $MgCO_3$ | $CaCO_3$ |
|---|---|---|---|---|---|---|---|---|---|---|---|
| 50 | 60 | | 20 | 10 | | | | 10 | | | |
| 51 | 80 | — | 7 | 3 | | | | 10 | | | |
| 52 | 60 | | 20 | 10 | | | | | 10 | | |
| 53 | 80 | | 7 | 3 | | | | | 10 | | |
| 54 | 60 | — | 10 | | | 20 | | | | | 10 |
| 55 | 80 | — | 10 | | | 5 | | | | | 5 |
| 56 | 60 | — | 10 | | | | 20 | | | | 10 |
| 57 | 80 | — | 10 | | | | 5 | | | | 5 |
| 58 | 60 | — | 10 | | 20 | | | | | | 10 |
| 59 | 80 | — | 10 | | 5 | | | | | | 5 |
| 60 | 40 | — | 5 | 2 | | 1 | 2 | | | 25 | 25 |
| 61 | 60 | — | 20 | 5 | | | 5 | 3 | 3 | | 4 |
| | $MgMoO_4$ $Mg_2Mo_3O_{11}$ | | | | | | | | | | |
| 62 | 40 40 | 3.4 | | | | | 8.3 | 8.3 | | | |
| 63 | 30 30 | — | 20 | 2.5 | 2.5 | 2.5 | 2.5 | 2.5 | 2.5 | 2.5 | 2.5 |
| | $CaMoO_4$ | | | | | | | | | | |
| 64 | 25 | 58.4 | — | | | | 8.3 | 8.3 | | | |
| 65 | 41.7 | 41.7 | — | | | | 8.3 | 8.3 | | | |
| 66 | 62.5 | 20.9 | — | | | | 8.3 | 8.3 | | | |
| 67 | 80 | 3.4 | — | | | | 8.3 | 8.3 | | | |
| 68 | 41.7 | — | 41.7 | | | | 8.3 | 8.3 | | | |
| 69 | 62.5 | — | 20.9 | | | | 8.3 | 8.3 | | | |
| 70 | 40 | | 59 | 0.5 | | | | | | | 0.5 |
| 71 | 40 | | 5 | 5 | | | | | | | 50 |
| 72 | 60 | — | 5 | 30 | | | | | | | 5 |
| 73 | 60 | — | 20 | 10 | | | | | | | 10 |
| 74 | 80 | — | 10 | 5 | | | | | | | 5 |
| 75 | 80 | — | 7 | 3 | | | | | | | 10 |
| 76 | 95 | — | 4 | 0.5 | | | | | | | 0.5 |
| 77 | 40 | | 59 | | | | 0.5 | | 0.5 | | |
| 78 | 40 | | 5 | | | | 5 | | 50 | | |
| 79 | 60 | — | 5 | | | | 30 | | 5 | | |
| 80 | 60 | — | 20 | | | | 10 | | 10 | | |
| 81 | 80 | — | 10 | | | | 5 | | 5 | | |
| 82 | 80 | — | 7 | | | | 3 | | 10 | | |
| 83 | 95 | — | 4 | | | | 0.5 | | 0.5 | | |
| 84 | 60 | — | 20 | 10 | | | | | | 10 | |
| 85 | 80 | — | 7 | 3 | | | | | | 10 | |
| 86 | 60 | — | 20 | 10 | | | | 10 | | | |
| 87 | 80 | — | 7 | 3 | | | | 10 | | | |
| 88 | 60 | — | 20 | 10 | | | | | 10 | | |
| 89 | 80 | — | 7 | 3 | | | | | 10 | | |
| 90 | 60 | — | 10 | | | 20 | | | | | 10 |
| 91 | 80 | — | 10 | | | 5 | | | | | 5 |
| 92 | 60 | — | 10 | | | | 20 | | | | 10 |
| 93 | 80 | — | 10 | | | | 5 | | | | 5 |
| 94 | 60 | — | 10 | | 20 | | | | | | 10 |
| 95 | 80 | — | 10 | | 5 | | | | | | 5 |
| 96 | 40 | — | 5 | 2 | | 1 | 2 | 25 | | | 25 |
| 97 | 60 | — | 20 | | 5 | 5 | | 3 | 3 | | 4 |
| | $Ca_3MoO_6$ | | | | | | | | | | |
| 98 | 25 | — | 58.4 | | | | 8.3 | 8.3 | | | |
| 99 | 41.7 | — | 41.7 | | | | 8.3 | 8.3 | | | |
| 100 | 62.5 | — | 20.9 | | | | 8.3 | 8.3 | | | |
| 101 | 80 | — | 3.4 | | | | 8.3 | 8.3 | | | |
| 102 | 41.7 | 41.7 | — | | | | 8.3 | 8.3 | | | |
| 103 | 62.5 | 20.9 | — | | | | 8.3 | 8.3 | | | |
| 104 | 40 | — | 59 | | 0.5 | | | | | 0.5 | |
| 105 | 30 | — | 5 | | 5 | | | | | 50 | |
| 106 | 60 | — | 5 | | 30 | | | | | 5 | |
| 107 | 60 | — | 20 | | 10 | | | | | 10 | |
| 108 | 80 | — | 10 | 5 | | | | | | 5 | |
| 109 | 80 | — | 7 | | 3 | | | | | 10 | |
| 110 | 95 | 4 | | | 0.5 | | | | | 0.5 | |
| 111 | 60 | 20 | | | 10 | | | | | | 10 |
| 112 | 80 | 7 | — | | 3 | | | | | | 10 |
| 113 | 60 | 20 | — | | 10 | | | 10 | | | |
| 114 | 80 | — | 7 | | 3 | | | 10 | | | |
| 115 | 60 | | 20 | | 10 | | | | 10 | | |
| 116 | 80 | | 7 | | 3 | | | | 10 | | |
| 117 | 60 | — | 10 | | | 20 | | | | 10 | |
| 118 | 80 | — | 10 | | | 5 | | | | 5 | |
| 119 | 60 | — | 10 | | | | 20 | | | 10 | |
| 120 | 80 | — | 10 | | | | 5 | | | 5 | |
| 121 | 60 | — | 10 | 20 | | | | | | 10 | |

TABLE 2-continued

| | (Ex. 1)(Group A) Composition | | | | | | | | | | | |
|---|---|---|---|---|---|---|---|---|---|---|---|---|
| | Molybdates | | Glass A | Glass B | Fluorides (wt. %) | | | | Carbonates (wt. %) | | | |
| Nos | (wt. %) | | (wt. %) | (wt. %) | $SrF_2$ | $BaF_2$ | $MgF_2$ | $CaF_2$ | $SrCO_3$ | $BaCO_3$ | $MgCO_3$ | $CaCO_3$ |
| 122 | 80 | | — | 10 | 5 | | | | | | 5 | |
| 123 | 40 | | — | 5 | 2 | 2 | | 1 | | | 25 | 25 |
| 124 | 60 | | — | 20 | 5 | 5 | | | 3 | 3 | 4 | |
| | $CaMoO_4$ | $Ca_3MoO_6$ | | | | | | | | | | |
| 125 | 40 | 40 | 3.4 | — | | | | 8.3 | 8.3 | | | |
| 126 | 30 | 30 | — | 20 | 2.5 | 2.5 | 2.5 | 2.5 | 2.5 | 2.5 | 2.5 | 2.5 |
| | $SrMoO_4$ | | | | | | | | | | | |
| 127 | 25 | | 58.4 | — | | | | 8.3 | 8.3 | | | |
| 128 | 41.7 | | 41.7 | — | | | | 8.3 | 8.3 | | | |
| 129 | 62.5 | | 20.9 | — | | | | 8.3 | 8.3 | | | |
| 130 | 80 | | 3.4 | — | | | | 8.3 | 8.3 | | | |
| 131 | 41.7 | | — | 41.7 | | | | 8.3 | 8.3 | | | |
| 132 | 62.5 | | — | 20.9 | | | | 8.3 | 8.3 | | | |
| 133 | 40 | | | 59 | | | | 0.5 | 0.5 | | | |
| 134 | 40 | | | 5 | | | | 5 | 50 | | | |
| 135 | 60 | | — | 5 | | | | 30 | 5 | | | |
| 136 | 60 | | — | 20 | | | | 10 | 10 | | | |
| 137 | 80 | | — | 10 | | | | 5 | 5 | | | |
| 138 | 80 | | — | 7 | | | | 3 | 10 | | | |
| 139 | 95 | | — | 4 | | | | 0.5 | 0.5 | | | |
| 140 | 40 | | | 59 | | 0.5 | | | | | | 0.5 |
| 141 | 40 | | | 5 | | 5 | | | | | | 50 |
| 142 | 60 | | — | 5 | | 30 | | | | | | 5 |
| 143 | 60 | | — | 20 | | 10 | | | | | | 10 |
| 144 | 80 | | — | 10 | | 5 | | | | | | 5 |
| 145 | 80 | | — | 7 | | 3 | | | | | | 10 |
| 146 | 95 | | — | 4 | | 0.5 | | | | | | 0.5 |
| 147 | 60 | | — | 20 | | | | 10 | | | 10 | |
| 148 | 80 | | — | 7 | | | | 3 | | | 10 | |
| 149 | 60 | | — | 20 | | | | 10 | | | | 10 |
| 150 | 80 | | — | 7 | | | | 3 | | | | 10 |
| 151 | 60 | | — | 20 | | | | 10 | | 10 | | |
| 152 | 80 | | — | 7 | | | | 3 | | 10 | | |
| 153 | 60 | | — | 10 | | | 20 | | 10 | | | |
| 154 | 80 | | — | 10 | | | 5 | | 5 | | | |
| 155 | 60 | | — | 10 | 20 | | | | 10 | | | |
| 156 | 80 | | — | 10 | 5 | | | | 5 | | | |
| 157 | 60 | | — | 10 | | 20 | | | 10 | | | |
| 158 | 80 | | — | 10 | | 5 | | | 5 | | | |
| 159 | 40 | | — | 5 | 2 | 2 | 1 | | 25 | | | 25 |
| 160 | 60 | | — | 20 | 5 | 5 | | | 3 | 3 | | 4 |
| | $Sr_3MoO_6$ | | | | | | | | | | | |
| 161 | 25 | | — | 58.4 | | | | 8.3 | 8.3 | | | |
| 162 | 41.7 | | — | 41.7 | | | | 8.3 | 8.3 | | | |
| 163 | 62.5 | | — | 20.9 | | | | 8.3 | 8.3 | | | |
| 164 | 80 | | — | 3.4 | | | | 8.3 | 8.3 | | | |
| 165 | 41.7 | | 41.7 | — | | | | 8.3 | 8.3 | | | |
| 166 | 62.5 | | 20.9 | | | | | 8.3 | 8.3 | | | |
| 167 | 40 | | — | 59 | 0.5 | | | | | 0.5 | | |
| 168 | 40 | | — | 5 | 5 | | | | | 50 | | |
| 169 | 60 | | — | 5 | 30 | | | | | 5 | | |
| 170 | 60 | | — | 20 | 10 | | | | | 10 | | |
| 171 | 80 | | — | 10 | 5 | | | | | 5 | | |
| 172 | 80 | | — | 7 | 3 | | | | | 10 | | |
| 173 | 95 | | | 4 | 0.5 | | | | | 0.5 | | |
| 174 | 60 | | | 20 | 10 | | | | | | 10 | |
| 175 | 80 | | | 7 | 3 | | | | | | 10 | |
| 176 | 60 | | | 20 | 10 | | | | | | | 10 |
| 177 | 80 | | — | 7 | 3 | | | | | | | 10 |
| 178 | 60 | | | 20 | 10 | | | | 10 | | | |
| 179 | 80 | | | 7 | 3 | | | | 10 | | | |
| 180 | 60 | | — | 10 | | | 20 | | | 10 | | |
| 181 | 80 | | — | 10 | | | 5 | | | 5 | | |
| 182 | 60 | | — | 10 | | | | 20 | | 10 | | |
| 183 | 80 | | — | 10 | | | | 5 | | 5 | | |
| 184 | 60 | | — | 10 | | 20 | | | | 10 | | |
| 185 | 80 | | — | 10 | | 5 | | | | 5 | | |
| 186 | 40 | | — | 5 | | 2 | 1 | 2 | | 25 | 25 | |
| 187 | 60 | | — | 20 | | 5 | | 5 | 3 | 3 | | 4 |
| | $SrMoO_4$ | $Sr_3MoO_6$ | — | | | | | | | | | |
| 188 | 40 | 40 | 3.4 | | | | | 8.3 | 8.3 | | | |
| 189 | 30 | 30 | — | 20 | 2.5 | 2.5 | 2.5 | 2.5 | 2.5 | 2.5 | 2.5 | 2.5 |
| | $BaMoO_4$ | | | | | | | | | | | |
| 190 | 25 | | 58.4 | — | | | | 8.3 | 8.3 | | | |
| 191 | 41.7 | | 41.7 | — | | | | 8.3 | 8.3 | | | |

TABLE 2-continued

| | (Ex. 1)(Group A) Composition | | | | | | | | | | |
|---|---|---|---|---|---|---|---|---|---|---|---|
| | | Glass | Glass | Fluorides (wt. %) | | | | Carbonates (wt. %) | | | |
| Nos | Molybdates (wt. %) | A (wt. %) | B (wt. %) | $SrF_2$ | $BaF_2$ | $MgF_2$ | $CaF_2$ | $SrCO_3$ | $BaCO_3$ | $MgCO_3$ | $CaCO_3$ |
| 192 | 62.5 | 20.9 | — | | | | 8.3 | 8.3 | | | |
| 193 | 80 | 3.4 | — | | | | 8.3 | 8.3 | | | |
| 194 | 41.7 | — | 41.7 | | | | 8.3 | 8.3 | | | |
| 195 | 62.5 | — | 20.9 | | | | 8.3 | 8.3 | | | |
| 196 | 40 | — | 59 | | 0.5 | | | | | | 0.5 |
| 197 | 40 | — | 5 | | 5 | | | | | | 50 |
| 198 | 60 | — | 5 | | 30 | | | | | | 5 |
| 199 | 60 | — | 20 | | 10 | | | | | | 10 |
| 200 | 80 | — | 7 | | 3 | | | | | | 10 |
| 201 | 95 | — | 4 | | 0.5 | | | | | | 0.5 |
| 202 | 60 | — | 20 | | 10 | | | | | 10 | |
| 203 | 60 | — | 20 | | 10 | | | 10 | | | |
| 204 | 60 | — | 20 | | 10 | | | | 10 | | |
| 205 | 80 | — | 7 | | | 3 | | | | | 10 |
| 206 | 80 | — | 10 | | | | 3 | | | | 10 |
| 207 | 80 | — | 7 | 3 | | | | | | | 10 |
| 208 | 40 | — | 5 | | 5 | | | | | | 0.5 |
| 209 | 40 | — | 5 | | | | 5 | | | 10 | |
| 210 | 40 | — | 5 | | 2.5 | | 2.5 | | | 10 | |
| | $Ba_2MoO_5$ | | | | | | | | | | |
| 211 | 25 | — | 58.4 | | | | 8.3 | 8.3 | | | |
| 212 | 41.7 | — | 41.7 | | | | 8.3 | 8.3 | | | |
| 213 | 62.5 | — | 20.9 | | | | 8.3 | 8.3 | | | |
| 214 | 80 | — | 3.4 | | | | 8.3 | 8.3 | | | |
| 215 | 40 | — | 59 | 0.5 | | | | | | 0.5 | |
| 216 | 40 | — | 5 | 5 | | | | | | 50 | |
| 217 | 60 | — | 20 | 10 | | | | | | 10 | |
| 218 | 60 | — | 5 | 30 | | | | | | 5 | |
| 219 | 80 | — | 7 | 3 | | | | | | 10 | |
| 220 | 95 | — | 4 | 0.5 | | | | | | 0.5 | |
| 221 | 60 | — | 20 | 10 | | | | 3 | 3 | | 4 |
| 222 | 60 | — | 20 | 10 | | | | | | | 10 |
| 223 | 60 | — | 20 | 10 | | | | 10 | | | |
| 224 | 80 | — | 7 | | | 3 | | | | 10 | |
| 225 | 80 | — | 7 | | | | 3 | | | 10 | |
| 226 | 80 | — | 7 | | 3 | | | | | 10 | |
| 227 | 60 | — | 5 | | 20 | | 10 | | | 5 | |
| 228 | 60 | — | 5 | 20 | | | 10 | 2.5 | | | 2.5 |
| 229 | 60 | — | 5 | 10 | 10 | 10 | | | 3 | | 2 |
| | $Ba_3MoO_6$ | | | | | | | | | | |
| 230 | 41.7 | 41.7 | | | | | 8.3 | 8.3 | | | |
| 231 | 62.5 | 20.9 | | | | | 8.3 | 8.3 | | | |
| 232 | 41.7 | — | 41.7 | | | | 8.3 | 8.3 | | | |
| 233 | 62.5 | — | 20.9 | | | | 8.3 | 8.3 | | | |
| 234 | 40 | — | 59 | | | 0.5 | | 0.5 | | | |
| 235 | 40 | — | 5 | | | 5 | | 50 | | | |
| 236 | 60 | — | 20 | | | 10 | | 10 | | | |
| 237 | 60 | — | 5 | | | 30 | | 5 | | | |
| 238 | 80 | — | 7 | | | 3 | | 10 | | | |
| 239 | 95 | — | 4 | | | 0.5 | | 0.5 | | | |
| 240 | 60 | — | 20 | | | 10 | | | | 10 | |
| 241 | 60 | — | 20 | | | 10 | | | | | 10 |
| 242 | 60 | — | 20 | | | 10 | | | 10 | | |
| 243 | 80 | — | 7 | | | | 3 | 10 | | | |
| 244 | 80 | — | 7 | 3 | | | | 10 | | | |
| 245 | 80 | | 7 | | 3 | | | 10 | | | |
| | $BaMoO_4$ $Ba_3MoO_6$ | | | | | | | | | | |
| 246 | 40 40 | | 7 | | 1.5 | 1.5 | | 5 | | | 5 |
| | $BaMoO_4$ $Ba_2MoO_5$ | $Ba_3MoO_6$ | | | | | | | | | |
| 247 | 30 20 | 20 | 7 | 1 | 0.5 | 0.5 | 1 | 3 | 3 | 2 | 2 |
| 248 | 20.8 20.8 | 20.8 | | | | | 8.4 | 8.4 | | | |
| 249 | $(Mg_{0.3}Ca_{0.7})MoO_4$ 41.7 | 41.7 | — | 8.3 | | | | | | | 8.3 |
| 250 | $(Mg_{0.7}Ca_{0.3})MoO_4$ 41.7 | 41.7 | — | 8.3 | | | | | | | 8.3 |
| 251 | $(Ca_{0.3}Sr_{0.7})MoO_4$ 41.7 | 41.7 | — | 8.3 | | | | | | | 8.3 |
| 252 | $(Ca_{0.7}Sr_{0.3})MoO_4$ 41.7 | 41.7 | — | 8.3 | | | | | | | 8.3 |
| 253 | $(Mg_{0.3}Ba_{0.7})MoO_4$ 41.7 | 41.7 | — | 8.3 | | | | | | | 8.3 |
| 254 | $(Mg_{0.7}Ba_{0.3})MoO_4$ 41.7 | 41.7 | — | 8.3 | | | | | | | 8.3 |
| 255 | $(Mg_{0.2}Ca_{0.2}Ba_{0.6})MoO_4$ 41.7 | 41.7 | — | 8.3 | | | | | | | 8.3 |
| 256 | $(Mg_{0.3}Ca_{0.4}Ba_{0.3})MoO_4$ 41.7 | 41.7 | — | 8.3 | | | | | | | 8.3 |
| 257 | $(Ca_{0.2}Sr_{0.6}Ba_{0.2})MoO_4$ 41.7 | 41.7 | — | 8.3 | | | | | | | 8.3 |
| 258 | $(Ca_{0.4}Sr_{0.3}Ba_{0.3})MoO_4$ 41.7 | 41.7 | — | 8.3 | | | | | | | 8.3 |
| 259 | $(Mg_{0.2}Ca_{0.2}Sr_{0.2}Ba_{0.4})MoO_4$ 41.7 | 41.7 | — | 8.3 | | | | | | | 8.3 |
| 260 | $(Mg_{0.2}Ca_{0.3}Sr_{0.3}Ba_{0.2})MoO_4$ 41.7 | 41.7 | — | 8.3 | | | | | | | 8.3 |
| 261 | $(Ca_{2.0}Sr_{1.0})MoO_6$ 41.7 | 41.7 | — | 8.3 | | | | | | | 8.3 |
| 262 | $(Ca_{1.0}Sr_{2.0})MoO_6$ 41.7 | 41.7 | — | 8.3 | | | | | | | 8.3 |

TABLE 2-continued (Ex. 1)(Group A)

| Nos | Molybdates (wt. %) | Glass A (wt. %) | Glass B (wt. %) | Fluorides (wt. %) $SrF_2$ | $BaF_2$ | $MgF_2$ | $CaF_2$ | Carbonates (wt. %) $SrCO_3$ | $BaCO_3$ | $MgCO_3$ | $CaCO_3$ |
|---|---|---|---|---|---|---|---|---|---|---|---|
| 263 | $(Sr_{2.0}Ba_{1.0})MoO_6$ 41.7 | 41.7 | — | 8.3 | | | | | | | 8.3 |
| 264 | $(Sr_{1.0}Ba_{2.0})MoO_6$ 41.7 | 41.7 | — | 8.3 | | | | | | | 8.3 |
| 265 | $MgMoO_4$ 29.2<br>$Ca_3MoO_6$ 33.4 | — | 20.8 | | | | 8.3 | 8.3 | | | |
| 266 | $CaMoO_4$ 29.2<br>$Sr_3MoO_6$ 33.4 | — | 20.8 | | | | 8.3 | 8.3 | | | |
| 267 | $SrMoO_4$ 29.2<br>$Ba_2MoO_5$ 33.4 | — | 20.8 | | | | 8.3 | 8.3 | | | |
| 268 | $BaMoO_4$ 29.2<br>$Mg_2Mo_3O_{11}$ 33.4 | — | 20.8 | | | | 8.3 | 8.3 | | | |
| 269 | $MgMoO_4$ 20.8<br>$Sr_3MoO_6$ 20.8<br>$Ba_3MoO_6$ 20.8 | — | 20.8 | | | | 8.3 | 8.3 | | | |
| 270 | $Mg_2Mo_3O_{11}$ 12.5<br>$CaMoO_4$ 16.7<br>$SrMoO_4$ 16.7<br>$BaMoO_4$ 16.7 | — | 20.8 | | | | 8.3 | 8.3 | | | |
| 271 | $MgMoO_4$ 30<br>$Ca_3MoO_6$ 30 | — | 20 | | | | 10 | 10 | | | |
| 272 | $CaMoO_4$ 30<br>$Sr_3MoO_6$ 30 | — | 20 | | | | 10 | 10 | | | |
| 273 | $SrMoO_4$ 30<br>$Ba_2MoO_5$ 30 | — | 20 | | | | 10 | 10 | | | |
| 274 | $BaMoO_4$ 30<br>$Mg_2Mo_3O_{11}$ 30 | — | 20 | | | | 10 | 10 | | | |
| 275 | $MgMoO_4$ 20<br>$Sr_3MoO_6$ 20<br>$Ba_3MoO_6$ 20 | — | 20 | | | | 10 | 10 | | | |
| 276 | $Mg_2Mo_3O_{11}$ 15<br>$CaMoO_4$ 15<br>$SrMoO_4$ 15<br>$BaMoO_4$ 15 | — | 20 | | | | 10 | 10 | | | |

TABLE 3

(Ex. 1-Group B)

| NOs | Molybdate (wt. %) | Glass A (wt. %) | Glass B (wt. %) | Fluorides (wt. %) $SrF_2$ | $BaF_2$ | $MgF_2$ | $CaF_2$ | Carbonate (wt. %) $SrCO_3$ | $BaCO_3$ | $MgCO_3$ | $CaCO_3$ |
|---|---|---|---|---|---|---|---|---|---|---|---|
| | $ZnMoO_4$ | | | | | | | | | | |
| 1 | 45.9 | 37.5 | — | | | | 8.3 | 8.3 | | | |
| 2 | 54.2 | 29.2 | — | | | | 8.3 | 8.3 | | | |
| 3 | 66.7 | 16.7 | — | | | | 8.3 | 8.3 | | | |
| 4 | 80 | 3.4 | — | | | | 8.3 | 8.3 | | | |
| 5 | 54.2 | — | 29.2 | | | | 8.3 | 8.3 | | | |
| 6 | 66.7 | — | 16.7 | | | | 8.3 | 8.3 | | | |
| 7 | 65 | — | 34 | | | 0.5 | | | | | 0.5 |
| 8 | 65 | — | 4 | | | 1 | | | | | 30 |
| 9 | 75 | — | 4 | | | 20 | | | | | 1 |
| 10 | 75 | — | 10 | | | 3 | | | | | 12 |
| 11 | 85 | — | 5 | | | 5 | | | | | 5 |
| 12 | 95 | — | 4 | | | 0.5 | | | | | 0.5 |
| 13 | 65 | — | 4 | | | 1 | | | | 30 | |
| 14 | 75 | — | 10 | | | 3 | | | | 12 | |
| 15 | 65 | — | 4 | | | 1 | | 30 | | | |
| 16 | 75 | — | 10 | | | 3 | | 12 | | | |
| 17 | 65 | — | 4 | | | 1 | | | 30 | | |
| 18 | 75 | — | 10 | | | 3 | | | 12 | | |
| 19 | 75 | — | 4 | | | | 20 | | | | 1 |
| 20 | 85 | — | 5 | | | | 5 | | | | 5 |
| 21 | 75 | — | 4 | 20 | | | | | | | 1 |
| 22 | 85 | — | 5 | 5 | | | | | | | 5 |
| 23 | 75 | — | 4 | | 20 | | | | | | 1 |
| 24 | 85 | — | 5 | | 5 | | | | | | 5 |
| 25 | 75 | — | 10 | | | 3 | | 6 | 6 | | |
| 26 | 75 | — | 10 | 1.5 | | | 1.5 | | 6 | | 6 |
| 27 | 75 | — | 10 | 1 | 1 | | 1 | 4 | 4 | | 4 |
| | $ZnMo_2O_7$ | | | | | | | | | | |
| 28 | 45.9 | 37.5 | — | | | | 8.3 | 8.3 | | | |
| 29 | 54.2 | 29.2 | — | | | | 8.3 | 8.3 | | | |
| 30 | 66.7 | 16.7 | — | | | | 8.3 | 8.3 | | | |
| 31 | 80 | 3.4 | — | | | | 8.3 | 8.3 | | | |

TABLE 3-continued (Ex. 1-Group B)

| NOs | Molybdate (wt. %) | Glass A (wt. %) | Glass B (wt. %) | Fluorides (wt. %) | | | | Carbonate (wt. %) | | | |
|---|---|---|---|---|---|---|---|---|---|---|---|
| | | | | $SrF_2$ | $BaF_2$ | $MgF_2$ | $CaF_2$ | $SrCO_3$ | $BaCO_3$ | $MgCO_3$ | $CaCO_3$ |
| 32 | 54.2 | — | 29.2 | | | | 8.3 | 8.3 | | | |
| 33 | 66.7 | — | 16.7 | | | | 8.3 | 8.3 | | | |
| 34 | 65 | — | 34 | | | | 0.5 | 0.5 | | | |
| 35 | 65 | — | 4 | | | | 1 | 30 | | | |
| 36 | 75 | — | 4 | | | | 20 | 1 | | | |
| 37 | 75 | — | 10 | | | | 3 | 12 | | | |
| 38 | 85 | — | 5 | | | | 5 | 5 | | | |
| 39 | 95 | — | 4 | | | | 0.5 | 0.5 | | | |
| 40 | 65 | — | 4 | | | | 1 | | | 30 | |
| 41 | 75 | — | 10 | | | | 3 | | | 12 | |
| 42 | 65 | — | 4 | | | | 1 | | | | 30 |
| 43 | 75 | — | 10 | | | | 3 | | | | 12 |
| 44 | 65 | — | 4 | | | | 1 | | 30 | | |
| 45 | 75 | — | 10 | | | | 3 | | 12 | | |
| 46 | 75 | — | 4 | | | 20 | | 1 | | | |
| 47 | 85 | — | 5 | | | 5 | | 5 | | | |
| 48 | 75 | — | 4 | 20 | | | | 1 | | | |
| 49 | 85 | — | 5 | 5 | | | | 5 | | | |
| 50 | 75 | — | 4 | | 20 | | | 1 | | | |
| 51 | 85 | — | 5 | | 5 | | | 5 | | | |
| 52 | 65 | — | 4 | | | | 1 | | 15 | 15 | |
| 53 | 65 | — | 4 | 0.5 | | 0.5 | | 20 | | | 10 |
| 54 | 65 | — | 4 | | 0.5 | | 0.5 | | 15 | | 15 |
| | $Zn_3Mo_2O_9$ | | | | | | | | | | |
| 55 | 54.2 | 29.2 | — | | | | 8.3 | 8.3 | | | |
| 56 | 66.7 | 16.7 | — | | | | 8.3 | 8.3 | | | |
| 57 | 54.2 | — | 29.2 | | | | 8.3 | 8.3 | | | |
| 58 | 66.7 | — | 16.7 | | | | 8.3 | 8.3 | | | |
| 59 | 65 | — | 34 | 0.5 | | | | | 0.5 | | |
| 60 | 65 | — | 4 | 1 | | | | | 30 | | |
| 61 | 75 | — | 4 | 20 | | | | | 1 | | |
| 62 | 75 | — | 10 | 3 | | | | | 12 | | |
| 63 | 85 | — | 5 | 5 | | | | | 5 | | |
| 64 | 95 | — | 4 | 0.5 | | | | | 0.5 | | |
| 65 | 65 | — | 4 | 1 | | | | | | 30 | |
| 66 | 75 | — | 10 | 3 | | | | | | 12 | |
| 67 | 65 | — | 4 | 1 | | | | | | | 30 |
| 68 | 75 | — | 10 | 3 | | | | | | | 12 |
| 69 | 65 | — | 4 | 1 | | | | 30 | | | |
| 70 | 75 | — | 10 | 3 | | | | 12 | | | |
| 71 | 75 | — | 4 | | | 20 | | | 1 | | |
| 72 | 85 | — | 5 | | | 5 | | | 5 | | |
| 73 | 75 | — | 4 | | | | 20 | | 1 | | |
| 74 | 85 | — | 5 | | | | 5 | | 5 | | |
| 75 | 75 | — | 4 | | 20 | | | | 1 | | |
| 76 | 85 | — | 5 | | 5 | | | | 5 | | |
| 77 | 85 | — | 5 | 5 | | | | 2.5 | | | 2.5 |
| 78 | 85 | — | 5 | | 2.5 | | 2.5 | | 2.5 | 2.5 | |
| 79 | 85 | — | 5 | 2.5 | 2.5 | | | 1 | 3 | | 1 |
| 80 | $ZnMoO_4$ 35<br>$ZnMo_2O_7$ 40 | — | 10 | | | 3 | | | | | 12 |
| 81 | $ZnMoO_4$ 25<br>$ZnMo_2O_7$ 25<br>$Zn_3Mo_2O_9$ 16.7 | 16.7 | — | | | | 8.3 | 8.3 | | | |
| 82 | $ZnMoO_4$ 20<br>$ZnMo_2O_7$ 25<br>$Zn_3Mo_2O_9$ 30 | — | 10 | 1.5 | | | 1.5 | | 6 | 6 | |
| 83 | $ZnMoO_4$ 20<br>$ZnMo_2O_7$ 25<br>$Zn_3Mo_2O_9$ 30 | — | 10 | 1 | 1 | 0.5 | 0.5 | 3 | 3 | 3 | 3 |

TABLE 4

(Ex. 1-Group C)

| NOs | Molybdate $Al_2Mo_3O_{12}$ (wt. %) | Glass A (wt. %) | Glass B (wt. %) | Composition Fluorides (wt. %) | | | | Carbonate ( %) | | | |
|---|---|---|---|---|---|---|---|---|---|---|---|
| | | | | $SrF_2$ | $BaF_2$ | $MgF_2$ | $CaF_2$ | $SrCO_3$ | $BaCO_3$ | $MgCO_3$ | $CaCO_3$ |
| 1 | 41.7 | 41.7 | — | | | | 8.3 | 8.3 | | | |
| 2 | 54.2 | 29.2 | — | | | | 8.3 | 8.3 | | | |
| 3 | 66.7 | 16.7 | — | | | | 8.3 | 8.3 | | | |
| 4 | 80 | 3.4 | — | | | | 8.3 | 8.3 | | | |
| 5 | 41.7 | — | 41.7 | | | | 8.3 | 8.3 | | | |
| 6 | 54.2 | — | 29.3 | | | | 8.3 | 8.3 | | | |

TABLE 4-continued

| | (Ex. 1-Group C) Composition | | | | | | | | | | |
|---|---|---|---|---|---|---|---|---|---|---|---|
| | Molybdate $Al_2Mo_3O_{12}$ | Glass A | Glass B | Fluorides (wt. %) | | | | Carbonate ( %) | | | |
| NOs | (wt. %) | (wt. %) | (wt. %) | $SrF_2$ | $BaF_2$ | $MgF_2$ | $CaF_2$ | $SrCO_3$ | $BaCO_3$ | $MgCO_3$ | $CaCO_3$ |
| 7 | 66.7 | — | 16.7 | | | | 8.3 | 8.3 | | | |
| 8 | 80 | — | 3.4 | | | | 8.3 | 8.3 | | | |
| 9 | 66.8 | 8.3 | 8.3 | | | | 8.3 | 8.3 | | | |
| 10 | 60 | — | 39 | | 0.5 | | | 0.5 | | | |
| 11 | 60 | — | 5 | | 10 | | | 25 | | | |
| 12 | 75 | — | 10 | | 5 | | | 10 | | | |
| 13 | 85 | — | 7 | | 3 | | | 5 | | | |
| 14 | 95 | — | 4 | | 0.5 | | | 0.5 | | | |
| 15 | 60 | — | 39 | | | 0.5 | | | 0.5 | | |
| 16 | 60 | — | 5 | | | 10 | | | 25 | | |
| 17 | 75 | — | 10 | | | 5 | | | 10 | | |
| 18 | 85 | — | 7 | | | 3 | | | 5 | | |
| 19 | 95 | — | 4 | | | 0.5 | | | 0.5 | | |
| 20 | 75 | — | 10 | | 5 | | | | | 10 | |
| 21 | 85 | — | 7 | | 3 | | | | | 5 | |
| 22 | 75 | — | 10 | | 5 | | | | | | 10 |
| 23 | 85 | — | 7 | | 3 | | | | | | 5 |
| 24 | 75 | — | 10 | | 5 | | | | 10 | | |
| 25 | 85 | — | 7 | | 3 | | | | 5 | | |
| 26 | 75 | — | 10 | | | 5 | | 10 | | | |
| 27 | 85 | — | 7 | | | 3 | | 5 | | | |
| 28 | 75 | — | 10 | | | | 5 | 10 | | | |
| 29 | 85 | — | 7 | | | | 3 | 5 | | | |
| 30 | 75 | — | 10 | 5 | | | | 10 | | | |
| 31 | 85 | — | 7 | 3 | | | | 5 | | | |
| 32 | 75 | — | 10 | | 5 | | | | 5 | | 5 |
| 33 | 75 | — | 10 | 2.5 | | | 2.5 | 5 | | | 5 |
| 34 | 75 | — | 10 | 2 | 2 | 1 | | 3 | 4 | 3 | |
| 35 | 85 | — | 7 | 1 | 1 | | 1 | 2 | 2 | | 1 |

TABLE 5

| | (Ex. 1-Group D) Composition | | | | | | | | | | |
|---|---|---|---|---|---|---|---|---|---|---|---|
| | Molybdate | Glass A | Glass B | Fluorides (wt. %) | | | | Carbonates (wt. %) | | | |
| NOs | (wt. %) | (wt. %) | (wt. %) | $SrF_2$ | $BaF_2$ | $MgF_2$ | $CaF_2$ | $SrCO_3$ | $BaCO_3$ | $MgCO_3$ | $CaCO_3$ |
| | $ZrMo_2O_8$ | | | | | | | | | | |
| 1 | 29.2 | 54.2 | — | | | | 8.3 | 8.3 | | | |
| 2 | 45.9 | 37.5 | — | | | | 8.3 | 8.3 | | | |
| 3 | 62.5 | 20.9 | — | | | | 8.3 | 8.3 | | | |
| 4 | 80 | 3.4 | — | | | | 8.3 | 8.3 | | | |
| 5 | 45.9 | — | 37.5 | | | | 8.3 | 8.3 | | | |
| 6 | 62.5 | — | 20.9 | | | | 8.3 | 8.3 | | | |
| 7 | 45 | — | 54 | 0.5 | | | | | 0.5 | | |
| 8 | 45 | — | 4 | 1 | | | | | 50 | | |
| 9 | 60 | — | 20 | 5 | | | | | 15 | | |
| 10 | 60 | — | 10 | 20 | | | | | 10 | | |
| 11 | 80 | — | 10 | 5 | | | | | 5 | | |
| 12 | 80 | — | 7 | 10 | | | | | 3 | | |
| 13 | 95 | — | 4 | 0.5 | | | | | 0.5 | | |
| 14 | 45 | — | 54 | | | 0.5 | | | | | 0.5 |
| 15 | 45 | — | 4 | | | 1 | | | | | 50 |
| 16 | 60 | — | 20 | | | 5 | | | | | 15 |
| 17 | 60 | — | 10 | | | 20 | | | | | 10 |
| 18 | 80 | — | 10 | | | 5 | | | | | 5 |
| 19 | 80 | — | 7 | | | 10 | | | | | 3 |
| 20 | 95 | — | 4 | | | 0.5 | | | | | 0.5 |
| 21 | 60 | — | 20 | 5 | | | | | | 15 | |
| 22 | 80 | — | 10 | 5 | | | | | | 5 | |
| 23 | 60 | — | 20 | 5 | | | | | | | 15 |
| 24 | 80 | — | 10 | 5 | | | | | | | 5 |
| 25 | 60 | — | 20 | 5 | | | | 15 | | | |
| 26 | 80 | — | 10 | 5 | | | | 5 | | | |
| 27 | 60 | — | 10 | | | 20 | | | 10 | | |
| 28 | 80 | — | 7 | | | 10 | | | 3 | | |
| 29 | 60 | — | 10 | | | | 20 | | 10 | | |
| 30 | 80 | — | 7 | | | | 10 | | 3 | | |
| 31 | 60 | — | 10 | | 20 | | | | 10 | | |
| 32 | 80 | — | 7 | | 10 | | | | 3 | | |
| 33 | 45 | — | 4 | 1 | | | | 30 | | | 20 |
| 34 | 45 | — | 4 | | 0.5 | | 0.5 | 20 | 20 | 10 | |
| | $HfMo_2O_8$ | | | | | | | | | | |

TABLE 5-continued

| | (Ex. 1-Group D) Composition | | | | | | | | | | |
|---|---|---|---|---|---|---|---|---|---|---|---|
| | Molybdate | Glass A | Glass B | Fluorides (wt. %) | | | | Carbonates (wt. %) | | | |
| NOs | (wt. %) | (wt. %) | (wt. %) | $SrF_2$ | $BaF_2$ | $MgF_2$ | $CaF_2$ | $SrCO_3$ | $BaCO_3$ | $MgCO_3$ | $CaCO_3$ |
| 35 | 29.2 | — | 54.2 | | | | 8.3 | 8.3 | | | |
| 36 | 45.9 | — | 37.5 | | | | 8.3 | 8.3 | | | |
| 37 | 62.5 | — | 20.9 | | | | 8.3 | 8.3 | | | |
| 38 | 80 | — | 3.4 | | | | 8.3 | 8.3 | | | |
| 39 | 45.9 | 37.5 | — | | | | 8.3 | 8.3 | | | |
| 40 | 62.5 | 20.9 | — | | | | 8.3 | 8.3 | | | |
| 41 | 45 | — | 54 | | | | 0.5 | 0.5 | | | |
| 42 | 45 | — | 4 | | | | 1 | 50 | | | |
| 43 | 60 | — | 20 | | | | 5 | 15 | | | |
| 44 | 60 | — | 10 | | | | 20 | 10 | | | |
| 45 | 80 | — | 10 | | | | 5 | 5 | | | |
| 46 | 80 | — | 7 | | | | 10 | 3 | | | |
| 47 | 95 | — | 4 | | | | 0.5 | 0.5 | | | |
| 48 | 60 | — | 20 | | | | 5 | | | 15 | |
| 49 | 80 | — | 10 | | | | 5 | | | 5 | |
| 50 | 60 | — | 20 | | | | 5 | | | | 15 |
| 51 | 80 | — | 10 | | | | 5 | | | | 5 |
| 52 | 60 | — | 20 | | | | 5 | | 15 | | |
| 53 | 80 | — | 10 | | | | 5 | | 5 | | |
| 54 | 60 | — | 10 | | | 20 | | 10 | | | |
| 55 | 80 | — | 7 | | | 10 | | 3 | | | |
| 56 | 60 | — | 10 | 20 | | | | 10 | | | |
| 57 | 80 | — | 7 | 10 | | | | 3 | | | |
| 58 | 60 | — | 10 | | 20 | | | 10 | | | |
| 59 | 80 | — | 7 | | 10 | | | 3 | | | |
| 60 | 45 | — | 4 | | | | 1 | | 30 | | 20 |
| 61 | 45 | — | 4 | 0.5 | 0.5 | | | 20 | | 10 | 20 |
| | $(Zr_{0.5}Mo_{0.5})Mo_2O_8$ | | | | | | | | | | |
| 62 | 80 | — | 10 | 1 | 2 | 1 | 1 | 1 | 1 | 1 | 2 |
| 63 | $ZrMo_2O_8$ 40 | — | 10 | 5 | | | | | 5 | | |
| | $HfMo_2O_8$ 40 | | | | | | | | | | |
| 64 | $ZrMo_2O_8$ 40 | — | 10 | 1 | 2 | 1 | 1 | 1 | 1 | 1 | 2 |
| | $HfMo_2O_8$ 40 | | | | | | | | | | |

TABLE 6

| | (Ex. 1-Group E) Composition | | | | | | | | | | |
|---|---|---|---|---|---|---|---|---|---|---|---|
| | Molybdates | Glass A | Glass B | Fluorides (wt. %) | | | | Carbonate ( %) | | | |
| NOs | (wt. %) | (wt. %) | (wt. %) | $SrF_2$ | $BaF_2$ | $MgF_2$ | $CaF_2$ | $SrCO_3$ | $BaCO_3$ | $MgCO_3$ | $CaCO_3$ |
| | $Y_6MoO_{12}$ | | | | | | | | | | |
| 1 | 33.4 | 50 | — | | | | 8.3 | 8.3 | | | |
| 2 | 45.9 | 37.5 | — | | | | 8.3 | 8.3 | | | |
| 3 | 62.5 | 20.9 | — | | | | 8.3 | 8.3 | | | |
| 4 | 80 | 3.4 | — | | | | 8.3 | 8.3 | | | |
| 5 | 45.9 | — | 37.5 | | | | 8.3 | 8.3 | | | |
| 6 | 62.5 | — | 20.9 | | | | 8.3 | 8.3 | | | |
| 7 | 50 | — | 49 | 0.5 | | | | | | | 0.5 |
| 8 | 50 | — | 20 | 10 | | | | | | | 20 |
| 9 | 50 | — | 4 | 1 | | | | | | | 45 |
| 10 | 65 | — | 10 | 15 | | | | | | | 10 |
| 11 | 65 | — | 20 | 10 | | | | | | | 5 |
| 12 | 80 | — | 10 | 5 | | | | | | | 5 |
| 13 | 80 | — | 5 | 7.5 | | | | | | | 7.5 |
| 14 | 95 | — | 4 | 0.5 | | | | | | | 0.5 |
| 15 | 50 | — | 49 | | | | 0.5 | | 0.5 | | |
| 16 | 50 | — | 20 | | | | 10 | | 20 | | |
| 17 | 50 | — | 4 | | | | 1 | | 45 | | |
| 18 | 65 | — | 10 | | | | 15 | | 10 | | |
| 19 | 65 | — | 20 | | | | 10 | | 5 | | |
| 20 | 80 | — | 10 | | | | 5 | | 5 | | |
| 21 | 80 | — | 5 | | | | 7.5 | | 7.5 | | |
| 22 | 95 | — | 4 | | | | 0.5 | | 0.5 | | |
| 23 | 50 | — | 20 | 10 | | | | | | 20 | |
| 24 | 80 | — | 10 | 5 | | | | | | 5 | |
| 25 | 50 | — | 20 | 10 | | | | 20 | | | |
| 26 | 80 | — | 10 | 5 | | | | 10 | | | |
| 27 | 50 | — | 20 | 10 | | | | | 20 | | |
| 28 | 80 | — | 10 | 5 | | | | | 5 | | |
| 29 | 65 | — | 20 | | | 10 | | | | | 5 |
| 30 | 80 | — | 10 | | | 5 | | | | | 5 |
| 31 | 65 | — | 20 | | | | 10 | | | | 5 |

TABLE 6-continued

| | (Ex. 1-Group E) Composition | | | | | | | | | | |
|---|---|---|---|---|---|---|---|---|---|---|---|
| | Molybdates | Glass A | Glass B | Fluorides (wt. %) | | | | Carbonate ( %) | | | |
| NOs | (wt. %) | (wt. %) | (wt. %) | $SrF_2$ | $BaF_2$ | $MgF_2$ | $CaF_2$ | $SrCO_3$ | $BaCO_3$ | $MgCO_3$ | $CaCO_3$ |
| 32 | 80 | — | 10 | | | | 5 | | | | 5 |
| 33 | 65 | — | 20 | | 10 | | | | | | 5 |
| 34 | 80 | — | 10 | | 5 | | | | | | 5 |
| 35 | 50 | — | 20 | 10 | | | | | | 10 | 10 |
| 36 | 50 | — | 20 | | 5 | 5 | | 10 | 10 | | |
| 37 | 50 | — | 20 | 3 | 4 | 3 | | 5 | 5 | 10 | |
| 38 | 50 | — | 20 | 3 | 3 | 2 | 2 | 5 | 5 | 5 | 5 |
| | $La_6MoO_{12}$ | | | | | | | | | | |
| 39 | 33.4 | — | 50 | | | | 8.3 | 8.3 | | | |
| 40 | 45.9 | — | 37.5 | | | | 8.3 | 8.3 | | | |
| 41 | 62.5 | — | 20.9 | | | | 8.3 | 8.3 | | | |
| 42 | 80 | — | 3.4 | | | | 8.3 | 8.3 | | | |
| 43 | 45.9 | 37.5 | — | | | | 8.3 | 8.3 | | | |
| 44 | 62.5 | 20.9 | — | | | | 8.3 | 8.3 | | | |
| 45 | 50 | — | 49 | | 0.5 | | | | | 0.5 | |
| 46 | 50 | — | 20 | | 10 | | | | | 20 | |
| 47 | 50 | — | 4 | | 1 | | | | | 45 | |
| 48 | 65 | — | 10 | | 15 | | | | | 10 | |
| 49 | 65 | — | 20 | | 10 | | | | | 5 | |
| 50 | 80 | — | 10 | | 5 | | | | | 5 | |
| 51 | 80 | — | 5 | | 7.5 | | | | | 7.5 | |
| 52 | 95 | — | 4 | | 0.5 | | | | | 0.5 | |
| 53 | 80 | — | 5 | 7.5 | | | | | | | 7.5 |
| 54 | 50 | — | 20 | | | 5 | 5 | | | 20 | |
| 55 | 50 | — | 20 | 5 | 5 | | | | | 20 | |
| 56 | 50 | — | 20 | 4 | | 3 | 3 | | | 20 | |
| | $Ce_6MoO_{12}$ | | | | | | | | | | |
| 57 | 45.9 | 37.5 | — | | | | 8.3 | 8.3 | | | |
| 58 | 62.5 | — | 20.9 | | | | 8.3 | 8.3 | | | |
| 59 | 80 | — | 5 | 7.5 | | | | | | | 7.5 |
| | $Pr_6MoO_{12}$ | | | | | | | | | | |
| 60 | 45.9 | 37.5 | — | | | | 8.3 | 8.3 | | | |
| 61 | 62.5 | — | 20.9 | | | | 8.3 | 8.3 | | | |
| 62 | 80 | — | 5 | 7.5 | | | | | | | 7.5 |
| | $Nd_6MoO_{12}$ | | | | | | | | | | |
| 63 | 45.9 | 37.5 | — | | | | 8.3 | 8.3 | | | |
| 64 | 62.5 | — | | | | 8.3 | 8.3 | | | | |
| 65 | 80 | — | 5 | 7.5 | | | | | | | 7.5 |
| | $Sm_6MoO_{12}$ | | | | | | | | | | |
| 66 | 45.9 | 37.5 | — | | | | 8.3 | 8.3 | | | |
| 67 | 62.5 | — | 20.9 | | | | 8.3 | 8.3 | | | |
| 68 | 80 | — | 5 | 7.5 | | | | | | | 7.5 |
| | $Eu_6MoO_{12}$ | | | | | | | | | | |
| 69 | 45.9 | 37.5 | — | | | | 8.3 | 8.3 | | | |
| 70 | 62.5 | — | 20.9 | | | | 8.3 | 8.3 | | | |
| 71 | 80 | — | 5 | 7.5 | | | | | | | 7.5 |
| | $Gd_6MoO_{12}$ | | | | | | | | | | |
| 72 | 45.9 | 37.5 | — | | | | 8.3 | 8.3 | | | |
| 73 | 62.5 | — | 20.9 | | | | 8.3 | 8.3 | | | |
| 74 | 80 | — | 5 | 7.5 | | | | | | | 7.5 |
| | $Tb_6MoO_{12}$ | | | | | | | | | | |
| 75 | 45.9 | 37.5 | — | | | | 8.3 | 8.3 | | | |
| 76 | 62.5 | — | 20.9 | | | | 8.3 | 8.3 | | | |
| 77 | 80 | — | 5 | 7.5 | | | | | | 7.5 | |
| | $Dy_6MoO_{12}$ | | | | | | | | | | |
| 78 | 45.9 | 37.5 | — | | | | 8.3 | 8.3 | | | |
| 79 | 62.5 | — | 20.9 | | | | 8.3 | 8.3 | | | |
| 80 | 80 | — | 5 | 7.5 | | | | | | | 7.5 |
| | $Ho_6MoO_{12}$ | | | | | | | | | | |
| 81 | 45.9 | 37.5 | — | | | | 8.3 | 8.3 | | | |
| 82 | 62.5 | — | 20.9 | | | | 8.3 | 8.3 | | | |
| 83 | 80 | — | 5 | 7.5 | | | | | | | 7.5 |
| | $Er_6MoO_{12}$ | | | | | | | | | | |
| 84 | 45.9 | 37.5 | — | | | | 8.3 | 8.3 | | | |
| 85 | 62.5 | — | 20.9 | | | | 8.3 | 8.3 | | | |
| 86 | 80 | — | 5 | 7.5 | | | | | | | 7.5 |
| | $Tm_6MoO_{12}$ | | | | | | | | | | |
| 87 | 45.9 | 37.5 | — | | | | 8.3 | 8.3 | | | |
| 88 | 62.5 | — | 20.9 | | | | 8.3 | 8.3 | | | |
| 89 | 80 | — | 5 | 7.5 | | | | | | | 7.5 |
| | $Yb_6MoO_{12}$ | | | | | | | | | | |
| 90 | 45.9 | 37.5 | — | | | | 8.3 | 8.3 | | | |
| 91 | 62.5 | — | 20.9 | | | | 8.3 | 8.3 | | | |

TABLE 6-continued

| | (Ex. 1-Group E) Composition | | | | | | | | | | |
|---|---|---|---|---|---|---|---|---|---|---|---|
| | Molybdates | Glass A | Glass B | Fluorides (wt. %) | | | | Carbonate ( %) | | | |
| NOs | (wt. %) | (wt. %) | (wt. %) | $SrF_2$ | $BaF_2$ | $MgF_2$ | $CaF_2$ | $SrCO_3$ | $BaCO_3$ | $MgCO_3$ | $CaCO_3$ |
| 92 | 80 $Lu_6MoO_{12}$ | — | 5 | 7.5 | | | | | | | 7.5 |
| 93 | 45.9 | 37.5 | — | | | | 8.3 | 8.3 | | | |
| 94 | 62.5 | — | 20.9 | | | | 8.3 | 8.3 | | | |
| 95 | 80 | — | 5 | 7.5 | | | | | | | 7.5 |
| 96 | $(Y_{3.0}Ce_{3.0})MoO_{12}$ 65 | — | 20 | | 10 | | | 5 | | | |
| 97 | $(Pr_{3.0}Eu_{3.0})MoO_{12}$ 65 | — | 20 | | 10 | | | 5 | | | |
| 98 | $(Gd_{3.0}Dy_{3.0})MoO_{12}$ 65 | — | 20 | | 10 | | | 5 | | | |
| 99 | $(La_{2.0}Nd_{2.0}Tb_{2.0})MoO_{12}$ 65 | — | 20 | | 10 | | | 5 | | | |
| 100 | $(Ho_{2.0}Tm_{2.0}Yb_{2.0})MoO_{12}$ 65 | — | 20 | | 10 | | | 5 | | | |
| 101 | $Y_6MoO_{12}$ 40 $La_6MoO_{12}$ 40 | — | 5 | | | | 7.5 | | 7.5 | | |
| 102 | $Nd_6MoO_{12}$ 40 $Sm_6MoO_{12}$ 40 | — | 5 | | | | 7.5 | | 7.5 | | |
| 103 | $Gd_6MoO_{12}$ 40 $Dy_6MoO_{12}$ 40 | — | 5 | | | | 7.5 | | 7.5 | | |
| 104 | $Ho_6MoO_{12}$ 20 $Er_6MoO_{12}$ 30 $Tm_6MoO_{12}$ 30 | — | 5 | | | | 7.5 | | 7.5 | | |
| 105 | $Yb_6MoO_{12}$ 20 $Lu_6MoO_{12}$ 30 $Eu_6MoO_{12}$ 30 | — | 5 | | | | 7.5 | | 7.5 | | |

TABLE 7

| | (Ex. 1-Group F) Composition | | | | | | | | | | |
|---|---|---|---|---|---|---|---|---|---|---|---|
| | Molybdates | Glass A | Glass B | Fluorides (wt. %) | | | | Carbonates (wt. %) | | | |
| NOs | (wt. %) | (wt. %) | (wt. %) | $SrF_2$ | $BaF_2$ | $MgF_2$ | $CaF_2$ | $SrCO_3$ | $BaCO_3$ | $MgCO_3$ | $CaCO_3$ |
| | $Nb_2Mo_3O_{14}$ | | | | | | | | | | |
| 1 | 37.5 | 45.9 | — | | | | 8.3 | 8.3 | | | |
| 2 | 54.2 | 29.2 | — | | | | 8.3 | 8.3 | | | |
| 3 | 66.7 | 16.7 | — | | | | 8.3 | 8.3 | | | |
| 4 | 80 | 3.4 | — | | | | 8.3 | 8.3 | | | |
| 5 | 54.2 | — | 29.2 | | | | 8.3 | 8.3 | | | |
| 6 | 66.7 | — | 16.7 | | | | 8.3 | 8.3 | | | |
| 7 | 55 | — | 44 | | 0.5 | | | | | 0.5 | |
| 8 | 55 | — | 4 | | 1 | | | | | 40 | |
| 9 | 70 | — | 10 | | 15 | | | | | 5 | |
| 10 | 70 | — | 10 | | 5 | | | | | 15 | |
| 11 | 80 | — | 7 | | 3 | | | | | 10 | |
| 12 | 95 | — | 4 | | 0.5 | | | | | 0.5 | |
| 13 | 70 | — | 10 | | 15 | | | | | | 5 |
| 14 | 80 | — | 7 | | 3 | | | | | | 10 |
| 15 | 70 | — | 10 | | 15 | | | 5 | | | |
| 16 | 80 | — | 7 | | 3 | | | 10 | | | |
| 17 | 70 | — | 10 | | 15 | | | | 5 | | |
| 18 | 80 | — | 7 | | 3 | | | | 10 | | |
| 19 | 55 | — | 4 | | | 1 | | | | 40 | |
| 20 | 70 | — | 10 | | | 5 | | | | 15 | |
| 21 | 55 | — | 4 | | | | 1 | | | 40 | |
| 22 | 70 | — | 10 | | | | 5 | | | 15 | |
| 23 | 55 | — | 4 | 1 | | | | | | 40 | |
| 24 | 70 | — | 10 | 5 | | | | | | 15 | |
| 25 | 70 | — | 10 | | 5 | | | 10 | | | 5 |
| 26 | 70 | — | 10 | 2.5 | | | 2.5 | 5 | 5 | | 5 |
| | $Ta_2Mo_3O_{14}$ | | | | | | | | | | |
| 27 | 37.5 | — | 45.9 | | | | 8.3 | 8.3 | | | |
| 28 | 54.2 | — | 29.2 | | | | 8.3 | 8.3 | | | |
| 29 | 66.7 | — | 16.7 | | | | 8.3 | 8.3 | | | |
| 30 | 80 | — | 3.4 | | | | 8.3 | 8.3 | | | |
| 31 | 54.2 | 29.2 | — | | | | 8.3 | 8.3 | | | |
| 32 | 66.7 | 16.7 | — | | | | 8.3 | 8.3 | | | |
| 33 | 55 | — | 44 | | | | 0.5 | 0.5 | | | |
| 34 | 55 | — | 4 | | | | 1 | 40 | | | |
| 35 | 70 | — | 10 | | | | 15 | 5 | | | |
| 36 | 70 | — | 10 | | | | 5 | 15 | | | |
| 37 | 80 | — | 7 | | | | 3 | 10 | | | |
| 38 | 95 | — | 4 | | | | 0.5 | 0.5 | | | |
| 39 | 70 | — | 10 | | | | 15 | | | 5 | |

TABLE 7-continued (Ex. 1-Group F)

| NOs | Molybdates (wt. %) | Glass A (wt. %) | Glass B (wt. %) | Fluorides (wt. %) $SrF_2$ | $BaF_2$ | $MgF_2$ | $CaF_2$ | Carbonates (wt. %) $SrCO_3$ | $BaCO_3$ | $MgCO_3$ | $CaCO_3$ |
|---|---|---|---|---|---|---|---|---|---|---|---|
| 40 | 80 | — | 7 | | | | 3 | | | 10 | |
| 41 | 70 | — | 10 | | | | 15 | | | | 5 |
| 42 | 80 | — | 7 | | | | 3 | | | | 10 |
| 43 | 70 | — | 10 | | | | 15 | | 5 | | |
| 44 | 80 | — | 7 | | | | 3 | | 10 | | |
| 45 | 55 | — | 4 | | | 1 | | 40 | | | |
| 46 | 70 | — | 10 | | | 5 | | 15 | | | |
| 47 | 55 | — | 4 | 1 | | | | 40 | | | |
| 48 | 70 | — | 10 | 5 | | | | 15 | | | |
| 49 | 55 | — | 4 | | 1 | | | 40 | | | |
| 50 | 70 | — | 10 | | 5 | | | 15 | | | |
| 51 | 70 | — | 10 | | 2.5 | | 2.5 | 10 | | | 5 |
| 52 | 70 | — | 10 | 2 | 2 | 1 | | 5 | 5 | | 5 |
| 53 | $(Nb_{1.0}Ta_{1.0})Mo_3O_{14}$ | 80 | 7 | 1 | 1 | 0.5 | 0.5 | 3 | 3 | 2 | 2 |
| 54 | $Nb_2Mo_3O_{14}$ 40<br>$Ta_2Mo_3O_{14}$ 40 | — | 7 | 1 | 1 | 0.5 | 0.5 | 3 | 3 | 2 | 2 |

TABLE 8

(Ex. 1-Group G)

| Nos | Molybdate $MnMoO_4$ (wt. %) | Glass A (wt. %) | Glass B (wt. %) | Fluorides (wt. %) $SrF_2$ | $BaF_2$ | $MgF_2$ | $CaF_2$ | Carbonates (wt. %) $SrCO_3$ | $BaCO_3$ | $MgCO_3$ | $CaCO_3$ |
|---|---|---|---|---|---|---|---|---|---|---|---|
| 1 | 41.7 | 41.7 | — | | | | 8.3 | 8.3 | | | |
| 2 | 54.2 | 29.2 | — | | | | 8.3 | 8.3 | | | |
| 3 | 66.7 | 16.7 | — | | | | 8.3 | 8.3 | | | |
| 4 | 80 | 3.4 | — | | | | 8.3 | 8.3 | | | |
| 5 | 41.7 | — | 41.7 | | | | 8.3 | 8.3 | | | |
| 6 | 54.2 | — | 29.2 | | | | 8.3 | 8.3 | | | |
| 7 | 66.7 | — | 16.7 | | | | 8.3 | 8.3 | | | |
| 8 | 80 | — | 3.4 | | | | 8.3 | 8.3 | | | |
| 9 | 66.8 | 8.3 | 8.3 | | | | 8.3 | 8.3 | | | |
| 10 | 65 | — | 34 | | | 0.5 | | 0.5 | | | |
| 11 | 65 | — | 5 | | | 5 | | 25 | | | |
| 12 | 75 | — | 10 | | | 5 | | 10 | | | |
| 13 | 75 | — | 5 | | | 15 | | 5 | | | |
| 14 | 85 | — | 7 | | | 3 | | 5 | | | |
| 15 | 95 | — | 4 | | | 0.5 | | 0.5 | | | |
| 16 | 65 | — | 34 | | | | 0.5 | | 0.5 | | |
| 17 | 65 | — | 5 | | | | 5 | | 25 | | |
| 18 | 75 | — | 10 | | | | 5 | | 10 | | |
| 19 | 75 | — | 5 | | | | 15 | | 5 | | |
| 20 | 85 | — | 7 | | | | 3 | | 5 | | |
| 21 | 95 | — | 4 | | | | 0.5 | | 0.5 | | |
| 22 | 75 | — | 10 | | | 5 | | | | 10 | |
| 23 | 85 | — | 7 | | | 3 | | | | 5 | |
| 24 | 75 | — | 10 | | | 5 | | | | | 10 |
| 25 | 85 | — | 7 | | | 3 | | | | | 5 |
| 26 | 75 | — | 10 | | | 5 | | | 10 | | |
| 27 | 85 | — | 7 | | | 3 | | | 5 | | |
| 28 | 75 | — | 5 | | | | 15 | 5 | | | |
| 29 | 85 | — | 7 | | | | 3 | 5 | | | |
| 30 | 75 | — | 5 | 15 | | | | 5 | | | |
| 31 | 85 | — | 7 | 3 | | | | 5 | | | |
| 32 | 75 | — | 5 | | 15 | | | 5 | | | |
| 33 | 85 | — | 7 | | 3 | | | 5 | | | |
| 34 | 65 | — | 5 | | | 5 | | | 15 | | 10 |
| 35 | 65 | — | 5 | 2.5 | | | 2.5 | 15 | | 10 | |
| 36 | 65 | — | 7 | 1 | 1 | | 1 | 10 | | 5 | 10 |

TABLE 9

(Ex. 1-plural Groups)

| Nos | A | B | C | D | E | F | G | Glass A | Glass B | Flourides | Carbonates |
|---|---|---|---|---|---|---|---|---|---|---|---|
| 1 | $MgMoO_4$<br>24.7 | $ZnMoO_4$<br>24.8 | | | | | | 49.5 | | $MgF_2$<br>0.5 | $MgCo_3$<br>0.5 |
| 2 | $CaMoO_4$<br>25.0 | | $Y_6MoO_{12}$<br>25.0 | | | | | 33.3 | | $MgF_2$<br>8.3 | $MgCo_3$<br>8.3 |
| 3 | $SrMoO_4$<br>25.0 | | | $Al_2Mo_3O_{12}$<br>25.0 | | | | 21.4 | | $MgF_2$<br>14.3 | $MgCo_3$<br>14.3 |

TABLE 9-continued (Ex. 1-plural Groups)

| Nos | A | B | C | D | E | F | G | Glass A | Glass B | Flourides | Carbonates |
|---|---|---|---|---|---|---|---|---|---|---|---|
| 4 | $BaMoO_4$ 25.0 | | | | $ZrMo_2O_8$ 25.0 | | | 12.5 | | $MgF_2$ 18.7 | $MgCo_3$ 18.8 |
| 5 | $Mg_2Mo_3O_{11}$ 24.2 | | | | | $Nb_2Mo_3O_{14}$ 24.2 | | 5.4 | | $MgF_2$ 23.1 | $MgCo_3$ 23.1 |
| 6 | $Ca_3MoO_6$ 47.5 | | | | | | $MnMoO_4$ 47.5 | 4.0 | | $CaF_2$ 0.5 | $MgCo_3$ 0.5 |
| 7 | | $ZnMo_2O_7$ 22.6 | $La_2Mo_2O_4$ 22.6 | | | | | 45.3 | | $CaF_2$ 9.0 | $CaCo_3$ 0.5 |
| 8 | | $Zn_3Mo_2O_9$ 23.1 | | $Al_2Mo_3O_{12}$ 23.1 | | | | 30.8 | | $CaF_2$ 15.4 | $CaCo_3$ 7.6 |
| 9 | | $ZnMoO_4$ 23.3 | | | $HfMo_2O_8$ 23.3 | | | 20.0 | | $CaF_2$ 20.0 | $CaCo_3$ 13.4 |
| 10 | | $ZnMo_2O_7$ 23.1 | | | | $Ta_2Mo_3O_{14}$ 23.1 | | 11.6 | | $CaF_2$ 24.9 | $CaCo_3$ 17.3 |
| 11 | | $Zn_3Mo_2O_9$ 32.0 | | | | | $MnMoO_4$ 32.0 | 7.1 | | $SrF_2$ 0.4 | $CaCo_3$ 28.5 |
| 12 | | | $CeMo_2O_8$ 30.0 | $Al_2Mo_3O_{12}$ 30.0 | | | | 2.5 | | $SrF_2$ 6.3 | $CaCo_3$ 31.2 |
| 13 | | | $Pr_2MoO_6$ 20.7 | | $ZrMoO_8$ 20.7 | | | 41.5 | | $SrF_2$ 16.6 | $SrCo_3$ 0.5 |
| 14 | | | $Nd_2Mo_3O_{12}$ 21.4 | | | $Nb_2Mo_3O_{14}$ 21.4 | | 28.6 | | $SrF_2$ 21.4 | $SrCo_3$ 7.2 |
| 15 | | | $Sm_6MoO_{12}$ 21.5 | | | | $MnMoO_4$ 21.5 | 18.4 | | $SrF_2$ 26.4 | $SrCo_3$ 12.3 |
| 16 | | | | $Al_2Mo_3O_{12}$ 30.7 | $HfMo_2O_8$ 30.7 | | | 15.3 | | $BaF_2$ 0.4 | $SrCo_3$ 22.9 |
| 17 | | | | $Al_2Mo_3O_{12}$ 30.0 | | $Ta_2Mo_3O_{14}$ 30.0 | | 6.7 | | $BaF_2$ 6.7 | $SrCo_3$ 26.6 |
| 18 | | | | $Al_2Mo_3O_{12}$ 28.2 | | | $MnMoO_4$ 28.2 | 2.4 | | $BaF_2$ 11.8 | $SrCo_3$ 29.4 |
| 19 | | | | | $ZrMo_2O_8$ 19.2 | $Nb_2Mo_3O_{14}$ 19.2 | | 38.3 | | $BaF_2$ 22.9 | $BaCo_3$ 0.4 |
| 20 | | | | | $HfMo_2O_8$ 19.6 | | $MnMoO_4$ 19.6 | 26.1 | | $BaF_2$ 18.1 | $BaCo_3$ 6.6 |
| 21 | | | | | | $Ta_2Mo_3O_{14}$ 29.0 | $MnMoO_4$ 29.0 | 24.9 | | $MgF_2$ 0.4 | $BaCo_3$ 16.7 |
| 22 | $Sr_3MoO_6$ 28.6 | $ZnMoO_4$ 14.3 | $Eu_2Mo_2O_7$ 14.3 | | | | | 14.3 | | $MgF_2$ 7.1 | $BaCo_3$ 21.4 |
| 23 | $BaMo_2O_7$ 18.8 | $ZnMo_2O_7$ 18.8 | | $Al_2Mo_3O_{12}$ 18.8 | | | | 6.1 | | $MgF_2$ 12.5 | $BaCo_3$ 25.0 |
| 24 | $Ba_3MoO_6$ 22.2 | $Zn_3Mo_2O_9$ 22.2 | | | $ZrMo_2O_8$ 8.9 | | | 2.2 | | $MgF_2$ 16.7 | $BaCo_3$ 27.8 |
| 25 | $MgMoO_4$ 13.9 | $ZnMoO_4$ 7.0 | | | | $Nb_2Mo_3O_{14}$ 13.9 | | 34.8 | | $MgF_2$ 30.0 | $MgCo_3$ 0.4 |
| 26 | $CaNoO_4$ 18.1 | $ZnMo_2O_7$ 18.1 | | | | | $MnMoO_4$ 18.1 | 36.2 | | $CaF_2$ 0.5 | $MgCo_3$ 9.0 |
| 27 | $SrMoO_4$ 7.7 | | $Gd_6MoO_{12}$ 23.1 | $Al_2Mo_3O_{12}$ 23.1 | | | | 23.1 | | $CaF_2$ 7.7 | $MgCo_3$ 15.3 |
| 28 | $BaMo_4O_{13}$ 13.3 | | $Tb_2Mo_3O_{12}$ 26.7 | | $HfMo_2O_8$ 13.3 | | | 13.3 | | $CaF_2$ 13.4 | $MgCo_3$ 20.0 |
| 29 | $Mg_2Mo_3O_{11}$ 23.5 | | $Dy_2MoO_6$ 23.5 | | | $Ta_2Mo_3O_{14}$ 5.9 | | 5.9 | | $CaF_2$ 17.6 | $MgCo_3$ 23.6 |
| 30 | $Ca_3MoO_{12}$ 8.3 | | $HO_6MoO_{12}$ 20.7 | | | | $MnMoO_4$ 20.7 | 2.1 | | $CaF_2$ 22.3 | $MgCo_3$ 25.9 |
| 31 | $Sr_3MoO_6$ 9.9 | | | $Al_2Mo_3O_{12}$ 29.7 | $ZrMo_2O_8$ 9.9 | | | 49.5 | | $SrF_2$ 0.5 | $CaCo_3$ 0.5 |
| 32 | $BaMo_7O_{24}$ 8.3 | | | $Al_2Mo_3O_{12}$ 25.0 | | $Nb_2Mo_3O_{14}$ 16.7 | | 33.3 | | $SrF_2$ 8.3 | $CaCo_3$ 8.4 |
| 33 | $MgMoO_4$ 14.3 | | | $Al_2Mo_3O_{12}$ 14.3 | | | $MnMoO_4$ 21.4 | 21.4 | | $SrF_2$ 14.3 | $CaCo_3$ 14.3 |
| 34 | $CaMoO_4$ 25.0 | | | | $HfMo_2O_8$ 12.5 | $Ta_2Mo_3O_{14}$ 12.5 | | 12.5 | | $SrF_2$ 18.7 | $CaCo_3$ 18.8 |
| 35 | $SrMoO_4$ 16.4 | | | | $ZrMo_2O_8$ 16.4 | | $MnMoO_4$ 16.4 | 5.5 | | $SrF_2$ 23.5 | $CaCo_3$ 21.8 |
| 36 | $BaMoO_4$ 26.6 | | | | | $Nb_2Mo_3O_{14}$ 10.6 | $MnMoO_4$ 20.6 | 2.7 | | 04970027-06206 $BaF_2$ 0.3 | $CaCo_3$ 33.2 |
| 37 | | $Zn_3Mo_2O_9$ 18.1 | $Er_2MoO_6$ 18.1 | $Al_2Mo_3O_{12}$ 9.0 | | | | | 45.3 | $BaF_2$ 9.0 | $SrCo_3$ 0.5 |
| 38 | | $ZnMoO_4$ 7.7 | $Tm_6MoO_{12}$ 23.1 | | $HfMo_2O_8$ 1.54 | | | | 30.8 | $BaF_2$ 15.3 | $SrCo_3$ 7.7 |
| 39 | | $ZnMo_2O_7$ 6.7 | $Yb_2Mo_4O_{15}$ 13.3 | | | $Ta_2Mo_3O_{14}$ 26.7 | | | 20.0 | $BaF_2$ 20.0 | $SrCo_3$ 13.3 |
| 40 | | $Zn_3Mo_2O_9$ 12.3 | $Lu_2Mo_3O_{12}$ 12.3 | | | | $MnMoO_4$ 11.6 | | 11.6 | $BaF_2$ 24.9 | $SrCo_3$ 17.3 |
| 41 | | $ZnMoO_4$ 28.5 | | $Al_2Mo_3O_{12}$ 28.5 | $ZrMo_2O_8$ 7.1 | | | | 7.1 | $MgF_2$ 0.4 | $SrCo_3$ 28.4 |

TABLE 9-continued (Ex. 1-plural Groups)

| Nos | A | B | C | D | E | F | G | Glass A | Glass B | Flourides | Carbonates |
|---|---|---|---|---|---|---|---|---|---|---|---|
| 42 | | $ZnMo_2O_7$ 25.0 | | $Al_2Mo_3O_{12}$ 18.8 | | $Nb_2Mo_3O_{14}$ 16.2 | | | 2.5 | $MgF_2$ 6.3 | $SrCo_3$ 31.2 |
| 43 | | $Zn_3Mo_2O_9$ 16.6 | | $Al_2Mo_3O_{12}$ 16.6 | | | $MnMoO_4$ 8.2 | | 41.5 | $MgF_2$ 16.6 | $BaCo_3$ 0.5 |
| 44 | | $ZnMoO_4$ 14.3 | | | $HfMo_2O_8$ 14.3 | $Ta_2Mo_3O_{14}$ 14.3 | | | 28.6 | $MgF_2$ 21.4 | $BaCo_3$ 7.1 |
| 45 | | $ZnMo_2O_7$ 18.4 | | | $ZrMo_2O_8$ 18.4 | | $MnMoO_4$ 6.1 | | 18.4 | $MgF_2$ 26.4 | $BaCo_3$ 12.3 |
| 46 | | $Zn_3Mo_2O_9$ 23.0 | | | | $Nb_2Mo_3O_{14}$ 23.0 | $MnMoO_4$ 15.3 | | 15.3 | $CaF_2$ 0.4 | $BaCo_3$ 23.0 |
| 47 | | | $Y_2Mo_3O_{12}$ 6.7 | $Al_2Mo_3O_{12}$ 26.7 | $HfMo_2O_8$ 26.7 | | | | 6.7 | $CaF_2$ 6.7 | $BaCo_3$ 26.5 |
| 48 | | | $La_6MoO_{12}$ 29.4 | $Al_2Mo_3O_{12}$ 9.4 | | $Ta_2Mo_3O_{14}$ 17.6 | | | 2.4 | $CaF_2$ 11.8 | $BaCo_3$ 29.4 |
| 49 | | | $Ce_2Mo_3O_{13}$ 23.0 | $Al_2Mo_3O_{12}$ 7.7 | | | $MnMoO_4$ 7.7 | | 38.3 | $CaF_2$ 23.0 | $MgCo_3$ 0.3 |
| 50 | | | $Pr_2Mo_3O_{12}$ 19.6 | | $ZrMo_2O_8$ 13.1 | $Nb_2Mo_3O_{14}$ 6.5 | | | 22.1 | $CaF_2$ 28.1 | $MgCo_3$ 6.6 |
| 51 | | | $Nd_2MoO_6$ 24.9 | | $HfMo_2O_8$ 24.9 | | $MnMoO_4$ 8.3 | | 24.9 | $SrF_2$ 0.4 | $MgCo_3$ 16.6 |
| 52 | | | $Sm_6MoO_{12}$ 21.4 | | | $Ta_2Mo_3O_{14}$ 28.6 | $MnMoO_4$ 7.1 | | 14.3 | $SrF_2$ 7.1 | $MgCo_3$ 21.5 |
| 53 | | | | $Al_2Mo_3O_{12}$ 18.7 | $ZrMo_2O_8$ 18.7 | $Nb_2Mo_3O_{14}$ 18.7 | | | 6.3 | $SrF_2$ 12.6 | $MgCo_3$ 25.0 |
| 54 | | | | $Al_2Mo_3O_{12}$ 16.7 | $HfMo_2O_8$ 16.7 | | $MnMoO_4$ 20.0 | | 2.2 | $SrF_2$ 16.7 | $MgCo_3$ 27.7 |
| 55 | | | | $Al_2Mo_3O_{12}$ 7.0 | | $Ta_2Mo_3O_{14}$ 13.9 | $MnMoO_4$ 13.9 | 34.8 | | $SrF_2$ 30.0 | $CaCo_3$ 0.4 |
| 56 | | | | | $ZrMo_2O_8$ 9.0 | $Nb_2Mo_3O_{14}$ 18.1 | $MnMoO_4$ 27.1 | 36.2 | | $BaF_2$ 0.5 | $CaCo_3$ 9.1 |
| 57 | $Mg_2Mo_3O_{11}$ 7.7 | $ZnMoO_4$ 15.4 | $EuMoO_4$ 15.4 | $Al_2Mo_3O_{12}$ 15.4 | | | | 23.1 | | $BaF_2$ 7.7 | $CaCo_3$ 15.3 |
| 58 | $Ca_3MoO_6$ 13.3 | $ZnMo_2O_7$ 13.3 | $Gd_2Mo_6O_{21}$ 13.3 | | $HfMo_2O_8$ 13.3 | | | 13.3 | | $BaF_2$ 13.4 | $CaCo_3$ 20.1 |
| 59 | $Sr_3MoO_6$ 8.8 | $Zn_3Mo_2O_9$ 8.8 | $Tb_6MoO_{12}$ 17.6 | | | $Ta_2Mo_3O_{14}$ 17.6 | | 5.9 | | $BaF_2$ 17.6 | $CaCo_3$ 23.7 |
| 60 | $Ba_2MoO_5$ 15.5 | $ZnMoO_4$ 15.5 | $Dy_6MoO_{12}$ 15.5 | | | | $MnMoO_4$ 3.1 | 2.1 | | $BaF_2$ 22.3 | $CaCo_3$ 26.0 |
| 61 | $MgMoO_4$ 10 | $ZnMo_2O_7$ 10 | | $Al_2Mo_3O_{12}$ 10 | $ZrMo_2O_8$ 20 | | | 49.5 | | $MgF_2$ 0.5 | $SrCo_3$ 0.5 |
| 62 | $CaMoO_4$ 12.5 | $Zn_3Mo_2O_9$ 12.5 | | $Al_2Mo_3O_{12}$ 12.5 | | $Nb_2Mo_3O_{14}$ 12.5 | | 33.3 | | $MgF_2$ 8.3 | $SrCo_3$ 8.4 |
| 63 | $SrMoO_4$ 14.3 | $ZnMoO_4$ 1.43 | | $Al_2Mo_3O_{12}$ 10.7 | | | $MnMoO_4$ 10.7 | 21.4 | | $MgF_2$ 14.3 | $SrCo_3$ 14.3 |
| 64 | $BaMoO_4$ 9.4 | $ZnMo_2O_7$ 15.6 | | | $HfMo_2O_8$ 15.6 | $Ta_2Mo_3O_{14}$ 9.4 | | 12.5 | | $MgF_2$ 18.8 | $SrCo_3$ 18.7 |
| 65 | $Mg_2Mo_3O_{11}$ 10.9 | $Zn_3Mo_2O_9$ 10.9 | | | $ZrMo_2O_8$ 13.7 | | $MnMoO_4$ 13.7 | 5.5 | | $MgF_2$ 23.5 | $SrCo_3$ 21.8 |
| 66 | $Ca_3MoO_3$ 15.9 | $ZnMoO$ 15.9 | | $Nb_2Mo_3O_{14}$ | $MnMoO_4$ | 15.9 | 15.9 | $CaF_2$ 2.4 | $SrCo_3$ | 0.3 | 33.3 |
| 67 | $Sr_3MoO_6$ 9.0 | | $Ho_2Mo_3O_{12}$ 13.6 | $Al_2Mo_3O_{12}$ 13.6 | $HfMo_2O_8$ 9.0 | | | 45.2 | | $CaF_2$ 9.0 | $BaCo_3$ 0.5 |
| 68 | $BaMo_3O_{10}$ 7.7 | | $Er_6MoO_{12}$ 15.4 | $Al_2Mo_3O_{12}$ 7.7 | | $Ta_2Mo_3O_{14}$ 15.4 | | 30.8 | | $CaF_2$ 15.4 | $BaCo_3$ 7.6 |
| 69 | $MgMoO_4$ 13.3 | | $Tm_2MoO_6$ 10.0 | $Al_2Mo_3O_{12}$ 10.0 | | | $MnMoO_4$ 13.3 | 20.0 | | $CaF_2$ 20.0 | $BaCo_3$ 13.4 |
| 70 | $CaMoO_4$ 17.3 | | $Yb_6MoO_{12}$ 5.8 | | $ZrMo_2O_8$ 17.3 | $Nb_2Mo_3O_{14}$ 5.8 | | 11.6 | | $CaF_2$ 24.9 | $BaCo_3$ 17.3 |
| 71 | $SrMoO_4$ 17.8 | | $Lu_6MoO_{12}$ 14.2 | | $HfMo_2O_8$ 17.8 | | $MnMoO_4$ 14.2 | 7.1 | | $SrF_2$ 0.4 | $BaCo_3$ 28.5 |
| 72 | $BaMoO_4$ 18.7 | | $Yb_6MoO_{12}$ 18.7 | | | $Ta_2Mo_3O_{14}$ 18.7 | $MnMoO_4$ 3.8 | 2.5 | | $SrF_2$ 6.3 | $BaCo_3$ 31.3 |
| 73 | $Mg_2Mo_3O_{11}$ 12.4 | | | $Al_2Mo_3O_{12}$ 12.4 | $ZrMo_2O_8$ 8.3 | $Nb_2Mo_3O_{14}$ 8.3 | | 41.5 | | $SrF_2$ 16.7 | $MgCo_3$ 0.4 |
| 74 | $Ca_3MoO_6$ 7.1 | | | $Al_2Mo_3O_{12}$ 14.3 | $HfMo_2O_8$ 14.3 | | $MnMoO_4$ 7.1 | 28.6 | | $SrF_2$ 21.4 | $MgCo_3$ 7.2 |
| 75 | $Sr_3MoO_6$ 12.3 | | | $Al_2Mo_3O_{12}$ 12.3 | | $Ta_2Mo_3O_{14}$ 9.2 | $MnMoO_4$ 9.2 | 18.4 | | $SrF_2$ 26.4 | $MgCo_3$ 12.2 |
| 76 | $BaMo_2O_7$ 15.3 | | | | $ZrMo_2O_8$ 15.3 | $Nb_2Mo_3O_{14}$ 15.3 | $MnMoO_4$ 15.3 | 15.3 | | $BaF_2$ 0.4 | $MgCo_3$ 23.1 |
| 77 | | $ZnMo_2O_7$ 13.3 | $La_2Mo_3O_{12}$ 6.7 | $Al_2Mo_3O_{12}$ 20.0 | $HfMo_2O_8$ 20.0 | | | 6.7 | | $BaF_2$ 6.7 | $MgCo_3$ 26.6 |
| 78 | | $Zn_3Mo_2O_9$ 8.8 | $Pr_6MoO_{12}$ 14.7 | $Al_2Mo_3O_{12}$ 20.6 | | $Ta_2Mo_3O_{14}$ 12.4 | | 2.4 | | $BaF_2$ 11.7 | $MgCo_3$ 29.4 |
| 79 | | $ZnMoO_4$ 7.7 | $Nd_6MoO_{12}$ 7.7 | $Al_2Mo_3O_{12}$ 7.7 | | | $MnMoO_4$ 15.3 | 38.3 | | $BaF_2$ 22.9 | $CaCo_3$ 0.4 |
| 80 | | $ZnMo_2O_7$ 9.8 | $Sm_2Mo_3O_{12}$ 9.8 | | $ZrMo_2O_8$ 9.8 | $Nb_2Mo_3O_{14}$ 9.8 | | 26.1 | | $BaF_2$ 28.1 | $CaCo_3$ 6.6 |

TABLE 9-continued (Ex. 1-plural Groups)

| Nos | A | B | C | D | E | F | G | Glass A | Glass B | Flourides | Carbonates |
|---|---|---|---|---|---|---|---|---|---|---|---|
| 81 | | $Zn_3Mo_2O_9$ 12.4 | $Eu_2MoO_6$ 16.6 | | $HfMo_2O_8$ 12.4 | | $MnMoO_4$ 16.6 | 24.9 | | $MgF_2$ 0.4 | $CaCo_3$ 16.1 |
| 82 | | $ZnMoO_4$ 14.3 | $Gd_2Mo_3O_{12}$ 14.3 | | | $Ta_2Mo_3O_{14}$ 14.3 | $MnMoO_4$ 14.3 | 14.3 | | $MgF_2$ 7.1 | $CaCo_3$ 21.4 |
| 83 | | $ZnMo_2O_7$ 15.6 | | $Al_2Mo_3O_{12}$ 15.6 | $ZrMo_2O_8$ 12.5 | $Nb_2Mo_3O_{14}$ 12.5 | | 6.3 | | $MgF_2$ 12.5 | $CaCo_3$ 25.0 |
| 84 | | $Zn_3Mo_2O_9$ 13.3 | | $Al_2Mo_3O_{12}$ 13.3 | $HfMo_2O_8$ 13.3 | | $MnMoO_4$ 13.3 | 2.2 | | $MgF_2$ 16.7 | $CaCo_3$ 27.9 |
| 85 | | $ZnMoO_4$ 7.0 | | $Al_2Mo_3O_{12}$ 7.0 | | $Ta_2Mo_3O_{14}$ 7.0 | $MnMoO_4$ 13.9 | 34.8 | | $MgF_2$ 30.0 | $SrCo_3$ 0.3 |
| 86 | | $ZnMo_2O_7$ 13.6 | | | $ZrMo_2O_8$ 13.6 | $Nb_2Mo_3O_{14}$ 13.6 | $MnMoO_4$ 13.6 | 36.2 | | $CaF_2$ 0.4 | $SrCo_3$ 9.0 |
| 87 | | | $Tb_2MoO_6$ 11.5 | $Al_2Mo_3O_{12}$ 15.4 | $HfMo_2O_8$ 11.5 | $Ta_2Mo_3O_{14}$ 15.4 | | 23.1 | | $CaF_2$ 7.7 | $SrCo_3$ 15.4 |
| 88 | | | $Dy_2MoO_6$ 13.3 | $Al_2Mo_3O_{12}$ 13.3 | $ZrMo_2O_8$ 13.3 | | $MnMoO_4$ 13.3 | 13.3 | | $CaF_2$ 13.4 | $SrCo_3$ 20.1 |
| 89 | | | $Ho_2MoO_6$ 11.8 | $Al_2Mo_3O_{12}$ 11.8 | | $Nb_2Mo_3O_{14}$ 11.8 | $MnMoO_4$ 17.6 | 5.9 | | $CaF_2$ 17.6 | $SrCo_3$ 23.5 |
| 90 | | | $Er_6MoO_{12}$ 12.4 | | $HfMo_2O_8$ 12.4 | $Ta_2Mo_3O_{14}$ 12.4 | $MnMoO_4$ 12.4 | 2.0 | | $CaF_2$ 22.4 | $SrCo_3$ 26.0 |
| 91 | | | | $Al_2Mo_3O_{12}$ 9.9 | $ZrMo_2O_8$ 19.8 | $Nb_2Mo_3O_{14}$ 9.9 | $MnMoO_4$ 9.9 | 49.5 | | $SrF_2$ 0.5 | $BaCo_3$ 0.5 |
| 92 | $MgMoO_4$ 8.3 | $Zn_3Mo_2O_4$ 16.7 | $Tm_3MoO_{12}$ 8.3 | $Al_2Mo_3O_{12}$ 8.3 | $HfMo_2O_8$ 8.3 | | | 33.4 | | $SrF_2$ 8.3 | $BaCo_3$ 8.4 |
| 93 | $CaMoO_4$ 7.1 | $ZaMoO_4$ 14.3 | $Yb_6MoO_{12}$ 14.3 | $Al_2Mo_3O_{12}$ 7.1 | | $Ta_2Mo_3O_{14}$ 7.1 | | 21.5 | | $SrF_2$ 14.3 | $BaCo_3$ 14.3 |
| 94 | $SrMoO_4$ 12.5 | $ZnMo_2O_7$ 12.5 | $Lu_6MoO_{12}$ 12.5 | $Al_2Mo_3O_{12}$ 6.3 | | | $MnMoO_4$ 6.3 | 12.5 | | $SrF_2$ 18.7 | $BaCo_3$ 18.7 |
| 95 | $BaMoO_4$ 10.9 | $Zn_3Mo_2O_9$ 5.5 | $Y_2Mo_3O_{12}$ 10.9 | | $ZrMo_2O_8$ 10.9 | $Nb_2Mo_3O_{14}$ 10.9 | | 5.5 | | $SrF_2$ 23.5 | $BaCo_3$ 21.9 |
| 96 | $Mg_2Mo_3O_{11}$ 13.3 | $ZnMoO_4$ 10.6 | $La_2MoO_6$ 13.3 | | $HfMo_2O_8$ 13.3 | | $MnMoO_4$ 13.3 | 2.6 | | $BaF_2$ 0.3 | $BaCo_3$ 33.3 |
| 97 | $Ca_3MoO_6$ 9.0 | $ZnMo_2O_7$ 9.0 | $Pr_2Mo_3O_{12}$ 9.0 | | | $Ta_2Mo_3O_{14}$ 9.0 | $MnMoO_4$ 9.0 | 45.3 | | $BaF_2$ 9.2 | $MgCo_3$ 0.5 |
| 98 | $Sr_3MoO_6$ 7.7 | $Zn_3Mo_2O_9$ 7.7 | | $Al_2Mo_3O_{12}$ 15.4 | $ZrMo_2O_8$ 7.7 | $Nb_2Mo_3O_{14}$ 7.7 | | 30.8 | | $BaF_2$ 15.4 | $MgCo_3$ 7.6 |
| 99 | $Ba_3MoO_6$ 6.7 | $ZnMoO_4$ 13.3 | | $Al_2Mo_3O_{12}$ 13.3 | $HfMo_2O_8$ 6.7 | | $MnMoO_4$ 6.7 | 20.0 | | $BaF_2$ 20.0 | $MgCo_3$ 13.3 |
| 100 | $MgMoO_4$ 5.8 | $ZnMo_2O_7$ 11.6 | | $Al_2Mo_3O_{12}$ 11.6 | | $Ta_2Mo_3O_{14}$ 11.6 | $MnMoO_4$ 5.8 | 11.6 | | $BaF_2$ 24.8 | $MgCo_3$ 17.2 |
| 101 | $CaMoO_4$ 14.2 | $Zn_3Mo_2O_9$ 14.2 | | | $ZrMo_2O_8$ 14.2 | $Nb_2Mo_3O_{14}$ 14.2 | $MnMoO_4$ 7.1 | 7.1 | | $MgF_2$ 0.4 | $MgCo_3$ 28.6 |
| 102 | $SrMoO_4$ 12.5 | | $Ce_6MoO_{12}$ 12.5 | $Al_2Mo_3O_{12}$ 12.5 | $HfMo_2O_8$ 12.5 | $Ta_2Mo_3O_{14}$ 10.0 | | 2.5 | | $MgF_2$ 6.2 | $MgCo_3$ 31.3 |
| 103 | $BaMoO_4$ 8.3 | | $Pr_2MoO_6$ 8.3 | $Al_2Mo_3O_{12}$ 8.3 | $ZrMo_2O_8$ 8.3 | | $MnMoO_4$ 8.3 | 41.5 | | $MgF_2$ 16.6 | $CaCo_3$ 0.4 |
| 104 | $Mg_2Mo_3O_{11}$ 7.1 | | $Nd_2Mo_3O_{12}$ 7.1 | $Al_2Mo_3O_{12}$ 7.1 | | $Nb_2Mo_3O_{14}$ 7.1 | $MnMoO_4$ 14.3 | 28.6 | | $MgF_2$ 21.5 | $CaCo_3$ 7.7 |
| 105 | $Ca_3MoO_6$ 6.1 | | $Sm_2Mo_2O_7$ 6.1 | | $HfMo_2O_8$ 6.1 | $Ta_2Mo_3O_{14}$ 12.3 | $MnMoO_4$ 12.3 | 18.4 | | $MgF_2$ 26.4 | $CaCo_3$ 12.3 |
| 106 | $Sr_3MoO_6$ 7.7 | | | $Al_2Mo_3O_{12}$ 15.3 | $ZrMo_2O_8$ 15.3 | $Nb_2Mo_3O_{14}$ 15.3 | $MnMoO_4$ 7.7 | 15.3 | | $CaF_2$ 0.4 | $CaCo_3$ 23.0 |
| 107 | | $ZnMoO_4$ 6.7 | $Eu_6MoO_{12}$ 13.3 | $Al_2Mo_3O_{12}$ 13.3 | $HfMo_2O_8$ 13.3 | $Ta_2Mo_3O_{14}$ 13.3 | | 6.7 | | $CaF_2$ 6.7 | $CaCo_3$ 26.7 |
| 108 | | $ZnMo_2O_7$ 9.4 | $Gd_2MoO_6$ 11.8 | $Al_2Mo_3O_{12}$ 11.8 | $ZrMo_2O_8$ 11.8 | | $MnMoO_4$ 11.8 | 2.3 | | $CaF_2$ 11.7 | $CaCo_3$ 29.4 |
| 109 | | $Zn_3Mo_2O_9$ 7.7 | $Tb_2Mo_3O_{12}$ 7.7 | $Al_2Mo_3O_{12}$ 7.7 | | $Nb_2Mo_3O_{14}$ 7.7 | $MnMoO_4$ 7.7 | 30.3 | | $CaF_2$ 22.9 | $SrCo_3$ 0.3 |
| 110 | | $ZnMoO_4$ 6.5 | $Dy_6MoO_{12}$ 13.1 | | $HfMo_2O_8$ 6.5 | $Ta_2Mo_3O_{14}$ 6.5 | $MnMoO_4$ 6.5 | 26.2 | | $CaF_2$ 28.1 | $SrCo_3$ 6.6 |
| 111 | | $ZnMo_2O_7$ 16.6 | | $Al_2Mo_3O_{12}$ 16.6 | $ZrMo_2O_8$ 8.3 | $Nb_2Mo_3O_{14}$ 8.3 | $MnMoO_4$ 8.3 | 24.9 | | $SrF_2$ 0.4 | $SrCo_3$ 16.6 |
| 112 | | | $Ho_6MoO_{12}$ 14.3 | $Al_2Mo_3O_{12}$ 14.3 | $HfMo_2O_8$ 14.3 | $Ta_2Mo_3O_{14}$ 7.1 | $MnMoO_4$ 7.1 | 14.3 | | $SrF_2$ 7.1 | $SrCo_3$ 21.5 |
| 113 | $MgMoO_4$ 6.3 | $Zn_3Mo_2O_9$ 12.5 | $Er_2MoO_6$ 12.5 | $Al_2Mo_3O_{12}$ 12.5 | $ZrMo_2O_8$ 6.3 | $Nb_2Mo_3O_{14}$ 6.3 | | 6.3 | | $SrF_2$ 12.4 | $SrCo_3$ 24.9 |
| 114 | $CaMoO_4$ 5.6 | $ZnMoO_4$ 11.1 | $Tm_2MoO_6$ 11.1 | $Al_2Mo_3O_{12}$ 20 | $HfMo_2O_8$ 8.9 | | $MnMoO_4$ 9.6 | 2.2 | | $SrF_2$ 16.7 | $SrCo_3$ 27.7 |
| 115 | $SrMoO_4$ 3.5 | $ZnMo_2O_7$ 3.5 | $Yb_6MoO_{12}$ 7.0 | $Al_2Mo_3O_{12}$ 7.0 | | $Ta_2Mo_3O_{14}$ 7.0 | $MnMoO_4$ 7.0 | 34.8 | | $SrF_2$ 29.9 | $BaCo_3$ 0.3 |
| 116 | $BaMoO_4$ 9.0 | $Zn_3Mo_2O_9$ 9.0 | $Lu_6MoO_{12}$ 9.0 | | $ZrMo_2O_8$ 9.0 | $Nb_2Mo_3O_{14}$ 9.0 | $MnMoO_4$ 9.0 | 36.3 | | $BaF_2$ 0.5 | $BaCo_3$ 9.2 |
| 117 | $Mg_2Mo_3O_{11}$ 15.4 | $ZnMoO_4$ 7.7 | | $Al_2Mo_3O_{12}$ 7.7 | $HfMo_2O_8$ 7.7 | $Ta_2Mo_3O_{14}$ 7.7 | $MnMoO_4$ 7.7 | 23.1 | | $BaF_2$ 7.7 | $BaCo_3$ 15.3 |
| 118 | $Ca_3MoO_6$ 13.3 | | $Y_2Mo_3O_{12}$ 13.3 | $Al_2Mo_3O_{12}$ 6.7 | $ZrMo_2O_8$ 6.7 | $Nb_2Mo_3O_{14}$ 6.7 | $MnMoO_4$ 6.7 | 13.3 | | $BaF_2$ 13.3 | $BaCo_3$ 20.0 |
| 119 | | $ZnMo_2O_7$ 11.8 | $La_2MoO_6$ 11.8 | $Al_2Mo_3O_{12}$ 11.8 | $HfMo_2O_8$ 5.9 | $Ta_2Mo_3O_{14}$ 5.9 | $MnMoO_4$ 5.9 | 5.8 | | $BaF_2$ 17.6 | $BaCo_3$ 23.5 |

TABLE 9-continued (Ex. 1-plural Groups)

| Nos | A | B | C | D | E | F | G | Glass A | Glass B | Flourides | Carbonates |
|---|---|---|---|---|---|---|---|---|---|---|---|
| 120 | $Sr_3MoO_6$ 5.2 | $Zn_3Mo_2O_9$ 5.2 | $Mo_2O_8$ 5.2 | $Al_2mo_3O_{12}$ 9.2 | $ZrMo_2O_8$ 10.3 | $Nb_2Mo_3O_{14}$ 10.3 | $MnMoO_4$ 8.3 | 2.1 | BaF | $Baf_2$ 22.3 | $BaCo_3$ 25.9 |

The respective samples of the aforesaid components were heat-treated at 1000° C. for 1 hour in a gaseous atmosphere consisting of 98.5% by volume of nitrogen ($N_2$) and 1.5% by volume of hydrogen mill and dried to obtain the heat-treated resistor material powders having a particle size of 10 μm and composed of the glass, the molybdates of the corresponding elements and the fluorides of alkaline earth metals.

The respective samples were then mixed with the carbonates of alkaline earth metals in the proportions specified in the tables. After mixing 25 parts by weight of the organic vehicle (90 parts by weight of butyl carbitol plus 10 parts by weight of ethyl cellulose) were added to and mixed with 100 parts by weight of the resulting powdery mixtures in a ball mill to obtain the respective resistor material pastes.

On the other hand, 8 parts by weight of polyvinyl butyral, 8 parts by weight of diethyl phthalate, 0.5 parts by weight of oleic acid, 10 parts by weight of acetone, 20 parts by weight of isopropyl alcohol and 20 parts by weight of methyl ethyl ketone were added to and mixed with 100 parts by weight of ceramic material powders consisting of 40.0% by weight of $Al_2O_3$, 35.0% by weight of $SiO_2$, 13.0% by weight of $B_2O_3$, 7.0% by weight of CaO and 5.0% by weight of MgO by means of a ball mill to prepare a slurry, which was defoamed. Thereafter, the slurry was formed by the doctor blade process into a long ceramic green sheet of 200 μm in thickness. Cut out of this ceramic green sheet were a green sheet piece of 9 mm×9 mm and a green sheet piece of 6 mm×9 mm.

As shown in FIG. 1, printed on the aforesaid green sheet 1 piece 1 of 9 mm×9 mm was a conductive material paste by means of screen printing, which was obtained by adding as the organic vehicle 20 parts by weight of butyl carbitol and 5 parts by weight of ethyl cellulose to 95 parts by weight of copper powders and 5 parts by weight of glass frit, followed by three-roll milling. The conductive paste printed ceramic green sheet piece 1 was dried at 125° C. for 10 minutes to form a conductive material film 2. Next, each of the aforesaid respective resistive material pastes was similarly screen-printed on the aforesaid green sheet piece 1 by the screen process, and was dried at 125° C. for 10 minutes to form a resistor material film 3 for a thick-film resistor.

Then, the aforesaid green sheet piece 4 of 6 mm×9 mm was laminated upon the green sheet piece 1, as shown by a chain dash, at 100° C. and 150 Kg/cm$^2$. Subsequently, the laminated product was heated at 400° to 500° C. in an oxidizing atmosphere of, e.g., air to decompose and burn off the organics remaining in the green sheet pieces 1,4, the conductive film 2 and the resistive film 3.

Figure 3:
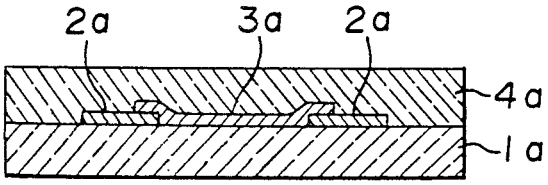
FIG. 3 is a sectional view of that sintered body taken on line III—III.
Figure 4:
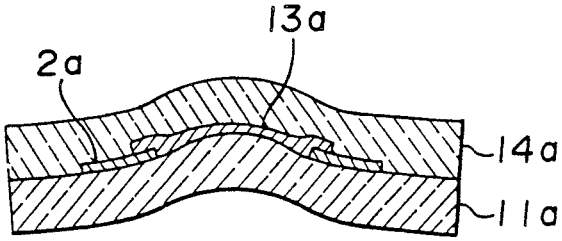
FIG. 4 is a sectional view of a sintered body of a multilayered structure using a conventional resistor material.
Figure 5:
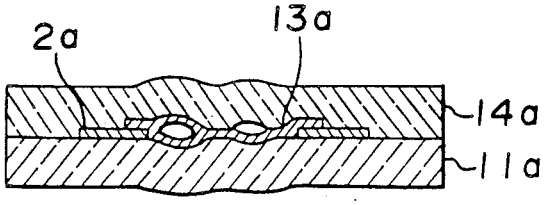
FIG. 5 is a view further illustrating that sintered body which is evolving gas.

After decomposing the organics in this manner, they were fired at 950° C. for 1 hour in a gaseous mixture consisting of 98.5% by volume of $N_2$ and 1.5% by volume of $H_2$ to obtain an integral multilayered ceramic board having a porcelain 1*a* formed of the sintered body of the green sheet piece 1, a porcelain layer 4*a* formed of the sintered body of the green sheet piece 4, a thick-film conductor 2*a*, formed of the sintered body of the conductive film 2 and a thick-film resistor 3*a* formed of the sintered resistive film 3 located between the layers 1 and 4, as illustrated in FIG. 3. With regard to this multilayered ceramic board, such warping or swelling as shown in FIGS. 4 and 5 were not found, as will be described later.

Figure 6:
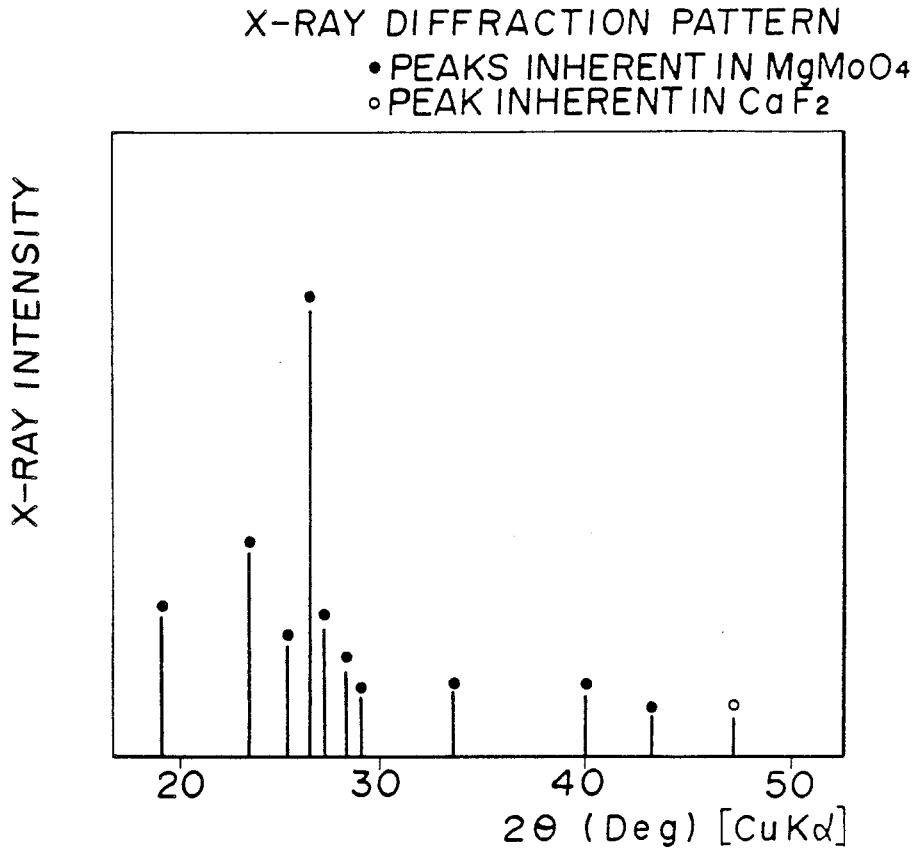
FIG. 6 is an X-ray diffraction pattern, where the corresponding molybdate is detected from the electrical resistor of Sample No. 1 according to the example of the present invention.
Figure 7:
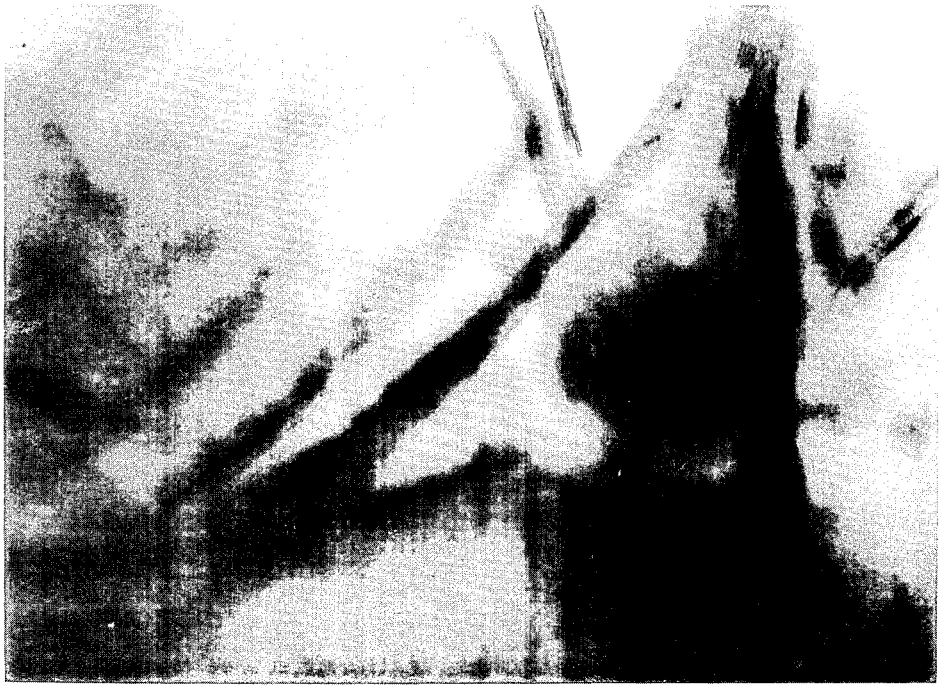
FIG. 7 is a TEM 900,000 times enlargement photograph showing the structure of the electrical resistor.
Figure 8:
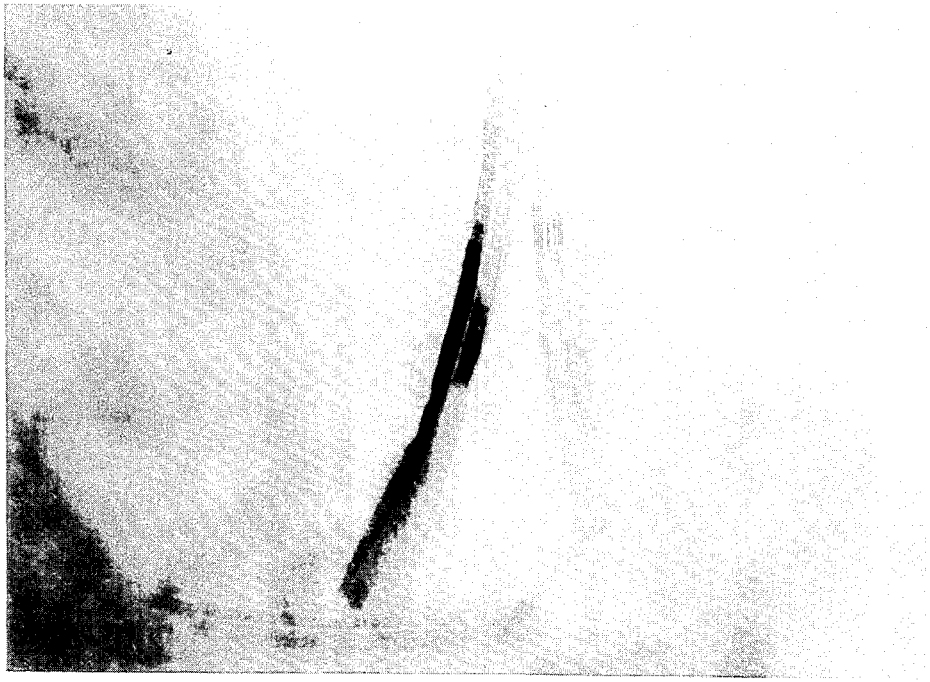
FIG. 8 is a TEM 900,000 times enlargement photograph showing the structure of the electrical resistor obtained by using the resistor material without the fluoride and the carbonate in the resistor material in FIG. 7.

The thus obtained multilayered ceramic board was polished in its layer direction to expose the resistor layer to view, which was then analized by X-ray diffraction (Cu K alpha rays). The results of Sample No. 1 obtained are shown in FIG. 6, from which the presence of the molybdate of the corresponding element could be ascertained. FIG. 7 is also a TEM photograph taken of said sample, which shows the acicular particles that are the reduction product of the molybdate of magnesium. In the photograph, the molybdate of magnesium is shown by a black portion on the left side, and the glass is indicated by a gray portion on the upper side. It is to be noted that the sample, of which a TEM photograph was taken, was prepared by cutting the multilayered ceramic board in the sectional direction to a band of 200 μm in width, and polishing the band to a thickness of about 20 μm, followed by thinning with an ion milling device. Although not illustrated and described, similar results could also be confirmed with respect to other samples.

Next, the resistance values ($R_{25}$) and ($R_{125}$) of the thick-film resistor 3*a* at 25° C. and at the time when heated to 125° C. were measured with a digital multimeter, and the temperature coefficient of resistance (TCR) was calculated from the following equation:

$$TCR = \frac{R_{125} - R_{25}}{R_{25}} \times 10000 \text{ (ppm/°C.)}$$

The measured resistance values $R_{25}$ and calculated values TCR are shown in Table 10 for the compositions of Table 2 and, similarly, in Tables 11 to 17 for the compositions of Tables 3 to 9.

After the obtained multilayered ceramic board had been permitted to stand at 60° C. and a relative humidity of 95% for 1000 hours, its resistance at 25° C. was measured to determine the rate of change with respect to the resistance at 25° C. Just as mentioned above, the results are shown in the tables.

With resistor material samples obtained by removing the carbonates and fluorides of alkaline earth metals, and by removing the former only from the aforesaid respective resistor material samples, multilayered ceramic boards were prepared and measured in the same manner as mentioned above. The results are set forth in Table 10 to 17 with the sample numbers corresponding to the sample numbers of the 1st column in the 2nd and 3rd columns of Tables 10 to 17.

TABLE 10

(Characteristic values corresponding to the sample in Table 2)

| | Example 1 | | | Carbonate-Free | | | Carbonate & Fluoride-Free | | |
|---|---|---|---|---|---|---|---|---|---|
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 1 | $8.35 \times 10^3$ | −286 | <±2 | $22.6 \times 10^3$ | −511 | <±2 | $18.5 \times 10^3$ | −831 | <±2 |
| 2 | $5.28 \times 10^3$ | −252 | " | $14.9 \times 10^3$ | −496 | " | $9.24 \times 10^3$ | −529 | " |
| 3 | $2.15 \times 10^3$ | −192 | " | $72.3 \times 10^3$ | −424 | " | $4.11 \times 10^3$ | −508 | " |
| 4 | $1.02 \times 10^3$ | −161 | " | $4.55 \times 10^3$ | −326 | " | $2.36 \times 10^3$ | −456 | " |
| 5 | $6.49 \times 10^3$ | −274 | " | $13.8 \times 10^3$ | −405 | " | $9.21 \times 10^3$ | −530 | " |
| 6 | $1.58 \times 10^3$ | −173 | " | $6.98 \times 10^3$ | −369 | " | $4.07 \times 10^3$ | −511 | " |
| 7 | $3.58 \times 10^3$ | −248 | " | $10.2 \times 10^3$ | −502 | " | $12.6 \times 10^3$ | −542 | " |
| 8 | $2.73 \times 10^3$ | −205 | " | $8.24 \times 10^3$ | −498 | " | $2.03 \times 10^3$ | −501 | " |
| 9 | $1.03 \times 10^3$ | −168 | " | $7.44 \times 10^3$ | −472 | " | $1.99 \times 10^3$ | −499 | " |
| 10 | $1.18 \times 10^3$ | −177 | " | $8.34 \times 10^3$ | −499 | " | $4.07 \times 10^3$ | −511 | " |
| 11 | 899 | −89 | " | $5.21 \times 10^3$ | −470 | " | $2.03 \times 10^3$ | −501 | " |
| 12 | 925 | −97 | " | $4.49 \times 10^3$ | −462 | " | $1.97 \times 10^3$ | −498 | " |
| 13 | 676 | −25 | " | $3.32 \times 10^3$ | −454 | " | $3.12 \times 10^3$ | −505 | " |
| 14 | $4.03 \times 10^3$ | −270 | " | $11.5 \times 10^3$ | −504 | " | $12.6 \times 10^3$ | −542 | " |
| 15 | $2.88 \times 10^3$ | −211 | " | $8.27 \times 10^3$ | −498 | " | $2.03 \times 10^3$ | −501 | " |
| 16 | $2.91 \times 10^3$ | −218 | " | $7.98 \times 10^3$ | −483 | " | $1.99 \times 10^3$ | −499 | " |
| 17 | $3.10 \times 10^3$ | −229 | " | $8.20 \times 10^3$ | −497 | " | $4.07 \times 10^3$ | −511 | " |
| 18 | $1.03 \times 10^3$ | −159 | " | $7.52 \times 10^3$ | −474 | " | $2.03 \times 10^3$ | −501 | " |
| 19 | $1.57 \times 10^3$ | −198 | " | $8.01 \times 10^3$ | −487 | " | $1.97 \times 10^3$ | −498 | " |
| 20 | 755 | −71 | " | $8.13 \times 10^3$ | −492 | " | $3.12 \times 10^3$ | −505 | " |
| 21 | 980 | −135 | " | $8.28 \times 10^3$ | −498 | " | $4.07 \times 10^3$ | −511 | " |
| 22 | 805 | −75 | " | $7.73 \times 10^3$ | −482 | " | $1.97 \times 10^3$ | −498 | " |
| 23 | 953 | −109 | " | $7.99 \times 10^3$ | −494 | " | $4.07 \times 10^3$ | −511 | " |
| 24 | 785 | −70 | " | $7.66 \times 10^3$ | −475 | " | $1.97 \times 10^3$ | −498 | " |
| 25 | $1.09 \times 10^3$ | −171 | " | $11.9 \times 10^3$ | −510 | " | $4.07 \times 10^3$ | −511 | " |
| 26 | 867 | −81 | " | $7.92 \times 10^3$ | −482 | " | $1.97 \times 10^3$ | −498 | " |
| 27 | $4.73 \times 10^3$ | −281 | " | $8.10 \times 10^3$ | −491 | " | $2.42 \times 10^3$ | −503 | " |
| 28 | $1.13 \times 10^3$ | −125 | " | $7.50 \times 10^3$ | −472 | " | $2.03 \times 10^3$ | −501 | " |
| 29 | $3.00 \times 10^3$ | −229 | " | $8.06 \times 10^3$ | −488 | " | $2.42 \times 10^3$ | −503 | " |
| 30 | 854 | −77 | " | $7.14 \times 10^3$ | −452 | " | $2.03 \times 10^3$ | −501 | " |
| 31 | $3.95 \times 10^3$ | −248 | " | $8.09 \times 10^3$ | −489 | " | $2.42 \times 10^3$ | −503 | " |
| 32 | 953 | −98 | " | $7.21 \times 10^3$ | −463 | " | $2.03 \times 10^3$ | −501 | " |
| 33 | $3.02 \times 10^3$ | −221 | " | $7.75 \times 10^3$ | −484 | " | $2.03 \times 10^3$ | −507 | " |
| 34 | $3.77 \times 10^3$ | −248 | " | $8.15 \times 10^3$ | −492 | " | $4.07 \times 10^3$ | −511 | " |
| 35 | $9.34 \times 10^3$ | 233 | " | $14.6 \times 10^3$ | 502 | " | $12.9 \times 10^3$ | −744 | " |
| 36 | $5.68 \times 10^3$ | 164 | " | $9.28 \times 10^3$ | 321 | " | $7.11 \times 10^3$ | −516 | " |
| 37 | $1.04 \times 10^3$ | 98 | " | $4.67 \times 10^3$ | 216 | " | $2.07 \times 10^3$ | −440 | " |
| 38 | 923 | 87 | " | $3.34 \times 10^3$ | 173 | " | $1.09 \times 10^3$ | −395 | " |
| 39 | $3.24 \times 10^3$ | 121 | " | $8.89 \times 10^3$ | 288 | " | $7.14 \times 10^3$ | −512 | " |
| 40 | $1.89 \times 10^3$ | 113 | " | $5.11 \times 10^3$ | 244 | " | $2.06 \times 10^3$ | −438 | " |
| 41 | $2.05 \times 10^3$ | −153 | " | $5.14 \times 10^3$ | −478 | " | $5.23 \times 10^3$ | −482 | " |
| 42 | $1.03 \times 10^3$ | −108 | " | $2.05 \times 10^3$ | −418 | " | $1.52 \times 10^3$ | −421 | " |
| 43 | 847 | −83 | " | $1.23 \times 10^3$ | −384 | " | $1.14 \times 10^3$ | −397 | " |
| 44 | 980 | −89 | " | $1.62 \times 10^3$ | −392 | " | $2.07 \times 10^3$ | −440 | " |
| 45 | 658 | −41 | " | $1.54 \times 10^3$ | −388 | " | $1.48 \times 10^3$ | −420 | " |
| 46 | 723 | −37 | " | $1.47 \times 10^3$ | −384 | " | $1.21 \times 10^3$ | −399 | " |
| 47 | 521 | −5 | " | $1.14 \times 10^3$ | −381 | " | $1.10 \times 10^3$ | −395 | " |
| 48 | $1.23 \times 10^3$ | −98 | " | $2.09 \times 10^3$ | −436 | " | $2.07 \times 10^3$ | −440 | " |
| 49 | 705 | −59 | " | $1.32 \times 10^3$ | −383 | " | $1.21 \times 10^3$ | −399 | " |
| 50 | 915 | −78 | " | $2.10 \times 10^3$ | −434 | " | $2.07 \times 10^3$ | −440 | " |
| 51 | 625 | −38 | " | $1.25 \times 10^3$ | −382 | " | $1.21 \times 10^3$ | −399 | " |
| 52 | $1.01 \times 10^3$ | −95 | " | $2.13 \times 10^3$ | −438 | " | $2.07 \times 10^3$ | −440 | " |
| 53 | 688 | −50 | " | $1.82 \times 10^3$ | −401 | " | $1.21 \times 10^3$ | −399 | " |
| 54 | $3.77 \times 10^3$ | −230 | " | $4.05 \times 10^3$ | −444 | " | $1.54 \times 10^3$ | −422 | " |
| 55 | 991 | −100 | " | $2.03 \times 10^3$ | −417 | " | $1.48 \times 10^3$ | −420 | " |
| 56 | $2.01 \times 10^3$ | −131 | " | $3.49 \times 10^3$ | −421 | " | $1.54 \times 10^3$ | −422 | " |
| 57 | 795 | −50 | " | $2.09 \times 10^3$ | −418 | " | $1.48 \times 10^3$ | −420 | " |
| 58 | $2.95 \times 10^3$ | −185 | " | $3.63 \times 10^3$ | −423 | " | $1.54 \times 10^3$ | −422 | " |
| 59 | 888 | −55 | " | $2.02 \times 10^3$ | −417 | " | $1.48 \times 10^3$ | −420 | " |
| 60 | $1.45 \times 10^3$ | −129 | " | $3.51 \times 10^3$ | −421 | " | $1.48 \times 10^3$ | −420 | " |
| 61 | $1.01 \times 10^3$ | −120 | " | $4.25 \times 10^3$ | −445 | " | $2.07 \times 10^3$ | −440 | " |
| 62 | $1.63 \times 10^3$ | −136 | " | $4.50 \times 10^3$ | 369 | " | $2.22 \times 10^3$ | −451 | " |
| 63 | $2.49 \times 10^3$ | −203 | " | $4.82 \times 10^3$ | −458 | " | $4.08 \times 10^3$ | −462 | " |
| 64 | $30.2 \times 10^3$ | +32 | " | $70.5 \times 10^3$ | −321 | " | $97.5 \times 10^3$ | −829 | " |
| 65 | $27.9 \times 10^3$ | +49 | " | $59.7 \times 10^3$ | −286 | " | $25.6 \times 10^3$ | −519 | " |
| 66 | $18.4 \times 10^3$ | +116 | " | $36.5 \times 10^3$ | −224 | " | $12.3 \times 10^3$ | −268 | " |
| 67 | $2.54 \times 10^3$ | +223 | " | $4.39 \times 10^3$ | −63 | " | $1.86 \times 10^3$ | −85 | " |
| 68 | $26.8 \times 10^3$ | +52 | " | $49.3 \times 10^3$ | −218 | " | $27.4 \times 10^3$ | −436 | " |
| 69 | $22.4 \times 10^3$ | +73 | " | $37.2 \times 10^3$ | −163 | " | $12.4 \times 10^3$ | −270 | " |
| 70 | $40.5 \times 10^3$ | +52 | " | $62.7 \times 10^3$ | −462 | " | $42.3 \times 10^3$ | −639 | " |
| 71 | $32.5 \times 10^3$ | +80 | " | $45.6 \times 10^3$ | −233 | " | $8.26 \times 10^3$ | −248 | " |
| 72 | $14.8 \times 10^3$ | +125 | " | $32.8 \times 10^3$ | −196 | " | $7.42 \times 10^3$ | −236 | " |
| 73 | $17.3 \times 10^3$ | +103 | " | $40.5 \times 10^3$ | −214 | " | $12.4 \times 10^3$ | −270 | " |
| 74 | $7.25 \times 10^3$ | +178 | " | $47.6 \times 10^3$ | −240 | " | $8.26 \times 10^3$ | −248 | " |
| 75 | $9.00 \times 10^3$ | +175 | " | $42.1 \times 10^3$ | −221 | " | $6.98 \times 10^3$ | −230 | " |

TABLE 10-continued (Characteristic values corresponding to the sample in Table 2)

| | Example 1 | | | Carbonate-Free | | | Carbonate & Fluoride-Free | | |
|---|---|---|---|---|---|---|---|---|---|
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 76 | 856 | +255 | " | $2.04 \times 10^3$ | −99 | " | $2.23 \times 10^3$ | −103 | " |
| 77 | $43.1 \times 10^3$ | +26 | " | $59.4 \times 10^3$ | −398 | " | $42.3 \times 10^3$ | −639 | " |
| 78 | $35.1 \times 10^3$ | +62 | " | $41.8 \times 10^3$ | −218 | " | $8.26 \times 10^3$ | −248 | " |
| 79 | $19.4 \times 10^3$ | +79 | " | $34.5 \times 10^3$ | −199 | " | $7.42 \times 10^3$ | −236 | " |
| 80 | $21.7 \times 10^3$ | +88 | " | $43.2 \times 10^3$ | −224 | " | $12.4 \times 10^3$ | −270 | " |
| 81 | $9.85 \times 10^3$ | +102 | " | $32.9 \times 10^3$ | −198 | " | $8.26 \times 10^3$ | −248 | " |
| 82 | $10.6 \times 10^3$ | +105 | " | $30.5 \times 10^3$ | −186 | " | $6.98 \times 10^3$ | −230 | " |
| 83 | $1.03 \times 10^3$ | +205 | " | $1.85 \times 10^3$ | −87 | " | $2.23 \times 10^3$ | −103 | " |
| 84 | $20.5 \times 10^3$ | +95 | " | $44.6 \times 10^3$ | −225 | " | $12.4 \times 10^3$ | −270 | " |
| 85 | $12.3 \times 10^3$ | +120 | " | $31.2 \times 10^3$ | −196 | " | $6.98 \times 10^3$ | −230 | " |
| 86 | $16.1 \times 10^3$ | +111 | " | $38.7 \times 10^3$ | −210 | " | $12.4 \times 10^3$ | −270 | " |
| 87 | $6.99 \times 10^3$ | +181 | " | $30.9 \times 10^3$ | −187 | " | $6.98 \times 10^3$ | −230 | " |
| 88 | $19.7 \times 10^3$ | +98 | " | $50.2 \times 10^3$ | −246 | " | $12.4 \times 10^3$ | −270 | " |
| 89 | $10.8 \times 10^3$ | +179 | " | $29.6 \times 10^3$ | −185 | " | $6.98 \times 10^3$ | −230 | " |
| 90 | $42.7 \times 10^3$ | −55 | " | $51.3 \times 10^3$ | −248 | " | $8.82 \times 10^3$ | −252 | " |
| 91 | $10.3 \times 10^3$ | +149 | " | $21.6 \times 10^3$ | −152 | " | $8.26 \times 10^3$ | −248 | " |
| 92 | $39.5 \times 10^3$ | −60 | " | $54.9 \times 10^3$ | −250 | " | $8.82 \times 10^3$ | −252 | " |
| 93 | $8.08 \times 10^3$ | +153 | " | $27.4 \times 10^3$ | −172 | " | $8.26 \times 10^3$ | −248 | " |
| 94 | $40.9 \times 10^3$ | −39 | " | $48.6 \times 10^3$ | −245 | " | $8.82 \times 10^3$ | −252 | " |
| 95 | $8.91 \times 10^3$ | +160 | " | $28.2 \times 10^3$ | −180 | " | $8.26 \times 10^3$ | −248 | " |
| 96 | $34.4 \times 10^3$ | +71 | " | $42.5 \times 10^3$ | −222 | " | $8.26 \times 10^3$ | −248 | " |
| 97 | $20.9 \times 10^3$ | +95 | " | $50.0 \times 10^3$ | −246 | " | $12.4 \times 10^3$ | −270 | " |
| 98 | $68.2 \times 10^3$ | −234 | " | $97.6 \times 10^3$ | −463 | " | $100.6\ 10^3$ | −957 | " |
| 99 | $27.3 \times 10^3$ | −92 | " | $46.5 \times 10^3$ | −413 | " | $32.4 \times 10^3$ | −607 | " |
| 100 | $20.8 \times 10^3$ | −74 | " | $34.8 \times 10^3$ | −296 | " | $21.4 \times 10^3$ | −483 | " |
| 101 | $6.24 \times 10^3$ | −25 | " | $10.7 \times 10^3$ | −152 | " | $5.37 \times 10^3$ | −195 | " |
| 102 | $27.6 \times 10^3$ | −96 | " | $35.2 \times 10^3$ | −274 | " | $32.9 \times 10^3$ | −436 | " |
| 103 | $18.8 \times 10^3$ | −48 | " | $29.6 \times 10^3$ | −304 | " | $21.1 \times 10^3$ | −490 | " |
| 104 | $45.4 \times 10^3$ | −127 | " | $63.2 \times 10^3$ | −512 | " | $68.2 \times 10^3$ | −802 | " |
| 105 | $36.6 \times 10^3$ | −83 | " | $45.2 \times 10^3$ | −262 | " | $12.5 \times 10^3$ | −271 | " |
| 106 | $19.6 \times 10^3$ | −18 | " | $30.4 \times 10^3$ | −241 | " | $7.24 \times 10^3$ | −243 | " |
| 107 | $22.1 \times 10^3$ | −77 | " | $51.3 \times 10^3$ | −462 | " | $21.4 \times 10^3$ | −483 | " |
| 108 | $9.90 \times 10^3$ | −55 | " | $30.3 \times 10^3$ | −241 | " | $6.96 \times 10^3$ | −338 | " |
| 109 | $12.3 \times 10^3$ | −37 | " | $17.7 \times 10^3$ | −200 | " | $6.12 \times 10^3$ | −219 | " |
| 110 | $1.87 \times 10^3$ | −60 | " | $32.8 \times 10^3$ | −254 | " | $8.63 \times 10^3$ | −262 | " |
| 111 | $20.8 \times 10^3$ | −75 | " | $54.2 \times 10^3$ | −472 | " | $21.1 \times 10^3$ | −490 | " |
| 112 | $9.85 \times 10^3$ | −28 | " | $45.3 \times 10^3$ | −264 | " | $12.3 \times 10^3$ | −270 | " |
| 113 | $18.6 \times 10^3$ | −60 | " | $56.3 \times 10^3$ | −481 | " | $21.1 \times 10^3$ | −490 | " |
| 114 | $9.12 \times 10^3$ | −29 | " | $17.4 \times 10^3$ | −198 | " | $6.12 \times 10^3$ | −219 | " |
| 115 | $21.2 \times 10^3$ | −68 | " | $54.3 \times 10^3$ | −472 | " | $21.4 \times 10^3$ | −483 | " |
| 116 | $11.5 \times 10^3$ | −35 | " | $18.6 \times 10^3$ | −209 | " | $6.12 \times 10^3$ | −219 | " |
| 117 | $43.6 \times 10^3$ | −188 | " | $47.9 \times 10^3$ | −306 | " | $14.6 \times 10^3$ | −302 | " |
| 118 | $11.5 \times 10^3$ | −58 | " | $28.9 \times 10^3$ | −225 | " | $6.96 \times 10^3$ | −233 | " |
| 119 | $38.5 \times 10^3$ | −107 | " | $44.6 \times 10^3$ | −292 | " | $14.6 \times 10^3$ | −302 | " |
| 120 | $9.05 \times 10^3$ | −51 | " | $29.3 \times 10^3$ | −230 | " | $6.96 \times 10^3$ | −233 | " |
| 121 | $34.5 \times 10^3$ | −95 | " | $42.3 \times 10^3$ | −290 | " | $14.6 \times 10^3$ | −302 | " |
| 122 | $7.88 \times 10^3$ | −50 | " | $29.5 \times 10^3$ | −231 | " | $6.96 \times 10^3$ | −233 | " |
| 123 | $38.3 \times 10^3$ | −107 | " | $30.2 \times 10^3$ | −236 | " | $6.96 \times 10^3$ | −233 | " |
| 124 | $22.5 \times 10^3$ | −89 | " | $55.4 \times 10^3$ | −472 | " | $21.4 \times 10^3$ | −483 | " |
| 125 | $4.73 \times 10^3$ | −42 | " | $48.6 \times 10^3$ | −321 | " | $3.62 \times 10^3$ | −138 | " |
| 126 | $21.9 \times 10^3$ | −55 | " | $48.6 \times 10^3$ | −321 | " | $16.9 \times 10^3$ | −324 | " |
| 127 | $2.22 \times 10^3$ | −126 | " | $3.48 \times 10^3$ | −324 | " | $2.36 \times 10^3$ | −626 | " |
| 128 | $1.76 \times 10^3$ | −83 | " | $2.32 \times 10^3$ | −302 | " | $1.90 \times 10^3$ | −490 | " |
| 129 | 893 | +64 | " | $1.26 \times 10^3$ | −236 | " | 619 | −251 | " |
| 130 | 562 | +52 | " | 763 | −103 | " | 488 | +55 | " |
| 131 | $2.04 \times 10^3$ | −109 | " | $2.88 \times 10^3$ | −318 | " | $1.92 \times 10^3$ | −505 | " |
| 132 | 724 | −63 | " | 846 | −193 | " | 621 | −250 | " |
| 133 | 841 | −216 | " | $1.25 \times 10^3$ | −493 | " | $2.35 \times 10^3$ | −732 | " |
| 134 | 803 | −185 | " | $1.09 \times 10^3$ | −240 | " | 492 | −241 | " |
| 135 | 596 | −107 | " | 954 | −236 | " | 468 | −238 | " |
| 136 | 608 | −106 | " | $1.12 \times 10^3$ | −248 | " | 621 | −250 | " |
| 137 | 442 | +56 | " | 974 | −238 | " | 492 | −241 | " |
| 138 | 438 | +58 | " | 968 | −237 | " | 474 | −239 | " |
| 139 | 396 | +95 | " | 942 | −232 | " | 442 | −235 | " |
| 140 | 839 | −238 | " | $1.22 \times 10^3$ | −487 | " | $2.35 \times 10^3$ | −732 | " |
| 141 | 798 | −198 | " | $1.10 \times 10^3$ | −242 | " | 492 | −241 | " |
| 142 | 597 | −115 | " | 969 | −237 | " | 468 | −238 | " |
| 143 | 603 | −118 | " | $1.14 \times 10^3$ | −248 | " | 621 | −250 | " |
| 144 | 438 | +5 | " | 975 | −238 | " | 492 | −241 | " |
| 145 | 441 | −15 | " | 965 | −237 | " | 474 | −239 | " |
| 146 | 390 | +21 | " | 948 | −233 | " | 442 | −235 | " |
| 147 | 705 | −159 | " | $1.16 \times 10^3$ | −249 | " | 621 | −250 | " |
| 148 | 509 | −56 | " | 964 | −236 | " | 474 | −239 | " |
| 149 | 617 | −111 | " | $1.13 \times 10^3$ | −248 | " | 621 | −250 | " |
| 150 | 459 | +41 | " | 968 | −237 | " | 474 | −239 | " |

TABLE 10-continued (Characteristic values corresponding to the sample in Table 2)

| | Example 1 | | | Carbonate-Free | | | Carbonate & Fluoride-Free | | |
|---|---|---|---|---|---|---|---|---|---|
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 151 | 668 | −140 | " | $1.18 \times 10^3$ | −252 | " | 621 | −250 | " |
| 152 | 481 | +36 | " | 970 | −237 | " | 474 | −239 | " |
| 153 | 636 | −119 | " | 973 | −237 | " | 470 | −238 | " |
| 154 | 481 | −5 | " | 976 | −238 | " | 492 | −241 | " |
| 155 | 578 | −106 | " | 975 | −239 | " | 470 | −238 | " |
| 156 | 425 | −9 | " | 977 | −238 | " | 492 | −241 | " |
| 157 | 615 | −120 | " | 982 | −240 | " | 470 | −238 | " |
| 158 | 469 | −20 | " | 974 | −239 | " | 492 | −241 | " |
| 159 | 846 | −221 | " | $1.01 \times 10^3$ | −243 | " | 492 | −241 | " |
| 160 | 641 | −152 | " | 977 | −239 | " | 621 | −239 | " |
| 161 | $3.95 \times 10^3$ | −212 | " | $8.94 \times 10^3$ | −324 | " | $4.66 \times 10^3$ | −677 | " |
| 162 | $3.23 \times 10^3$ | −186 | " | $6.62 \times 10^3$ | −295 | " | $3.51 \times 10^3$ | −525 | " |
| 163 | $1.24 \times 10^3$ | −1.52 | " | $4.63 \times 10^3$ | −251 | " | $1.19 \times 10^3$ | −400 | " |
| 164 | 886 | −82 | " | $1.64 \times 10^3$ | −183 | " | 728 | −305 | " |
| 165 | $3.65 \times 10^3$ | −205 | " | $6.49 \times 10^3$ | −294 | " | $3.54 \times 10^3$ | −520 | " |
| 166 | $2.02 \times 10^3$ | −163 | " | $3.28 \times 10^3$ | −198 | " | $1.22 \times 10^3$ | −398 | " |
| 167 | 852 | −235 | " | $2.62 \times 10^3$ | −498 | " | $4.12 \times 10^3$ | −612 | " |
| 168 | 814 | −204 | " | $2.18 \times 10^3$ | −352 | " | 983 | −354 | " |
| 169 | 605 | −113 | " | $1.94 \times 10^3$ | −331 | " | 842 | −332 | " |
| 170 | 619 | −119 | " | $2.25 \times 10^3$ | −397 | " | $1.19 \times 10^3$ | −400 | " |
| 171 | 453 | −55 | " | $2.10 \times 10^3$ | −357 | " | 983 | −354 | " |
| 172 | 449 | −51 | " | $1.65 \times 10^3$ | −321 | " | 815 | −324 | " |
| 173 | 407 | −32 | " | $1.42 \times 10^3$ | −304 | " | 734 | −307 | " |
| 174 | 634 | −124 | " | $2.24 \times 10^3$ | −397 | " | $-1.19 \times 10^3$ | −400 | " |
| 175 | 463 | −60 | " | $1.70 \times 10^3$ | −322 | " | 815 | −324 | " |
| 176 | 594 | −108 | " | $2.21 \times 10^3$ | −396 | " | $1.19 \times 10^3$ | −400 | " |
| 177 | 426 | −49 | " | $1.51 \times 10^3$ | −320 | " | 815 | −324 | " |
| 178 | 581 | −94 | " | $2.28 \times 10^3$ | −399 | " | $1.19 \times 10^3$ | −400 | " |
| 179 | 407 | −35 | " | $1.60 \times 10^3$ | −321 | " | 815 | −324 | " |
| 180 | 664 | −185 | " | $2.18 \times 10^3$ | −369 | " | 997 | −400 | " |
| 181 | 499 | −115 | " | $1.99 \times 10^3$ | −353 | " | 983 | −324 | " |
| 182 | 617 | −124 | " | $2.12 \times 10^3$ | −367 | " | 997 | −368 | " |
| 183 | 469 | −100 | " | $2.10 \times 10^3$ | −352 | " | 983 | −354 | " |
| 184 | 631 | −153 | " | $2.21 \times 10^3$ | −370 | " | 997 | −368 | " |
| 185 | 481 | −85 | " | $2.09 \times 10^3$ | −352 | " | 983 | −354 | " |
| 186 | 837 | −236 | " | $2.07 \times 10^3$ | −356 | " | 983 | −354 | " |
| 187 | 639 | −161 | " | $2.30 \times 10^3$ | −398 | " | $1.19 \times 10^3$ | −400 | " |
| 188 | 592 | −83 | " | $1.03 \times 10^3$ | −203 | " | 608 | −252 | " |
| 189 | 453 | −40 | " | $1.99 \times 10^3$ | −338 | " | 906 | −341 | " |
| 190 | 875 | −109 | " | $1.58 \times 10^3$ | −163 | " | 706 | +148 | " |
| 191 | 652 | −17 | " | $1.36 \times 10^3$ | −124 | " | 518 | +287 | " |
| 192 | 426 | +74 | " | 924 | +320 | " | 270 | +401 | " |
| 193 | 349 | +108 | " | 763 | +263 | " | 196 | +428 | " |
| 194 | 775 | −28 | " | $1.40 \times 10^3$ | +318 | " | 520 | +290 | " |
| 195 | 328 | +107 | " | 863 | +318 | " | 270 | +505 | " |
| 196 | 525 | +55 | " | 683 | +184 | " | 652 | +182 | " |
| 197 | 490 | +83 | " | 820 | +428 | " | 235 | +582 | " |
| 198 | 321 | +105 | " | 852 | +462 | " | 213 | +589 | " |
| 199 | 285 | +118 | " | 802 | +412 | " | 270 | +505 | " |
| 200 | 141 | +267 | " | 830 | +445 | " | 224 | +584 | " |
| 201 | 94 | +300 | " | 860 | +482 | " | 202 | +598 | " |
| 202 | 341 | +108 | " | 801 | +410 | " | 270 | +505 | " |
| 203 | 310 | +111 | " | 802 | +411 | " | 270 | +505 | " |
| 204 | 335 | +105 | " | 801 | +409 | " | 270 | +505 | " |
| 205 | 182 | +250 | " | 835 | +452 | " | 224 | +584 | " |
| 206 | 131 | +273 | " | 854 | +463 | " | 224 | +584 | " |
| 207 | 115 | +295 | " | 857 | +471 | " | 224 | +505 | " |
| 208 | 503 | +90 | " | 822 | +430 | " | 232 | +584 | " |
| 209 | 495 | +88 | " | 818 | +425 | " | 232 | +582 | " |
| 210 | 508 | +97 | " | 824 | +438 | " | 232 | +582 | " |
| 211 | 932 | −83 | " | $1.65 \times 10^3$ | −164 | " | 761 | +108 | " |
| 212 | 729 | −65 | " | $1.29 \times 10^3$ | −142 | " | 588 | +144 | " |
| 213 | 544 | +86 | " | 962 | +242 | " | 380 | +273 | " |
| 214 | 428 | +132 | " | 743 | +264 | " | 254 | +326 | " |
| 215 | 583 | +25 | " | 721 | +124 | " | 675 | +126 | " |
| 216 | 512 | +28 | " | 542 | +300 | " | 289 | +302 | " |
| 217 | 351 | +100 | " | 628 | +272 | " | 380 | +273 | " |
| 218 | 296 | +233 | " | 423 | +316 | " | 265 | +318 | " |
| 219 | 181 | +279 | " | 446 | +313 | " | 274 | +314 | " |
| 220 | 120 | +286 | " | 404 | +318 | " | 260 | +320 | " |
| 221 | 329 | +109 | " | 635 | +271 | " | 380 | +273 | " |
| 222 | 318 | +96 | " | 648 | +270 | " | 380 | +273 | " |
| 223 | 342 | +108 | " | 672 | +272 | " | 380 | +273 | " |
| 224 | 245 | +240 | " | 405 | +310 | " | 274 | +314 | " |

TABLE 10-continued (Characteristic values corresponding to the sample in Table 2)

| Nos | Example 1 Resistance value at 25° C. $R_{25}$ (Ω) | Example 1 TCR (ppm/°C.) | Example 1 Rate of Change in Resistance (%) | Carbonate-Free Resistance value at 25° C. $R_{25}$ (Ω) | Carbonate-Free TCR (ppm/°C.) | Carbonate-Free Rate of Change in Resistance (%) | Carbonate & Fluoride-Free Resistance value at 25° C. $R_{25}$ (Ω) | Carbonate & Fluoride-Free TCR (ppm/°C.) | Carbonate & Fluoride-Free Rate of Change in Resistance (%) |
|---|---|---|---|---|---|---|---|---|---|
| 225 | 195 | +268 | " | 453 | +312 | " | 274 | +314 | " |
| 226 | 212 | +259 | " | 398 | +311 | " | 274 | +314 | " |
| 227 | 325 | +218 | " | 436 | +315 | " | 265 | +318 | " |
| 228 | 331 | +245 | " | 425 | +316 | " | 265 | +318 | " |
| 229 | 319 | +250 | " | 411 | +317 | " | 265 | +318 | " |
| 230 | 824 | −120 | " | $1.32 \times 10^3$ | −216 | " | 645 | +107 | " |
| 231 | 536 | +31 | " | 824 | +103 | " | 415 | +209 | " |
| 232 | 743 | −21 | " | $1.28 \times 10^3$ | −183 | " | 645 | +106 | " |
| 233 | 526 | +40 | " | 832 | +149 | " | 410 | +211 | " |
| 234 | 721 | −23 | " | $1.42 \times 10^3$ | +156 | " | 528 | +158 | " |
| 235 | 605 | +12 | " | 868 | +360 | " | 239 | +362 | " |
| 236 | 433 | +183 | " | $1.02 \times 10^3$ | +212 | " | 410 | +211 | " |
| 237 | 380 | +209 | " | 675 | +500 | " | 203 | +502 | " |
| 238 | 350 | +221 | " | 623 | +701 | " | 191 | +702 | " |
| 239 | 211 | +266 | " | 543 | +974 | " | 182 | +982 | " |
| 240 | 505 | +50 | " | $1.32 \times 10^3$ | +208 | " | 410 | +211 | " |
| 241 | 450 | +61 | " | $1.14 \times 10^3$ | +210 | " | 410 | +211 | " |
| 242 | 475 | +63 | " | $1.06 \times 10^3$ | +211 | " | 410 | +211 | " |
| 243 | 405 | +179 | " | 652 | +698 | " | 191 | +702 | " |
| 244 | 386 | +205 | " | 620 | +701 | " | 191 | +702 | " |
| 245 | 421 | +185 | " | 640 | +699 | " | 191 | +702 | " |
| 246 | 383 | +207 | " | 682 | +484 | " | 208 | +486 | " |
| 247 | 422 | +199 | " | 924 | +302 | " | 396 | +304 | " |
| 248 | 639 | −161 | " | 583 | +105 | " | 354 | +294 | " |
| 249 | $17.5 \times 10^3$ | −124 | " | $25.8 \times 10^3$ | −321 | " | $18.6 \times 10^3$ | −448 | " |
| 250 | $10.5 \times 10^3$ | −79 | " | $16.7 \times 10^3$ | −212 | " | $11.9 \times 10^3$ | −507 | " |
| 251 | $5.29 \times 10^3$ | −36 | " | $9.24 \times 10^3$ | −143 | " | $4.88 \times 10^3$ | −487 | " |
| 252 | $21.6 \times 10^3$ | −144 | " | $32.3 \times 10^3$ | −365 | " | $20.6 \times 10^3$ | −449 | " |
| 253 | $1.98 \times 10^3$ | +28 | " | $7.62 \times 10^3$ | −62 | " | $2.30 \times 10^3$ | −87 | " |
| 254 | $12.4 \times 10^3$ | −106 | " | $15.6 \times 10^3$ | −203 | " | $7.08 \times 10^3$ | −328 | " |
| 255 | $17.9 \times 10^3$ | −131 | " | $24.8 \times 10^3$ | −272 | " | $16.6 \times 10^3$ | −308 | " |
| 256 | $16.8 \times 10^3$ | −129 | " | $22.9 \times 10^3$ | −264 | " | $14.5 \times 10^3$ | −381 | " |
| 257 | $6.88 \times 10^3$ | −54 | " | $13.9 \times 10^3$ | −179 | " | $6.21 \times 10^3$ | −422 | " |
| 258 | $6.02 \times 10^3$ | −42 | " | $11.2 \times 10^3$ | −158 | " | $5.49 \times 10^3$ | −456 | " |
| 259 | $13.2 \times 10^3$ | −109 | " | $22.4 \times 10^3$ | −252 | " | $12.2 \times 10^3$ | −470 | " |
| 260 | $16.4 \times 10^3$ | −120 | " | $23.8 \times 10^3$ | −270 | " | $14.6 \times 10^3$ | −485 | " |
| 261 | $18.6 \times 10^3$ | −128 | " | $42.6 \times 10^3$ | −391 | " | $27.4 \times 10^3$ | −641 | " |
| 262 | $9.64 \times 10^3$ | −94 | " | $17.9 \times 10^3$ | −224 | " | $8.61 \times 10^3$ | −588 | " |
| 263 | $2.39 \times 10^3$ | +15 | " | $6.93 \times 10^3$ | −891 | " | $2.19 \times 10^3$ | −501 | " |
| 264 | $1.68 \times 10^3$ | +32 | " | $4.83 \times 10^3$ | −521 | " | $1.55 \times 10^3$ | +57 | " |
| 265 | $-18.7 \times 10^3$ | −222 | " | $24.5 \times 10^3$ | −342 | " | $16.3 \times 10^3$ | −342 | " |
| 266 | $8.38 \times 10^3$ | −124 | " | $10.6 \times 10^3$ | −296 | " | $7.35 \times 10^3$ | −296 | " |
| 267 | 624 | +10 | " | 928 | −42 | " | 483 | −42 | " |
| 268 | 921 | +35 | " | $1.03 \times 10^3$ | −28 | " | 826 | −28 | " |
| 269 | $3.21 \times 10$ | −89 | " | $4.28 \times 10^3$ | −251 | " | $2.38 \times 10^3$ | −251 | " |
| 270 | $3.3 \times 10^3$ | −98 | " | $4.93 \times 10^3$ | −124 | " | $2.88 \times 10^3$ | −256 | " |
| 271 | $7.46 \times 10^3$ | −169 | " | $18.3 \times 10^3$ | −405 | " | $16.6 \times 10^3$ | −546 | " |
| 272 | $1.39 \times 10^3$ | −132 | " | $8.11 \times 10^3$ | −216 | " | $14.5 \times 10^3$ | −367 | " |
| 273 | 342 | +23 | " | 560 | −51 | " | $6.21 \times 10^3$ | −44 | " |
| 274 | 694 | −41 | " | 925 | −88 | " | $5.49 \times 10^3$ | −109 | " |
| 275 | $1.54 \times 10^3$ | −142 | " | $3.00 \times 10^3$ | −295 | " | $12.2 \times 10^3$ | −381 | " |
| 276 | $1.03 \times 10^3$ | −95 | " | $3.49 \times 10^3$ | −186 | " | $14.6 \times 10^3$ | −242 | " |

TABLE 11

(Characteristic values corresponding to the sample in Table 3)

| Nos | Example 1 Resistance value at 25° C. $R_{25}$ (Ω) | Example 1 TCR (ppm/°C.) | Example 1 Rate of Change in Resistance (%) | Carbonate-Free Resistance value at 25° C. $R_{25}$ (Ω) | Carbonate-Free TCR (ppm/°C.) | Carbonate-Free Rate of Change in Resistance (%) | Carbonate & Fluoride-Free Resistance value at 25° C. $R_{25}$ (Ω) | Carbonate & Fluoride-Free TCR (ppm/°C.) | Carbonate & Fluoride-Free Rate of Change in Resistance (%) |
|---|---|---|---|---|---|---|---|---|---|
| 1 | $9.23 \times 10^3$ | −48 | $< \pm 2$ | $15.2 \times 10^3$ | −268 | $< \pm 2$ | $8.78 \times 10^3$ | −916 | $< \pm 2$ |
| 2 | $5.69 \times 10^3$ | +21 | " | $7.94 \times 10^3$ | −196 | " | $5.10 \times 10^3$ | −522 | " |
| 3 | $3.48 \times 10^3$ | +163 | " | $4.22 \times 10^3$ | −154 | " | $3.16 \times 10^3$ | −398 | " |
| 4 | $3.16 \times 10^3$ | +125 | " | $4.09 \times 10^3$ | −150 | " | $3.05 \times 10^3$ | −216 | " |
| 5 | $5.74 \times 10^3$ | +12 | " | $8.26 \times 10^3$ | −214 | " | $5.17 \times 10^3$ | −529 | " |
| 6 | $3.52 \times 10^3$ | −174 | " | $6.13 \times 10^3$ | −189 | " | $3.22 \times 10^3$ | −402 | " |
| 7 | $5.48 \times 10^3$ | +36 | " | $5.63 \times 10^3$ | −171 | " | $5.01 \times 10^3$ | −516 | " |
| 8 | $5.16 \times 10^3$ | +38 | " | $5.49 \times 10^3$ | −170 | " | $2.82 \times 10^3$ | −201 | " |
| 9 | $3.15 \times 10^3$ | +126 | " | $4.98 \times 10^3$ | −166 | " | $2.73 \times 10^3$ | −185 | " |
| 10 | $3.23 \times 10^3$ | +150 | " | $5.16 \times 10^3$ | −167 | " | $3.04 \times 10^3$ | −215 | " |
| 11 | $2.84 \times 10^3$ | +195 | " | $4.62 \times 10^3$ | −162 | " | $2.65 \times 10^3$ | −177 | " |

TABLE 11-continued

| | (Characteristic values corresponding to the sample in Table 3) | | | | | | | | |
|---|---|---|---|---|---|---|---|---|---|
| | Example 1 | | | Carbonate-Free | | | Carbonate & Fluoride-Free | | |
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 12 | $2.46 \times 10^3$ | +242 | " | $4.41 \times 10^3$ | −161 | " | $2.62 \times 10^3$ | −175 | " |
| 13 | $5.88 \times 10^3$ | +7 | " | $6.02 \times 10^3$ | −191 | " | $2.82 \times 10^3$ | −201 | " |
| 14 | $4.21 \times 10^3$ | +108 | " | $5.81 \times 10^3$ | −172 | " | $3.04 \times 10^3$ | −215 | " |
| 15 | $4.92 \times 10^3$ | +43 | " | $6.11 \times 10^3$ | −198 | " | $2.82 \times 10^3$ | −201 | " |
| 16 | $3.00 \times 10^3$ | +161 | " | $5.99 \times 10^3$ | −182 | " | $3.04 \times 10^3$ | −215 | " |
| 17 | $5.38 \times 10^3$ | +34 | " | $6.15 \times 10^3$ | −199 | " | $2.82 \times 10^3$ | −201 | " |
| 18 | $3.81 \times 10^3$ | +136 | " | $6.01 \times 10^3$ | −188 | " | $3.04 \times 10^3$ | −215 | " |
| 19 | $2.84 \times 10^3$ | +167 | " | $5.85 \times 10^3$ | −180 | " | $2.73 \times 10^3$ | −185 | " |
| 20 | $2.40 \times 10^3$ | +193 | " | $5.65 \times 10^3$ | −173 | " | $2.65 \times 10^3$ | −177 | " |
| 21 | $2.69 \times 10^3$ | +181 | " | $5.84 \times 10^3$ | −178 | " | $2.73 \times 10^3$ | −185 | " |
| 22 | $2.18 \times 10^3$ | +180 | " | $5.62 \times 10^3$ | −171 | " | $2.65 \times 10^3$ | −177 | " |
| 23 | $3.08 \times 10^3$ | +130 | " | $5.88 \times 10^3$ | −181 | " | $2.73 \times 10^3$ | −185 | " |
| 24 | $2.61 \times 10^3$ | +185 | " | $5.67 \times 10^3$ | −174 | " | $2.65 \times 10^3$ | −177 | " |
| 25 | $3.40 \times 10^3$ | +151 | " | $6.19 \times 10^3$ | −209 | " | $3.04 \times 10^3$ | −215 | " |
| 26 | $2.99 \times 10^3$ | +203 | " | $6.22 \times 10^3$ | −211 | " | $3.04 \times 10^3$ | −215 | " |
| 27 | $3.08 \times 10^3$ | +176 | " | $6.25 \times 10^3$ | −214 | " | $3.04 \times 10^3$ | −215 | " |
| 28 | $8.72 \times 10^3$ | −62 | " | $14.3 \times 10^3$ | −278 | " | $8.55 \times 10^3$ | −859 | " |
| 29 | $5.11 \times 10^3$ | +119 | " | $11.2 \times 10^3$ | −257 | " | $5.03 \times 10^3$ | −545 | " |
| 30 | $2.92 \times 10^3$ | +267 | " | $8.92 \times 10^3$ | −148 | " | $3.02 \times 10^3$ | −349 | " |
| 31 | $2.89 \times 10^3$ | +246 | " | $5.71 \times 10^3$ | −92 | " | $2.88 \times 10^3$ | −207 | " |
| 32 | $4.94 \times 10^3$ | +205 | " | $9.96 \times 10^3$ | −246 | " | $5.00 \times 10^3$ | −550 | " |
| 33 | $3.09 \times 10^3$ | +167 | " | $7.23 \times 10^3$ | −104 | " | $3.07 \times 10^3$ | −389 | " |
| 34 | $4.89 \times 10^3$ | +103 | " | $6.21 \times 10^3$ | −490 | " | $4.98 \times 10^3$ | −531 | " |
| 35 | $4.57 \times 10^3$ | +96 | " | $5.31 \times 10^3$ | −243 | " | $2.91 \times 10^3$ | −241 | " |
| 36 | $2.66 \times 10^3$ | +145 | " | $3.68 \times 10^3$ | −216 | " | $2.89 \times 10^3$ | −223 | " |
| 37 | $2.74 \times 10^3$ | +149 | " | $5.52 \times 10^3$ | −258 | " | $2.95 \times 10^3$ | −262 | " |
| 38 | $2.33 \times 10^3$ | +189 | " | $4.86 \times 10^3$ | −234 | " | $2.90 \times 10^3$ | −236 | " |
| 39 | $1.97 \times 10^3$ | +240 | " | $3.32 \times 10^3$ | −207 | " | $2.88 \times 10^3$ | −209 | " |
| 40 | $5.03 \times 10^3$ | +65 | " | $5.21 \times 10^3$ | −239 | " | $2.91 \times 10^3$ | −241 | " |
| 41 | $3.23 \times 10^3$ | +128 | " | $5.83 \times 10^3$ | −264 | " | $2.95 \times 10^3$ | −262 | " |
| 42 | $4.71 \times 10^3$ | +95 | " | $5.25 \times 10^3$ | −240 | " | $2.91 \times 10^3$ | −241 | " |
| 43 | $2.89 \times 10^3$ | +139 | " | $5.75 \times 10^3$ | −261 | " | $2.95 \times 10^3$ | −262 | " |
| 44 | $4.88 \times 10^3$ | +81 | " | $4.98 \times 10^3$ | −238 | " | $2.91 \times 10^3$ | −241 | " |
| 45 | $3.05 \times 10^3$ | +129 | " | $5.67 \times 10^3$ | −259 | " | $2.95 \times 10^3$ | −262 | " |
| 46 | $3.20 \times 10^3$ | +103 | " | $4.65 \times 10^3$ | −225 | " | $2.89 \times 10^3$ | −223 | " |
| 47 | $2.87 \times 10^3$ | +151 | " | $4.61 \times 10^3$ | −235 | " | $2.90 \times 10^3$ | −236 | " |
| 48 | $2.44 \times 10^3$ | +140 | " | $3.81 \times 10^3$ | −220 | " | $2.89 \times 10^3$ | −223 | " |
| 49 | $2.08 \times 10^3$ | +183 | " | $4.77 \times 10^3$ | −223 | " | $2.90 \times 10^3$ | −236 | " |
| 50 | $2.85 \times 10^3$ | +160 | " | $4.68 \times 10^3$ | −227 | " | $2.89 \times 10^3$ | −223 | " |
| 51 | $2.54 \times 10^3$ | +179 | " | $4.87 \times 10^3$ | −234 | " | $2.90 \times 10^3$ | −236 | " |
| 52 | $4.68 \times 10^3$ | +89 | " | $5.30 \times 10^3$ | −243 | " | $2.91 \times 10^3$ | −241 | " |
| 53 | $4.70 \times 10^3$ | +95 | " | $5.32 \times 10^3$ | −245 | " | $2.91 \times 10^3$ | −241 | " |
| 54 | $4.77 \times 10^3$ | +78 | " | $5.46 \times 10^3$ | −261 | " | $2.91 \times 10^3$ | −241 | " |
| 55 | $7.16 \times 10^3$ | −163 | " | $9.33 \times 10^3$ | −462 | " | $7.28 \times 10^3$ | −298 | " |
| 56 | $4.81 \times 10^3$ | −82 | " | $6.42 \times 10^3$ | −419 | " | $4.99 \times 10^3$ | −636 | " |
| 57 | $7.22 \times 10^3$ | −184 | " | $10.2 \times 10^3$ | −497 | " | $7.30 \times 10^3$ | −936 | " |
| 58 | $4.93 \times 10^3$ | −93 | " | $7.21 \times 10^3$ | −444 | " | $5.05 \times 10^3$ | −640 | " |
| 59 | $6.13 \times 10^3$ | −121 | " | $8.25 \times 10^3$ | −498 | " | $7.02 \times 10^3$ | −887 | " |
| 60 | $6.01 \times 10^3$ | −105 | " | $8.43 \times 10^3$ | −499 | " | $3.42 \times 10^3$ | −524 | " |
| 61 | $3.87 \times 10^3$ | +53 | " | $7.91 \times 10^3$ | −497 | " | $3.21 \times 10^3$ | −502 | " |
| 62 | $3.62 \times 10^3$ | +77 | " | $7.62 \times 10^3$ | −496 | " | $4.67 \times 10^3$ | −611 | " |
| 63 | $3.14 \times 10^3$ | +68 | " | $6.41 \times 10^3$ | −490 | " | $3.33 \times 10^3$ | −512 | " |
| 64 | $3.00 \times 10^3$ | +85 | " | $6.15 \times 10^3$ | −489 | " | $2.64 \times 10^3$ | −499 | " |
| 65 | $6.24 \times 10^3$ | −135 | " | $7.32 \times 10^3$ | −495 | " | $3.42 \times 10^3$ | −524 | " |
| 66 | $4.07 \times 10^3$ | +5 | " | $7.04 \times 10^3$ | −494 | " | $4.67 \times 10^3$ | −611 | " |
| 67 | $5.85 \times 10^3$ | −85 | " | $6.02 \times 10^3$ | −488 | " | $3.42 \times 10^3$ | −524 | " |
| 68 | $3.41 \times 10^3$ | +58 | " | $6.52 \times 10^3$ | +491 | " | $4.67 \times 10^3$ | −611 | " |
| 69 | $5.67 \times 10^3$ | −18 | " | $5.88 \times 10^3$ | −487 | " | $3.42 \times 10^3$ | −524 | " |
| 70 | $3.29 \times 10^3$ | +60 | " | $6.72 \times 10^3$ | −492 | " | $4.67 \times 10^3$ | −611 | " |
| 71 | $4.33 \times 10^3$ | −52 | " | $6.83 \times 10^3$ | −493 | " | $3.21 \times 10^3$ | −502 | " |
| 72 | $3.68 \times 10^3$ | +21 | " | $6.39 \times 10^3$ | −490 | " | $3.33 \times 10^3$ | −512 | " |
| 73 | $3.99 \times 10^3$ | +18 | " | $4.86 \times 10^3$ | −468 | " | $3.21 \times 10^3$ | −468 | " |
| 74 | $3.31 \times 10^3$ | +28 | " | $5.25 \times 10^3$ | −478 | " | $3.33 \times 10^3$ | −478 | " |
| 75 | $4.18 \times 10^3$ | −20 | " | $5.06 \times 10^3$ | −472 | " | $3.21 \times 10^3$ | −472 | " |
| 76 | $3.54 \times 10^3$ | +40 | " | $5.45 \times 10^3$ | −479 | " | $3.33 \times 10^3$ | −479 | " |
| 77 | $3.08 \times 10^3$ | +72 | " | $5.61 \times 10^3$ | −481 | " | $3.33 \times 10^3$ | −481 | " |
| 78 | $3.20 \times 10^3$ | +70 | " | $5.24 \times 10^3$ | −478 | " | $3.33 \times 10^3$ | −478 | " |
| 79 | $3.49 \times 10^3$ | +20 | " | $5.16 \times 10^3$ | −476 | " | $3.33 \times 10^3$ | −476 | " |
| 80 | $3.10 \times 10^3$ | +166 | " | $4.74 \times 10^3$ | −467 | " | $3.00 \times 10^3$ | −467 | " |
| 81 | $4.02 \times 10^3$ | +172 | " | $6.14 \times 10^3$ | −492 | " | $3.82 \times 10^3$ | −477 | " |
| 82 | $3.48 \times 10^3$ | +159 | " | $3.98 \times 10^3$ | −398 | " | $3.04 \times 10^3$ | −501 | " |
| 83 | $3.84 \times 10^3$ | +144 | " | $4.52 \times 10^3$ | −456 | " | $3.16 \times 10^3$ | −504 | " |

TABLE 12

(Characteristic values corresponding to the sample in Table 4)

| | Example 1 | | | Carbonate-Free | | | Carbonate & Fluoride-Free | | |
|---|---|---|---|---|---|---|---|---|---|
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 1 | $20.3 \times 10^3$ | −289 | < ±2 | $26.3 \times 10^3$ | −986 | < ±2 | $25.4 \times 10^3$ | −986 | < ±2 |
| 2 | $17.5 \times 10^3$ | −278 | " | $22.5 \times 10^3$ | −887 | " | $21.7 \times 10^3$ | −877 | " |
| 3 | $13.2 \times 10^3$ | −252 | " | $19.3 \times 10^3$ | −805 | " | $18.4 \times 10^3$ | −805 | " |
| 4 | $5.34 \times 10^3$ | −190 | " | $10.3 \times 10^3$ | −681 | " | $9.26 \times 10^3$ | −681 | " |
| 5 | $21.5 \times 10^3$ | −285 | " | $27.5 \times 10^3$ | −995 | " | $26.4 \times 10^3$ | −995 | " |
| 6 | $18.4 \times 10^3$ | −275 | " | $23.1 \times 10^3$ | −880 | " | $22.3 \times 10^3$ | −880 | " |
| 7 | $14.9 \times 10^3$ | −250 | " | $19.8 \times 10^3$ | −803 | " | $19.0 \times 10^3$ | −803 | " |
| 8 | $4.25 \times 10^3$ | −187 | " | $10.1 \times 10^3$ | −684 | " | $9.77 \times 10^3$ | −684 | " |
| 9 | $15.3 \times 10^3$ | −265 | " | $19.2 \times 10^3$ | −804 | " | $18.8 \times 10^3$ | −804 | " |
| 10 | $15.1 \times 10^3$ | −285 | " | $23.6 \times 10^3$ | −418 | " | $21.4 \times 10^3$ | −842 | " |
| 11 | $13.9 \times 10^3$ | −249 | " | $16.4 \times 10^3$ | −376 | " | $17.3 \times 10^3$ | −794 | " |
| 12 | $11.5 \times 10^3$ | −218 | " | $15.2 \times 10^3$ | −351 | " | $14.6 \times 10^3$ | −693 | " |
| 13 | $9.84 \times 10^3$ | −205 | " | $17.6 \times 10^3$ | −402 | " | $16.9 \times 10^3$ | −761 | " |
| 14 | $8.07 \times 10^3$ | −188 | " | $9.31 \times 10^3$ | −598 | " | $9.48 \times 10^3$ | −652 | " |
| 15 | $16.3 \times 10^3$ | −297 | " | $20.3 \times 10^3$ | −783 | " | $21.4 \times 10^3$ | −842 | " |
| 16 | $14.7 \times 10^3$ | −259 | " | $16.8 \times 10^3$ | −428 | " | $17.3 \times 10^3$ | −794 | " |
| 17 | $12.7 \times 10^3$ | −231 | " | $15.4 \times 10^3$ | −398 | " | $14.6 \times 10^3$ | −693 | " |
| 18 | $10.4 \times 10^3$ | −227 | " | $14.9 \times 10^3$ | −372 | " | $16.9 \times 10^3$ | −761 | " |
| 19 | $8.65 \times 10^3$ | −205 | " | $9.72 \times 10^3$ | −481 | " | $9.48 \times 10^3$ | −652 | " |
| 20 | $13.9 \times 10^3$ | −261 | " | $15.2 \times 10^3$ | −384 | " | $14.6 \times 10^3$ | −693 | " |
| 21 | $13.4 \times 10^3$ | −268 | " | $15.8 \times 10^3$ | −402 | " | $16.9 \times 10^3$ | −761 | " |
| 22 | $12.3 \times 10^3$ | −242 | " | $14.4 \times 10^3$ | −369 | " | $14.6 \times 10^3$ | −693 | " |
| 23 | $10.7 \times 10^3$ | −225 | " | $15.5 \times 10^3$ | −401 | " | $16.9 \times 10^3$ | −761 | " |
| 24 | $12.9 \times 10^3$ | −243 | " | $13.9 \times 10^3$ | −340 | " | $14.6 \times 10^3$ | −693 | " |
| 25 | $11.8 \times 10^3$ | −236 | " | $15.1 \times 10^3$ | −377 | " | $16.9 \times 10^3$ | −761 | " |
| 26 | $12.7 \times 10^3$ | −240 | " | $14.2 \times 10^3$ | −358 | " | $14.6 \times 10^3$ | −693 | " |
| 27 | $10.7 \times 10^3$ | −235 | " | $14.9 \times 10^3$ | −373 | " | $16.9 \times 10^3$ | −761 | " |
| 28 | $10.4 \times 10^3$ | −205 | " | $14.3 \times 10^3$ | −364 | " | $14.6 \times 10^3$ | −693 | " |
| 29 | $9.12 \times 10^3$ | −207 | " | $15.9 \times 10^3$ | −418 | " | $16.9 \times 10^3$ | −761 | " |
| 30 | $9.03 \times 10^3$ | −198 | " | $14.5 \times 10^3$ | −370 | " | $14.6 \times 10^3$ | −693 | " |
| 31 | $8.88 \times 10^3$ | −191 | " | $13.4 \times 10^3$ | −314 | " | $16.9 \times 10^3$ | −761 | " |
| 32 | $12.6 \times 10^3$ | −243 | " | $15.8 \times 10^3$ | −404 | " | $14.6 \times 10^3$ | −693 | " |
| 33 | $11.4 \times 10^3$ | −222 | " | $13.6 \times 10^3$ | −318 | " | $14.6 \times 10^3$ | −693 | " |
| 34 | $13.8 \times 10^3$ | −261 | " | $14.9 \times 10^3$ | −382 | " | $14.6 \times 10^3$ | −693 | " |
| 35 | $9.73 \times 10^3$ | −209 | " | $15.2 \times 10^3$ | −383 | " | $16.9 \times 10^3$ | −761 | " |

TABLE 13

(Characteristic values corresponding to the sample in Table 5)

| | Example 1 | | | Carbonate-Free | | | Carbonate & Fluoride-Free | | |
|---|---|---|---|---|---|---|---|---|---|
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 1 | $48.3 \times 10^3$ | −298 | < ±2 | $53.8 \times 10^3$ | −483 | < ±2 | $52.5 \times 10^3$ | −877 | < ±2 |
| 2 | $14.8 \times 10^3$ | −273 | " | $19.5 \times 10^3$ | −395 | " | $18.9 \times 10^3$ | −580 | " |
| 3 | $2.54 \times 10^3$ | −93 | " | $6.23 \times 10^3$ | −315 | " | $5.81 \times 10^3$ | −416 | " |
| 4 | $2.19 \times 10^3$ | −90 | " | $3.15 \times 10^3$ | −310 | " | $2.30 \times 10^3$ | −304 | " |
| 5 | $16.2 \times 10^3$ | −279 | " | $20.5 \times 10^3$ | −403 | " | $19.3 \times 10^3$ | −576 | " |
| 6 | $2.80 \times 10^3$ | −95 | " | $6.34 \times 10^3$ | −392 | " | $5.79 \times 10^3$ | −415 | " |
| 7 | $20.1 \times 10^3$ | −292 | " | $26.3 \times 10^3$ | −425 | " | $25.3 \times 10^3$ | −685 | " |
| 8 | $18.5 \times 10^3$ | −281 | " | $22.1 \times 10^3$ | −410 | " | $21.6 \times 10^3$ | −675 | " |
| 9 | $8.78 \times 10^3$ | −195 | " | $9.56 \times 10^3$ | −380 | " | $9.26 \times 10^3$ | −525 | " |
| 10 | $7.96 \times 10^3$ | −197 | " | $9.02 \times 10^3$ | −378 | " | $8.92 \times 10^3$ | −518 | " |
| 11 | $2.01 \times 10^3$ | −105 | " | $3.25 \times 10^3$ | −309 | " | $3.03 \times 10^3$ | −403 | " |
| 12 | $2.00 \times 10^3$ | −98 | " | $2.89 \times 10^3$ | −305 | " | $2.84 \times 10^3$ | −398 | " |
| 13 | $1.12 \times 10^3$ | −45 | " | $2.18 \times 10^3$ | −303 | " | $2.13 \times 10^3$ | −387 | " |
| 14 | $24.3 \times 10^3$ | −298 | " | $26.9 \times 10^3$ | −432 | " | $25.3 \times 10^3$ | −685 | " |
| 15 | $21.8 \times 10^3$ | −290 | " | $23.0 \times 10^3$ | −415 | " | $21.6 \times 10^3$ | −675 | " |
| 16 | $9.95 \times 10^3$ | −225 | " | $9.82 \times 10^3$ | −392 | " | $9.26 \times 10^3$ | −525 | " |
| 17 | $9.03 \times 10^3$ | −221 | " | $9.03 \times 10^3$ | −381 | " | $8.92 \times 10^3$ | −518 | " |
| 18 | $4.68 \times 10^3$ | −185 | " | $3.25 \times 10^3$ | −363 | " | $3.03 \times 10^3$ | −403 | " |
| 19 | $4.41 \times 10^3$ | −168 | " | $3.01 \times 10^3$ | −314 | " | $2.84 \times 10^3$ | −398 | " |
| 20 | $1.85 \times 10^3$ | −62 | " | $2.21 \times 10^3$ | −309 | " | $2.13 \times 10^3$ | −387 | " |
| 21 | $10.08 \times 10^3$ | −223 | " | $9.83 \times 10^3$ | −392 | " | $9.26 \times 10^3$ | −525 | " |
| 22 | $2.38 \times 10^3$ | −114 | " | $3.21 \times 10^3$ | −365 | " | $3.03 \times 10^3$ | −403 | " |
| 23 | $8.14 \times 10^3$ | −186 | " | $9.56 \times 10^3$ | −353 | " | $9.26 \times 10^3$ | −525 | " |
| 24 | $1.95 \times 10^3$ | −106 | " | $3.14 \times 10^3$ | −358 | " | $3.03 \times 10^3$ | −403 | " |
| 25 | $7.68 \times 10^3$ | −181 | " | $9.54 \times 10^3$ | −393 | " | $9.26 \times 10^3$ | −525 | " |
| 26 | $1.88 \times 10^3$ | −99 | " | $3.17 \times 10^3$ | −374 | " | $3.03 \times 10^3$ | −403 | " |
| 27 | $9.84 \times 10^3$ | −200 | " | $9.02 \times 10^3$ | −362 | " | $8.92 \times 10^3$ | −518 | " |

TABLE 13-continued

| | (Characteristic values corresponding to the sample in Table 5) | | | | | | | | |
|---|---|---|---|---|---|---|---|---|---|
| | Example 1 | | | Carbonate-Free | | | Carbonate & Fluoride-Free | | |
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 28 | $3.01 \times 10^3$ | −141 | " | $2.92 \times 10^3$ | −316 | " | $2.84 \times 10^3$ | −398 | " |
| 29 | $8.16 \times 10^3$ | −184 | " | $9.21 \times 10^3$ | −321 | " | $8.92 \times 10^3$ | −518 | " |
| 30 | $2.18 \times 10^3$ | −120 | " | $2.90 \times 10^3$ | −316 | " | $2.84 \times 10^3$ | −398 | " |
| 31 | $8.78 \times 10^3$ | −188 | " | $8.98 \times 10^3$ | −321 | " | $8.92 \times 10^3$ | −518 | " |
| 32 | $2.54 \times 10^3$ | −121 | " | $2.96 \times 10^3$ | −319 | " | $2.84 \times 10^3$ | −398 | " |
| 33 | $17.4 \times 10^3$ | −277 | " | $21.9 \times 10^3$ | −403 | " | $21.6 \times 10^3$ | −675 | " |
| 34 | $18.9 \times 10^3$ | −289 | " | $22.0 \times 10^3$ | −410 | " | $21.6 \times 10^3$ | −675 | " |
| 35 | $43.9 \times 10^3$ | −297 | " | $45.6 \times 10^3$ | −463 | " | $44.8 \times 10^3$ | −857 | " |
| 36 | $14.8 \times 10^3$ | −261 | " | $16.3 \times 10^3$ | −405 | " | $15.0 \times 10^3$ | −521 | " |
| 37 | $4.13 \times 10^3$ | −180 | " | $5.34 \times 10^3$ | −362 | " | $4.77 \times 10^3$ | −408 | " |
| 38 | $1.93 \times 10^3$ | −120 | " | $3.51 \times 10^3$ | −354 | " | $2.07 \times 10^3$ | −311 | " |
| 39 | $14.8 \times 10^3$ | −273 | " | $17.5 \times 10^3$ | −413 | " | $15.3 \times 10^3$ | −527 | " |
| 40 | $4.24 \times 10^3$ | −186 | " | $5.83 \times 10^3$ | −372 | " | $4.80 \times 10^3$ | −411 | " |
| 41 | $18.2 \times 10^3$ | −271 | " | $19.8 \times 10^3$ | −412 | " | $19.4 \times 10^3$ | −621 | " |
| 42 | $16.4 \times 10^3$ | −254 | " | $18.6 \times 10^3$ | −408 | " | $18.2 \times 10^3$ | −613 | " |
| 43 | $6.85 \times 10^3$ | −186 | " | $7.82 \times 10^3$ | −395 | " | $7.32 \times 10^3$ | −480 | " |
| 44 | $6.18 \times 10^3$ | −184 | " | $7.53 \times 10^3$ | −389 | " | $7.01 \times 10^3$ | −478 | " |
| 45 | $2.81 \times 10^3$ | −125 | " | $3.43 \times 10^3$ | −325 | " | $3.24 \times 10^3$ | −411 | " |
| 46 | $2.16 \times 10^3$ | −118 | " | $3.21 \times 10^3$ | −320 | " | $3.02 \times 10^3$ | −408 | " |
| 47 | 985 | −15 | " | $1.53 \times 10^3$ | −302 | " | $1.21 \times 10^3$ | −398 | " |
| 48 | $7.90 \times 10^3$ | −197 | " | $7.42 \times 10^3$ | −380 | " | $7.32 \times 10^3$ | −480 | " |
| 49 | $4.11 \times 10^3$ | −174 | " | $3.28 \times 10^3$ | −328 | " | $3.24 \times 10^3$ | −411 | " |
| 50 | $6.99 \times 10^3$ | −181 | " | $7.38 \times 10^3$ | −375 | " | $7.32 \times 10^3$ | −480 | " |
| 51 | $3.05 \times 10^3$ | −155 | " | $3.80 \times 10^3$ | −331 | " | $3.24 \times 10^3$ | −411 | " |
| 52 | $7.41 \times 10^3$ | −192 | " | $7.36 \times 10^3$ | −375 | " | $7.32 \times 10^3$ | −480 | " |
| 53 | $3.40 \times 10^3$ | −148 | " | $3.92 \times 10^3$ | −380 | " | $3.24 \times 10^3$ | −411 | " |
| 54 | $7.10 \times 10^3$ | −189 | " | $7.21 \times 10^3$ | −369 | " | $7.01 \times 10^3$ | −478 | " |
| 55 | $2.99 \times 10^3$ | −133 | " | $3.56 \times 10^3$ | −345 | " | $3.02 \times 10^3$ | −408 | " |
| 56 | $5.84 \times 10^3$ | −170 | " | $7.26 \times 10^3$ | −361 | " | $7.01 \times 10^3$ | −478 | " |
| 57 | $1.95 \times 10^3$ | −119 | " | $3.21 \times 10^3$ | −353 | " | $3.02 \times 10^3$ | −408 | " |
| 58 | $6.65 \times 10^3$ | −179 | " | $7.36 \times 10^3$ | −372 | " | $7.01 \times 10^3$ | −478 | " |
| 59 | $2.45 \times 10^3$ | −130 | " | $3.25 \times 10^3$ | −350 | " | $3.02 \times 10^3$ | −408 | " |
| 60 | $18.6 \times 10^3$ | −283 | " | $19.3 \times 10^3$ | −403 | " | $18.2 \times 10^3$ | −613 | " |
| 61 | $19.1 \times 10^3$ | −290 | " | $18.6 \times 10^3$ | −410 | " | $18.2 \times 10^3$ | −613 | " |
| 62 | $1.66 \times 10^3$ | −105 | " | $2.10 \times 10^3$ | −380 | " | $2.06 \times 10^3$ | −487 | " |
| 63 | $1.59 \times 10^3$ | −100 | " | $2.24 \times 10^3$ | −383 | " | $2.15 \times 10^3$ | −498 | " |
| 64 | $1.76 \times 10^3$ | −109 | " | $1.98 \times 10^3$ | −375 | " | $1.92 \times 10^3$ | −478 | " |

TABLE 14

| | (Characteristic values corresponding to the sample in Table 6) | | | | | | | | |
|---|---|---|---|---|---|---|---|---|---|
| | Example 1 | | | Carbonate-Free | | | Carbonate & Fluoride-Free | | |
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 1 | $83.6 \times 10^3$ | −300 | $< \pm 2$ | $87.5 \times 10^3$ | −493 | $< \pm 2$ | $84.3 \times 10^3$ | −989 | $< \pm 2$ |
| 2 | $38.5 \times 10^3$ | −283 | " | $41.5 \times 10^3$ | −423 | " | $39.4 \times 10^3$ | −720 | " |
| 3 | $19.8 \times 10^3$ | −120 | " | $21.6 \times 10^3$ | −401 | " | $20.4 \times 10^3$ | −378 | " |
| 4 | $4.83 \times 10^3$ | +12 | " | $4.92 \times 10^3$ | −263 | " | $4.05 \times 10^3$ | −185 | " |
| 5 | $38.7 \times 10^3$ | −214 | " | $40.5 \times 10^3$ | −418 | " | $39.2 \times 10^3$ | −723 | " |
| 6 | $19.6 \times 10^3$ | −118 | " | $21.4 \times 10^3$ | −409 | " | $20.6 \times 10^3$ | −380 | " |
| 7 | $52.5 \times 10^3$ | −298 | " | $53.8 \times 10^3$ | −454 | " | $53.2 \times 10^3$ | −830 | " |
| 8 | $45.3 \times 10^3$ | −295 | " | $46.5 \times 10^3$ | −438 | " | $46.3 \times 10^3$ | −810 | " |
| 9 | $48.7 \times 10^3$ | −267 | " | $49.3 \times 10^3$ | −437 | " | $49.1 \times 10^3$ | −812 | " |
| 10 | $27.4 \times 10^3$ | −205 | " | $28.9 \times 10^3$ | −407 | " | $28.5 \times 10^3$ | −750 | " |
| 11 | $33.0 \times 10^3$ | −198 | " | $34.0 \times 10^3$ | −198 | " | $33.8 \times 10^3$ | −780 | " |
| 12 | $8.31 \times 10^3$ | +23 | " | $9.60 \times 10^3$ | −283 | " | $9.25 \times 10^3$ | −520 | " |
| 13 | $7.20 \times 10^3$ | +31 | " | $8.03 \times 10^3$ | −265 | " | $7.80 \times 10^3$ | −490 | " |
| 14 | $2.38 \times 10^3$ | +89 | " | $3.08 \times 10^3$ | −250 | " | $3.04 \times 10^3$ | −353 | " |
| 15 | $59.6 \times 10^3$ | −289 | " | $53.6 \times 10^3$ | −449 | " | $53.2 \times 10^3$ | −830 | " |
| 16 | $51.2 \times 10^3$ | −274 | " | $46.8 \times 10^3$ | −424 | " | $46.3 \times 10^3$ | −810 | " |
| 17 | $57.7 \times 10^3$ | −283 | " | $49.0 \times 10^3$ | −430 | " | $49.1 \times 10^3$ | −812 | " |
| 18 | $30.1 \times 10^3$ | −245 | " | $29.1 \times 10^3$ | −380 | " | $28.5 \times 10^3$ | −750 | " |
| 19 | $35.2 \times 10^3$ | −201 | " | $34.1 \times 10^3$ | −415 | " | $33.8 \times 10^3$ | −780 | " |
| 20 | $10.1 \times 10^3$ | −15 | " | $9.34 \times 10^3$ | −350 | " | $9.25 \times 10^3$ | −520 | " |
| 21 | $9.08 \times 10^3$ | −50 | " | $7.89 \times 10^3$ | −314 | " | $7.80 \times 10^3$ | −490 | " |
| 22 | $4.01 \times 10^3$ | +3 | " | $3.21 \times 10^3$ | −289 | " | $3.04 \times 10^3$ | −353 | " |
| 23 | $54.9 \times 10^3$ | −283 | " | $46.8 \times 10^3$ | −438 | " | $46.3 \times 10^3$ | −830 | " |
| 24 | $15.6 \times 10^3$ | −95 | " | $9.36 \times 10^3$ | −352 | " | $9.25 \times 10^3$ | −520 | " |
| 25 | $32.7 \times 10^3$ | −254 | " | $46.5 \times 10^3$ | −423 | " | $46.3 \times 10^3$ | −810 | " |

TABLE 14-continued

| | (Characteristic values corresponding to the sample in Table 6) | | | | | | | | |
|---|---|---|---|---|---|---|---|---|---|
| | Example 1 | | | Carbonate-Free | | | Carbonate & Fluoride-Free | | |
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 26 | $5.23 \times 10^3$ | −18 | " | $9.30 \times 10^3$ | −273 | " | $9.25 \times 10^3$ | −520 | " |
| 27 | $47.4 \times 10^3$ | −270 | " | $46.5 \times 10^3$ | −430 | " | $46.3 \times 10^3$ | −830 | " |
| 28 | $9.98 \times 10^3$ | −78 | " | $9.31 \times 10^3$ | −360 | " | $9.25 \times 10^3$ | −520 | " |
| 29 | $47.3 \times 10^3$ | −272 | " | $33.9 \times 10^3$ | −416 | " | $33.8 \times 10^3$ | −780 | " |
| 30 | $18.0 \times 10^3$ | −105 | " | $9.35 \times 10^3$ | −370 | " | $9.25 \times 10^3$ | −520 | " |
| 31 | $35.2 \times 10^3$ | −187 | " | $33.2 \times 10^3$ | −421 | " | $33.8 \times 10^3$ | −780 | " |
| 32 | $9.51 \times 10^3$ | −5 | " | $8.93 \times 10^3$ | −320 | " | $9.25 \times 10^3$ | −520 | " |
| 33 | $37.0 \times 10^3$ | −201 | " | $34.1 \times 10^3$ | −431 | " | $33.8 \times 10^3$ | −780 | " |
| 34 | $11.3 \times 10^3$ | −11 | " | $9.25 \times 10^3$ | −368 | " | $9.25 \times 10^3$ | −520 | " |
| 35 | $46.8 \times 10^3$ | −300 | " | $45.9 \times 10^3$ | −433 | " | $46.3 \times 10^3$ | −810 | " |
| 36 | $48.5 \times 10^3$ | −295 | " | $46.4 \times 10^3$ | −430 | " | $46.3 \times 10^3$ | −810 | " |
| 37 | $43.3 \times 10^3$ | −280 | " | $46.8 \times 10^3$ | −435 | " | $46.3 \times 10^3$ | −810 | " |
| 38 | $42.9 \times 10^3$ | −283 | " | $45.8 \times 10^3$ | −429 | " | $46.3 \times 10^3$ | −810 | " |
| 39 | $67.1 \times 10^3$ | −299 | " | $71.2 \times 10^3$ | −498 | " | $70.1 \times 10^3$ | −995 | " |
| 40 | $25.6 \times 10^3$ | −154 | " | $29.3 \times 10^3$ | −408 | " | $28.4 \times 10^3$ | −788 | " |
| 41 | $16.8 \times 10^3$ | −121 | " | $18.1 \times 10^3$ | −374 | " | $17.7 \times 10^3$ | −385 | " |
| 42 | $2.13 \times 10^3$ | −62 | " | $3.21 \times 10^3$ | −270 | " | $2.95 \times 10^3$ | −207 | " |
| 43 | $27.1 \times 10^3$ | −156 | " | $29.5 \times 10^3$ | −412 | " | $28.2 \times 10^3$ | −790 | " |
| 44 | $16.4 \times 10^3$ | −128 | " | $18.4 \times 10^3$ | −368 | " | $17.6 \times 10^3$ | −381 | " |
| 45 | $45.5 \times 10^3$ | −284 | " | $48.9 \times 10^3$ | −425 | " | $48.6 \times 10^3$ | −825 | " |
| 46 | $37.9 \times 10^3$ | −217 | " | $39.0 \times 10^3$ | −416 | " | $38.2 \times 10^3$ | −810 | " |
| 47 | $41.5 \times 10^3$ | −254 | " | $42.8 \times 10^3$ | −421 | " | $42.1 \times 10^3$ | −819 | " |
| 48 | $19.8 \times 10^3$ | −101 | " | $20.8 \times 10^3$ | −382 | " | $20.3 \times 10^3$ | −780 | " |
| 49 | $25.5 \times 10^3$ | −137 | " | $26.5 \times 10^3$ | −393 | " | $26.3 \times 10^3$ | −789 | " |
| 50 | $5.11 \times 10^3$ | −95 | " | $6.23 \times 10^3$ | −283 | " | $6.03 \times 10^3$ | −310 | " |
| 51 | $4.78 \times 10^3$ | −73 | " | $5.34 \times 10^3$ | −279 | " | $5.05 \times 10^3$ | −308 | " |
| 52 | $1.09 \times 10^3$ | −25 | " | $2.10 \times 10^3$ | −268 | " | $2.09 \times 10^3$ | −280 | " |
| 53 | $6.95 \times 10^3$ | −105 | " | $5.21 \times 10^3$ | −280 | " | $5.05 \times 10^3$ | −310 | " |
| 54 | $39.4 \times 10^3$ | −219 | " | $38.4 \times 10^3$ | −420 | " | $38.2 \times 10^3$ | −815 | " |
| 55 | $38.1 \times 10^3$ | −183 | " | $38.6 \times 10^3$ | −425 | " | $38.2 \times 10^3$ | −804 | " |
| 56 | $36.8 \times 10^3$ | −195 | " | $37.9 \times 10^3$ | −418 | " | $38.2 \times 10^3$ | −809 | " |
| 57 | $26.5 \times 10^3$ | −295 | " | $28.8 \times 10^3$ | −489 | " | $27.1 \times 10^3$ | −849 | " |
| 58 | $16.2 \times 10^3$ | −286 | " | $18.2 \times 10^3$ | −465 | " | $17.1 \times 10^3$ | −452 | " |
| 59 | $6.81 \times 10^3$ | −267 | " | $7.43 \times 10^3$ | −378 | " | $7.34 \times 10^3$ | −424 | " |
| 60 | $22.4 \times 10^3$ | −284 | " | $24.8 \times 10^3$ | −412 | " | $23.7 \times 10^3$ | −784 | " |
| 61 | $13.8 \times 10^3$ | −253 | " | $15.4 \times 10^3$ | −324 | " | $14.6 \times 10^3$ | −382 | " |
| 62 | $5.32 \times 10^3$ | −218 | " | $5.92 \times 10^3$ | −295 | " | $5.82 \times 10^3$ | −316 | " |
| 63 | $41.6 \times 10^3$ | −254 | " | $43.8 \times 10^3$ | −454 | " | $42.5 \times 10^3$ | −573 | " |
| 64 | $27.2 \times 10^3$ | −180 | " | $29.6 \times 10^3$ | −398 | " | $28.8 \times 10^3$ | −375 | " |
| 65 | $9.53 \times 10^3$ | +88 | " | $8.95 \times 10^3$ | −314 | " | $9.82 \times 10^3$ | −306 | " |
| 66 | $23.4 \times 10^3$ | −263 | " | $25.3 \times 10^3$ | −263 | " | $24.0 \times 10^3$ | −501 | " |
| 67 | $14.1 \times 10^3$ | −201 | " | $15.9 \times 10^3$ | −201 | " | $15.4 \times 10^3$ | −328 | " |
| 68 | $5.73 \times 10^3$ | −88 | " | $6.25 \times 10^3$ | −254 | " | $6.15 \times 10^3$ | −287 | " |
| 69 | $24.1 \times 10^3$ | −526 | " | $26.4 \times 10^3$ | −526 | " | $25.7 \times 10^3$ | −526 | " |
| 70 | $15.2 \times 10^3$ | −349 | " | $15.2 \times 10^3$ | −349 | " | $16.6 \times 10^3$ | −349 | " |
| 71 | $6.69 \times 10^3$ | −104 | " | $7.41 \times 10^3$ | −295 | " | $7.32 \times 10^3$ | −324 | " |
| 72 | $38.6 \times 10^3$ | −253 | " | $40.3 \times 10^3$ | −418 | " | $39.4 \times 10^3$ | −485 | " |
| 73 | $27.5 \times 10^3$ | −180 | " | $29.5 \times 10^3$ | −384 | " | $28.4 \times 10^3$ | −366 | " |
| 74 | $8.32 \times 10^3$ | +91 | " | $9.14 \times 10^3$ | −214 | " | $9.03 \times 10^3$ | −343 | " |
| 75 | $30.4 \times 10^3$ | −284 | " | $32.4 \times 10^3$ | −462 | " | $31.0 \times 10^3$ | −796 | " |
| 76 | $18.6 \times 10^3$ | −235 | " | $20.5 \times 10^3$ | −390 | " | $19.5 \times 10^3$ | −391 | " |
| 77 | $7.71 \times 10^3$ | −203 | " | $8.21 \times 10^3$ | −283 | " | $8.64 \times 10^3$ | −312 | " |
| 78 | $39.6 \times 10^3$ | −180 | " | $41.6 \times 10^3$ | −254 | | $40.8 \times 10^3$ | −299 | " |
| 79 | $31.5 \times 10^3$ | −174 | " | $33.5 \times 10^3$ | −209 | " | $32.2 \times 10^3$ | −284 | " |
| 80 | $8.54 \times 10^3$ | +95 | " | $9.15 \times 10^3$ | −196 | " | $9.03 \times 10^3$ | −254 | " |
| 81 | $33.4 \times 10^3$ | −263 | " | $35.3 \times 10^3$ | −435 | | $34.3 \times 10^3$ | −511 | " |
| 82 | $19.6 \times 10^3$ | −242 | " | $21.9 \times 10^3$ | −353 | " | $20.8 \times 10^3$ | −360 | " |
| 83 | $7.51 \times 10^3$ | −195 | " | $8.24 \times 10^3$ | −286 | " | $8.20 \times 10^3$ | −313 | " |
| 84 | $44.8 \times 10^3$ | −294 | " | $46.8 \times 10^3$ | −463 | | $45.5 \times 10^3$ | −775 | " |
| 85 | $32.8 \times 10^3$ | −281 | " | $34.3 \times 10^3$ | −401 | " | $33.1 \times 10^3$ | −381 | " |
| 86 | $9.11 \times 10^3$ | −240 | " | $9.8 \times 10^3$ | −2931 | " | $10.3 \times 10^3$ | −329 | " |
| 87 | $34.3 \times 10^3$ | −285 | " | $36.5 \times 10^3$ | −459 | " | $35.1 \times 10^3$ | −769 | " |
| 88 | $24.5 \times 10^3$ | −239 | " | $26.8 \times 10^3$ | −375 | " | $25.4 \times 10^3$ | −375 | " |
| 89 | $7.87 \times 10^3$ | −176 | " | $8.14 \times 10^3$ | −275 | " | $8.03 \times 10^3$ | −352 | " |
| 90 | $28.4 \times 10^3$ | −287 | " | $30.5 \times 10^3$ | −469 | " | $29.6 \times 10^3$ | −789 | " |
| 91 | $18.5 \times 10^3$ | −453 | " | $20.9 \times 10^3$ | −353 | " | $19.8 \times 10^3$ | −384 | " |
| 92 | $5.43 \times 10^3$ | −224 | " | $6.12 \times 10^3$ | −302 | " | $6.25 \times 10^3$ | −363 | " |
| 93 | $26.3 \times 10^3$ | −282 | " | $28.6 \times 10^3$ | −434 | " | $27.0 \times 10^3$ | −600 | " |
| 94 | $15.2 \times 10^3$ | −253 | " | $17.8 \times 10^3$ | −319 | " | $16.4 \times 10^3$ | −321 | " |
| 95 | $5.43 \times 10^3$ | −224 | " | $5.58 \times 10^3$ | −264 | " | $5.63 \times 10^3$ | −302 | " |
| 96 | $28.3 \times 10^3$ | −186 | " | $31.5 \times 10^3$ | −353 | " | $18.4 \times 10^3$ | −441 | " |
| 97 | $26.5 \times 10^3$ | −215 | " | $24.6 \times 10^3$ | −321 | " | $15.3 \times 10^3$ | −425 | " |
| 98 | $32.8 \times 10^3$ | −255 | " | $33.1 \times 10^3$ | −189 | " | $29.5 \times 10^3$ | −295 | " |
| 99 | $31.1 \times 10^3$ | −281 | " | $30.5 \times 10^3$ | −340 | " | $30.0 \times 10^3$ | −518 | " |

TABLE 14-continued (Characteristic values corresponding to the sample in Table 6)

| Nos | Example 1 Resistance value at 25° C. $R_{25}$ (Ω) | Example 1 TCR (ppm/°C.) | Example 1 Rate of Change in Resistance (%) | Carbonate-Free Resistance value at 25° C. $R_{25}$ (Ω) | Carbonate-Free TCR (ppm/°C.) | Carbonate-Free Rate of Change in Resistance (%) | Carbonate & Fluoride-Free Resistance value at 25° C. $R_{25}$ (Ω) | Carbonate & Fluoride-Free TCR (ppm/°C.) | Carbonate & Fluoride-Free Rate of Change in Resistance (%) |
|---|---|---|---|---|---|---|---|---|---|
| 100 | $32.5 \times 10^3$ | −296 | " | $31.1 \times 10^3$ | −290 | " | $23.4 \times 10^3$ | −399 | " |
| 101 | $7.35 \times 10^3$ | −58 | " | $8.44 \times 10^3$ | −159 | " | $4.90 \times 10^3$ | −365 | " |
| 102 | $8.03 \times 10^3$ | −103 | " | $8.33 \times 10^3$ | −353 | " | $4.62 \times 10^3$ | −521 | " |
| 103 | $9.46 \times 10^3$ | −59 | " | $11.5 \times 10^3$ | −197 | " | $5.51 \times 10^3$ | −403 | " |
| 104 | $11.5 \times 10^3$ | −206 | " | $13.0 \times 10^3$ | −395 | " | $7.70 \times 10^3$ | −530 | " |
| 105 | $7.48 \times 10^3$ | −251 | " | $8.15 \times 10^3$ | −420 | " | $4.80 \times 10^3$ | −565 | " |

TABLE 15

(Characteristics values corresponding to the sample in Table 7)

| | Example 1 Resistance value at 25° C. $R_{25}$ (Ω) | Example 1 TCR (ppm/°C.) | Example 1 Rate of Change in Resistance (%) | Carbonate-Free Resistance value at 25° C. $R_{25}$ (Ω) | Carbonate-Free TCR (ppm/°C.) | Carbonate-Free Rate of Change in Resistance (%) | Carbonate & Fluoride-Free Resistance value at 25° C. $R_{25}$ (Ω) | Carbonate & Fluoride-Free TCR (ppm/°C.) | Carbonate & Fluoride-Free Rate of Change in Resistance (%) |
|---|---|---|---|---|---|---|---|---|---|
| 1 | $2.03 \times 10^3$ | +193 | <±2 | $8.01 \times 10^3$ | +304 | <±2 | $2.87 \times 10^3$ | +307 | <±2 |
| 2 | 923 | +210 | " | $1.53 \times 10^3$ | +318 | " | $1.09 \times 10^3$ | +395 | " |
| 3 | 710 | +235 | " | 811 | +412 | " | 781 | +480 | " |
| 4 | 493 | +280 | " | 583 | +431 | " | 527 | +545 | " |
| 5 | 963 | +205 | " | $1.23 \times 10^3$ | +320 | " | $1.05 \times 10^3$ | +400 | " |
| 6 | 720 | +215 | " | 803 | +390 | " | 780 | +475 | " |
| 7 | 893 | +203 | " | $1.99 \times 10^3$ | +315 | " | $1.96 \times 10^3$ | +348 | " |
| 8 | 818 | +218 | " | 556 | +426 | " | 545 | +529 | " |
| 9 | 625 | +244 | " | 701 | +405 | " | 703 | +503 | " |
| 10 | 631 | +241 | " | 707 | +401 | " | 703 | +503 | " |
| 11 | 321 | +285 | " | 572 | +4161 | " | 566 | +514 | " |
| 12 | 218 | +299 | " | 503 | +386 | " | 524 | +541 | " |
| 13 | 595 | +275 | " | 701 | +405 | " | 703 | +503 | " |
| 14 | 308 | +281 | " | 572 | +416 | " | 566 | +514 | " |
| 15 | 583 | +276 | " | 701 | +405 | " | 703 | +503 | " |
| 16 | 300 | +280 | " | 572 | +416 | " | 566 | +514 | " |
| 17 | 610 | +279 | " | 701 | +405 | " | 703 | +503 | " |
| 18 | 318 | +286 | " | 572 | +416 | " | 566 | +514 | " |
| 19 | 925 | +203 | " | 580 | +422 | " | 545 | +529 | " |
| 20 | 781 | +218 | " | 699 | +403 | " | 703 | +503 | " |
| 21 | 785 | +228 | " | 571 | +425 | " | 545 | +529 | " |
| 22 | 523 | +248 | " | 678 | +409 | " | 703 | +503 | " |
| 23 | 712 | +251 | " | 559 | +414 | " | 545 | +529 | " |
| 24 | 455 | +263 | " | 650 | +400 | " | 703 | +503 | " |
| 25 | 585 | +269 | " | 685 | +410 | " | 703 | +503 | " |
| 26 | 564 | +268 | " | 671 | +405 | " | 703 | +503 | " |
| 27 | $5.85 \times 10^3$ | −298 | " | $7.25 \times 10^3$ | −483 | " | $6.14 \times 10^3$ | −705 | " |
| 28 | $3.23 \times 10^3$ | −284 | " | $4.26 \times 10^3$ | −448 | " | $3.88 \times 10^3$ | −509 | " |
| 29 | $1.84 \times 10^3$ | −283 | " | $2.62 \times 10^3$ | −431 | " | $2.17 \times 10^3$ | −417 | " |
| 30 | 814 | −163 | " | 893 | −285 | " | 866 | −284 | " |
| 31 | $3.10 \times 10^3$ | −276 | " | $4.21 \times 10^3$ | −451 | " | $3.90 \times 10^3$ | −515 | " |
| 32 | $1.94 \times 10^3$ | −284 | " | $2.85 \times 10^3$ | −436 | " | $2.18 \times 10^3$ | −421 | " |
| 33 | $2.03 \times 10^3$ | −299 | " | $5.07 \times 10^3$ | −452 | " | $5.14 \times 10^3$ | −618 | " |
| 34 | $1.86 \times 10^3$ | −286 | " | $1.48 \times 10^3$ | −303 | " | $1.02 \times 10^3$ | −326 | " |
| 35 | $1.03 \times 10^3$ | −251 | " | $1.52 \times 10^3$ | −301 | " | $1.50 \times 10^3$ | −347 | " |
| 36 | $1.02 \times 10^3$ | −233 | " | $1.47 \times 10^3$ | −316 | " | $1.50 \times 10^3$ | −347 | " |
| 37 | 985 | −185 | " | $1.14 \times 10^3$ | −281 | " | $1.07 \times 10^3$ | −334 | " |
| 38 | 818 | −135 | " | 886 | −251 | " | 902 | −295 | " |
| 39 | $1.48 \times 10^3$ | −281 | " | $1.52 \times 10^3$ | −301 | " | $1.50 \times 10^3$ | −347 | " |
| 40 | $1.25 \times 10^3$ | −220 | " | $1.14 \times 10^3$ | −281 | " | $1.07 \times 10^3$ | −334 | " |
| 41 | $1.11 \times 10^3$ | −256 | " | $1.52 \times 10^3$ | −301 | " | $1.50 \times 10^3$ | −347 | " |
| 42 | $1.03 \times 10^3$ | −188 | " | $1.14 \times 10^3$ | −281 | " | $1.07 \times 10^3$ | −334 | " |
| 43 | $1.23 \times 10^3$ | −248 | " | $1.52 \times 10^3$ | −301 | " | $1.50 \times 10^3$ | −347 | " |
| 44 | $1.09 \times 10^3$ | −195 | " | $1.14 \times 10^3$ | −281 | " | $1.07 \times 10^3$ | −334 | " |
| 45 | $1.90 \times 10^3$ | −299 | " | $1.55 \times 10^3$ | −314 | " | $1.02 \times 10^3$ | −326 | " |
| 46 | $2.54 \times 10^3$ | −273 | " | $1.86 \times 10^3$ | −295 | " | $1.50 \times 10^3$ | −314 | " |
| 47 | $1.28 \times 10^3$ | −249 | " | $1.35 \times 10^3$ | −288 | " | $1.02 \times 10^3$ | −326 | " |
| 48 | 980 | −203 | " | $1.38 \times 10^3$ | −256 | " | $1.50 \times 10^3$ | −341 | " |
| 49 | $2.05 \times 10^3$ | −285 | " | $1.56 \times 10^3$ | −311 | " | $1.02 \times 10^3$ | −326 | " |
| 50 | $1.76 \times 10^3$ | −251 | " | $1.67 \times 10^3$ | −285 | " | $1.50 \times 10^3$ | −341 | " |
| 51 | $1.24 \times 10^3$ | −240 | " | $1.58 \times 10^3$ | −295 | " | $1.50 \times 10^3$ | −341 | " |
| 52 | $1.48 \times 10^3$ | −259 | " | $1.55 \times 10^3$ | −336 | " | $1.50 \times 10^3$ | −341 | " |
| 53 | 703 | +112 | " | 884 | +162 | " | 830 | +261 | " |
| 54 | 625 | +101 | " | 878 | +156 | " | 816 | +258 | " |

TABLE 16

(Characteristics value corresponding to the sample in Table 8)

| | Example 1 | | | Carbonate-Free | | | Carbonate & Fluoride-Free | | |
|---|---|---|---|---|---|---|---|---|---|
| NO | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 1 | $2.92 \times 10^3$ | +118 | <±2 | $3.46 \times 10^3$ | +321 | <±2 | $3.14 \times 10^3$ | +357 | <±2 |
| 2 | $1.16 \times 10^3$ | +124 | " | $2.03 \times 10^3$ | +403 | " | $1.77 \times 10^3$ | +421 | " |
| 3 | 983 | +159 | " | $1.65 \times 10^3$ | +463 | " | $1.05 \times 10^3$ | +480 | " |
| 4 | 786 | +214 | " | 892 | +494 | " | 828 | +676 | " |
| 5 | $2.98 \times 10^3$ | +120 | " | $3.84 \times 10^3$ | +360 | " | $3.13 \times 10^3$ | +362 | " |
| 6 | $1.26 \times 10^3$ | +123 | " | $2.35 \times 10^3$ | +420 | " | $1.81 \times 10^3$ | +427 | " |
| 7 | 965 | +160 | " | $2.14 \times 10^3$ | +430 | " | $1.09 \times 10^3$ | +480 | " |
| 8 | 789 | +223 | " | 874 | +490 | " | 831 | +675 | " |
| 9 | 963 | +163 | " | $1.92 \times 10^3$ | +453 | " | $1.07 \times 10^3$ | +485 | " |
| 10 | $1.03 \times 10^3$ | +123 | " | $1.86 \times 10^3$ | +314 | " | $1.78 \times 10^3$ | +512 | " |
| 11 | 925 | +155 | " | $1.02 \times 10^3$ | +368 | " | $1.13 \times 10^3$ | +567 | " |
| 12 | 833 | +202 | " | 983 | +480 | " | 925 | +624 | " |
| 13 | 805 | +248 | " | 854 | +475 | " | 835 | +675 | " |
| 14 | 744 | +249 | " | 821 | +485 | " | 815 | +685 | " |
| 15 | 635 | +255 | " | 735 | +492 | " | 740 | +702 | " |
| 16 | $2.00 \times 10^3$ | +89 | " | $1.96 \times 10^3$ | +303 | " | $1.78 \times 10^3$ | +512 | " |
| 17 | $1.51 \times 10^3$ | +115 | " | $1.82 \times 10^3$ | +343 | " | $1.13 \times 10^3$ | +567 | " |
| 18 | $1.14 \times 10^3$ | +126 | " | $1.72 \times 10^3$ | +392 | " | 925 | +624 | " |
| 19 | $1.02 \times 10^3$ | +180 | " | $1.68 \times 10^3$ | +403 | " | 835 | +675 | " |
| 20 | 921 | +205 | " | 956 | +424 | " | 815 | +685 | " |
| 21 | 829 | +238 | " | 912 | +490 | " | 740 | +702 | " |
| 22 | $1.05 \times 10^3$ | +105 | " | $1.12 \times 10^3$ | +390 | " | 925 | +624 | " |
| 23 | 921 | +150 | " | 985 | +436 | " | 815 | +685 | " |
| 24 | 884 | +136 | " | 925 | +453 | " | 925 | +624 | " |
| 25 | 795 | +181 | " | 894 | +483 | " | 815 | +685 | " |
| 26 | 935 | +161 | " | 913 | +409 | " | 925 | +624 | " |
| 27 | 880 | +180 | " | 862 | +490 | " | 815 | +685 | " |
| 28 | 706 | +223 | " | 752 | +493 | " | 835 | +675 | " |
| 29 | 641 | +244 | " | 680 | +496 | " | 815 | +685 | " |
| 30 | 654 | +249 | " | 672 | +495 | " | 835 | +675 | " |
| 31 | 606 | +250 | " | 632 | +480 | " | 815 | +685 | " |
| 32 | 753 | +195 | " | 690 | +476 | " | 835 | +675 | " |
| 33 | 706 | +203 | " | 683 | +481 | " | 815 | +685 | " |
| 34 | $1.08 \times 10^3$ | +123 | " | $1.12 \times 10^3$ | +373 | " | $1.13 \times 10^3$ | +567 | " |
| 35 | $1.14 \times 10^3$ | +106 | " | $1.14 \times 10^3$ | +359 | " | $1.13 \times 10^3$ | +567 | " |
| 36 | 929 | +192 | " | 953 | +393 | " | 956 | +634 | " |

TABLE 17

(Characteristic value corresponding to the sample in Table 9)

| | Example 1 | | | Carbonate-Free | | | Carbonate & Fluoride-Free | | |
|---|---|---|---|---|---|---|---|---|---|
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 1 | $9.07 \times 10^3$ | −276 | <±2 | $9.56 \times 10^3$ | −483 | <±2 | $9.13 \times 10^3$ | −528 | <±2 |
| 2 | $20.2 \times 10^3$ | −278 | " | $23.1 \times 10^3$ | −495 | " | $21.4 \times 10^3$ | −676 | " |
| 3 | $16.5 \times 10^3$ | −289 | " | $19.4 \times 10^3$ | −496 | " | $17.6 \times 10^3$ | −805 | " |
| 4 | $2.45 \times 10^3$ | −216 | " | $3.77 \times 10^3$ | −350 | " | $2.86 \times 10^3$ | −396 | " |
| 5 | 825 | +222 | " | $1.01 \times 10^3$ | +362 | " | 888 | +380 | " |
| 6 | $4.01 \times 10^3$ | −152 | " | $4.22 \times 10^3$ | −249 | " | $4.18 \times 10^3$ | −256 | " |
| 7 | $31.6 \times 10^3$ | −292 | " | $34.0 \times 10^3$ | −486 | " | $32.1 \times 10^3$ | −929 | " |
| 8 | $18.5 \times 10^3$ | −296 | " | $24.1 \times 10^3$ | −493 | " | $20.0 \times 10^3$ | −956 | " |
| 9 | $6.88 \times 10^3$ | −277 | " | $8.03 \times 10^3$ | −446 | " | $7.14 \times 10^3$ | −530 | " |
| 10 | $2.55 \times 10^3$ | −242 | " | $3.96 \times 10^3$ | −387 | " | $3.04 \times 10^3$ | −407 | " |
| 11 | $4.29 \times 10^3$ | −269 | " | $4.93 \times 10^3$ | −477 | " | $4.80 \times 10^3$ | −628 | " |
| 12 | $7.68 \times 10^3$ | −275 | " | $8.95 \times 10^3$ | −467 | " | $8.11 \times 10^3$ | −607 | " |
| 13 | $25.4 \times 10^3$ | −293 | " | $29.4 \times 10^3$ | −480 | " | $26.4 \times 10^3$ | −814 | " |
| 14 | $27.9 \times 10^3$ | −261 | " | $34.9 \times 10^3$ | −417 | " | $29.6 \times 10^3$ | −505 | " |
| 15 | $10.6 \times 10^3$ | −116 | " | $16.9 \times 10^3$ | −290 | " | $11.4 \times 10^3$ | −334 | " |
| 16 | $13.9 \times 10^3$ | −288 | " | $14.7 \times 10^3$ | −491 | " | $14.1 \times 10^3$ | −769 | " |
| 17 | $9.21 \times 10^3$ | −287 | " | $11.9 \times 10^3$ | −465 | " | $10.6 \times 10^3$ | −582 | " |
| 18 | $3.85 \times 10^3$ | −249 | " | $4.95 \times 10^3$ | −425 | " | $4.18 \times 10^3$ | −520 | " |
| 19 | $12.6 \times 10^3$ | −234 | " | $16.6 \times 10^3$ | −392 | " | $12.8 \times 10^3$ | −477 | " |
| 20 | $9.44 \times 10^3$ | −216 | " | $14.3 \times 10^3$ | −401 | " | $10.0 \times 10^3$ | −500 | " |
| 21 | 924 | −169 | " | $1.18 \times 10^3$ | −373 | " | $1.01 \times 10^3$ | −423 | " |
| 22 | $8.05 \times 10^3$ | −264 | " | $9.02 \times 10^3$ | −495 | " | $8.18 \times 10^3$ | −677 | " |
| 23 | $4.02 \times 10^3$ | −250 | " | $5.13 \times 10^3$ | −388 | " | $4.43 \times 10^3$ | −459 | " |
| 24 | $1.21 \times 10^3$ | −234 | " | $2.07 \times 10^3$ | −379 | " | $1.52 \times 10^3$ | −533 | " |
| 25 | $5.09 \times 10^3$ | −262 | " | $7.09 \times 10^3$ | −416 | " | $5.24 \times 10^3$ | −540 | " |
| 26 | $5.49 \times 10^3$ | −270 | " | $5.92 \times 10^3$ | −433 | " | $5.84 \times 10^3$ | −574 | " |
| 27 | $18.4 \times 10^3$ | −298 | " | $22.2 \times 10^3$ | −482 | " | $20.5 \times 10^3$ | −865 | " |
| 28 | $12.6 \times 10^3$ | −186 | " | $15.6 \times 10^3$ | −316 | " | $13.3 \times 10^3$ | −414 | " |

TABLE 17-continued

| | (Characteristic value corresponding to the sample in Table 9) | | | | | | | | |
|---|---|---|---|---|---|---|---|---|---|
| | Example 1 | | | Carbonate-Free | | | Carbonate & Fluoride-Free | | |
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 29 | $4.11 \times 10^3$ | −107 | " | $5.20 \times 10^3$ | −222 | " | $4.46 \times 10^3$ | −295 | " |
| 30 | $28.4 \times 10^3$ | −284 | " | $36.3 \times 10^3$ | −492 | " | $31.1 \times 10^3$ | −639 | " |
| 31 | $16.0 \times 10^3$ | −292 | " | $16.9 \times 10^3$ | −499 | " | $16.5 \times 10^3$ | −821 | " |
| 32 | 925 | −106 | " | 995 | −232 | " | 990 | −259 | " |
| 33 | $7.96 \times 10^3$ | −295 | " | $10.3 \times 10^3$ | −486 | " | $8.24 \times 10^3$ | −795 | " |
| 34 | $3.82 \times 10^3$ | −264 | " | $5.28 \times 10^3$ | −378 | " | $4.33 \times 10^3$ | −496 | " |
| 35 | $1.02 \times 10^3$ | +96 | " | $2.05 \times 10^3$ | +89 | " | $1.14 \times 10^3$ | +125 | " |
| 36 | 524 | +250 | " | 647 | +370 | " | 628 | +482 | " |
| 37 | $36.0 \times 10^3$ | −289 | " | $37.7 \times 10^3$ | −485 | " | $36.3 \times 10^3$ | −992 | " |
| 38 | $15.5 \times 10^3$ | −275 | " | $19.0 \times 10^3$ | −466 | " | $16.4 \times 10^3$ | −584 | " |
| 39 | $8.00 \times 10^3$ | −270 | " | $9.93 \times 10^3$ | −447 | " | $8.14 \times 10^3$ | −534 | " |
| 40 | $4.05 \times 10^3$ | −206 | " | $6.01 \times 10^3$ | −250 | " | $4.27 \times 10^3$ | −317 | " |
| 41 | $5.09 \times 10^3$ | −219 | " | $5.70 \times 10^3$ | −365 | " | $5.45 \times 10^3$ | −487 | " |
| 42 | $2.26 \times 10^3$ | −244 | " | $3.07 \times 10^3$ | −430 | " | $2.87 \times 10^3$ | −521 | " |
| 43 | $12.0 \times 10^3$ | −289 | " | $14.9 \times 10^3$ | −477 | " | $12.4 \times 10^3$ | −855 | " |
| 44 | $7.03 \times 10^3$ | −294 | " | $10.2 \times 10^3$ | −411 | " | $7.14 \times 10^3$ | −505 | " |
| 45 | $5.49 \times 10^3$ | −233 | " | $9.05 \times 10^3$ | −395 | " | $6.23 \times 10^3$ | −480 | " |
| 46 | 980 | +204 | " | $1.30 \times 10^3$ | +285 | " | $1.19 \times 10^3$ | +329 | " |
| 47 | $6.97 \times 10^3$ | −288 | " | $9.66 \times 10^3$ | −483 | " | $8.11 \times 10^3$ | −683 | " |
| 48 | $2.79 \times 10^3$ | −195 | " | $5.11 \times 10^3$ | −303 | " | $3.18 \times 10^3$ | −359 | " |
| 49 | $20.6 \times 10^3$ | −289 | " | $24.7 \times 10^3$ | −480 | " | $22.4 \times 10^3$ | −805 | " |
| 50 | $15.4 \times 10^3$ | −221 | " | $21.3 \times 10^3$ | −419 | " | $17.7 \times 10^3$ | −551 | " |
| 51 | $5.82 \times 10^3$ | −125 | " | $7.10 \times 10^3$ | −344 | " | $7.01 \times 10^3$ | −384 | " |
| 52 | $4.02 \times 10^3$ | −128 | " | $6.09 \times 10^3$ | −285 | " | $4.98 \times 10^3$ | −399 | " |
| 53 | $2.77 \times 10^3$ | −105 | " | $4.95 \times 10^3$ | −216 | " | $3.03 \times 10^3$ | −304 | " |
| 54 | $5.29 \times 10^3$ | −212 | " | $9.22 \times 10^3$ | −382 | " | $6.18 \times 10^3$ | −454 | " |
| 55 | $10.5 \times 10^3$ | −277 | " | $15.6 \times 10^3$ | −495 | " | $11.4 \times 10^3$ | −882 | " |
| 56 | $3.00 \times 10^3$ | −212 | " | $3.18 \times 10^3$ | −212 | " | $3.05 \times 10^3$ | −309 | " |
| 57 | $13.6 \times 10^3$ | −266 | " | $16.2 \times 10^3$ | −423 | " | $14.9 \times 10^3$ | −529 | " |
| 58 | $11.2 \times 10^3$ | −221 | " | $14.5 \times 10^3$ | −326 | " | $13.4 \times 10^3$ | −418 | " |
| 59 | $2.01 \times 10^3$ | −106 | " | $4.22 \times 10^3$ | −210 | " | $2.16 \times 10^3$ | −293 | " |
| 60 | $3.12 \times 10^3$ | −121 | " | $5.67 \times 10^3$ | −199 | " | $3.39 \times 10^3$ | −305 | " |
| 61 | $15.7 \times 10^3$ | −296 | " | $16.9 \times 10^3$ | −491 | " | $16.3 \times 10^3$ | −867 | " |
| 62 | $10.7 \times 10^3$ | −291 | " | $12.6 \times 10^3$ | −482 | " | $11.0 \times 10^3$ | −797 | " |
| 63 | $1.04 \times 10^3$ | −200 | " | $2.09 \times 10^3$ | −275 | " | $1.19 \times 10^3$ | −312 | " |
| 64 | $2.55 \times 10^3$ | −212 | " | $4.11 \times 10^3$ | −346 | " | $2.76 \times 10^3$ | −425 | " |
| 65 | $2.84 \times 10^3$ | −209 | " | $5.71 \times 10^3$ | −315 | " | $3.19 \times 10^3$ | −404 | " |
| 66 | $21.9 \times 10^3$ | −225 | " | $2.18 \times 10^3$ | −303 | " | $2.05 \times 10^3$ | −377 | " |
| 67 | $6.05 \times 10^3$ | −234 | " | $24.9 \times 10^3$ | −473 | " | $22.8 \times 10^3$ | −676 | " |
| 68 | $5.79 \times 10^3$ | −277 | " | $8.07 \times 10^3$ | −493 | " | $6.39 \times 10^3$ | −820 | " |
| 69 | $13.5 \times 10^3$ | −280 | " | $18.8 \times 10^3$ | −469 | " | $15.7 \times 10^3$ | −796 | " |
| 70 | $10.1 \times 10^3$ | −225 | " | $14.7 \times 10^3$ | −407 | " | $11.6 \times 10^3$ | −491 | " |
| 71 | $1.85 \times 10^3$ | −174 | " | $2.41 \times 10^3$ | −312 | " | $2.35 \times 10^3$ | −353 | " |
| 72 | $94.8 \times 10^3$ | −88 | " | $1.80 \times 10^3$ | −243 | " | $1.07 \times 10^3$ | −307 | " |
| 73 | $15.2 \times 10^3$ | −285 | " | $20.3 \times 10^3$ | −469 | " | $16.2 \times 10^3$ | −751 | " |
| 74 | $17.9 \times 10^3$ | −290 | " | $24.9 \times 10^3$ | −473 | " | $20.5 \times 10^3$ | −787 | " |
| 75 | $1.85 \times 10^3$ | −192 | " | $4.85 \times 10^3$ | −315 | " | $2.16 \times 10^3$ | −356 | " |
| 76 | $1.44 \times 10^3$ | +221 | " | $2.03 \times 10^3$ | +357 | " | $1.99 \times 10^3$ | +420 | " |
| 77 | $3.79 \times 10^3$ | −236 | " | $5.96 \times 10^3$ | −405 | " | $4.24 \times 10^3$ | −485 | " |
| 78 | $7.00 \times 10^3$ | −250 | " | $9.53 \times 10^3$ | −436 | " | $7.14 \times 10^3$ | −652 | " |
| 79 | $7.89 \times 10^3$ | −262 | " | $10.2 \times 10^3$ | −449 | " | $8.53 \times 10^3$ | −645 | " |
| 80 | $13.4 \times 10^3$ | −249 | " | $17.9 \times 10^3$ | −415 | " | $15.3 \times 10^3$ | −577 | " |
| 81 | $6.03 \times 10^3$ | −260 | " | $6.33 \times 10^3$ | −382 | " | $6.21 \times 10^3$ | −514 | " |
| 82 | $3.09 \times 10^3$ | −263 | " | $5.11 \times 10^3$ | −425 | " | $4.02 \times 10^3$ | −520 | " |
| 83 | $1.72 \times 10^3$ | −187 | " | $4.07 \times 10^3$ | −249 | " | $2.00 \times 10^3$ | −348 | " |
| 84 | $3.85 \times 10^3$ | −179 | " | $7.35 \times 10^3$ | −235 | " | $4.11 \times 10^3$ | −380 | " |
| 85 | $9.11 \times 10^3$ | −296 | " | $14.5 \times 10^3$ | −489 | " | $10.6 \times 10^3$ | −925 | " |
| 86 | $6.04 \times 10^3$ | −236 | " | $6.41 \times 10^3$ | −415 | " | $6.22 \times 10^3$ | −545 | " |
| 87 | $10.5 \times 10^3$ | −277 | " | $14.2 \times 10^3$ | −495 | " | $12.9 \times 10^3$ | −889 | " |
| 88 | $17.7 \times 10^3$ | −281 | " | $23.4 \times 10^3$ | −479 | " | $19.5 \times 10^3$ | −826 | " |
| 89 | $6.75 \times 10^3$ | −267 | " | $10.7 \times 10^3$ | −452 | " | $8.19 \times 10^3$ | −695 | " |
| 90 | $2.29 \times 10^3$ | −216 | " | $5.33 \times 10^3$ | −326 | " | $3.14 \times 10^3$ | −459 | " |
| 91 | $16.5 \times 10^3$ | −241 | " | $17.9 \times 10^3$ | −473 | " | $17.4 \times 10^3$ | −626 | " |
| 92 | $15.6 \times 10^3$ | −270 | " | $21.4 \times 10^3$ | −470 | " | $18.6 \times 10^3$ | −893 | " |
| 93 | $18.3 \times 10^3$ | −281 | " | $24.0 \times 10^3$ | −475 | " | $21.5 \times 10^3$ | −884 | " |
| 94 | $15.4 \times 10^3$ | −290 | " | $23.6 \times 10^3$ | −468 | " | $19.9 \times 10^3$ | −834 | " |
| 95 | $4.02 \times 10^3$ | −287 | " | $7.12 \times 10^3$ | −356 | " | $4.15 \times 10^3$ | −477 | " |
| 96 | $1.89 \times 10^3$ | −162 | " | $3.01 \times 10^3$ | −250 | " | $2.90 \times 10^3$ | −299 | " |
| 97 | $20.3 \times 10^3$ | −273 | " | $24.7 \times 10^3$ | −493 | " | $22.4 \times 10^3$ | −805 | " |
| 98 | $10.1 \times 10^3$ | −269 | " | $13.3 \times 10^3$ | −452 | " | $11.5 \times 10^3$ | −603 | " |
| 99 | $6.25 \times 10^3$ | −216 | " | $9.69 \times 10^3$ | −395 | " | $7.18 \times 10^3$ | −525 | " |
| 100 | $3.80 \times 10^3$ | −207 | " | $6.18 \times 10^3$ | −376 | " | $3.87 \times 10^3$ | −489 | " |
| 101 | $1.15 \times 10^3$ | −149 | " | $1.82 \times 10^3$ | −288 | " | $1.72 \times 10^3$ | −360 | " |
| 102 | $12.8 \times 10^3$ | −280 | " | $16.7 \times 10^3$ | −481 | " | $14.4 \times 10^3$ | −863 | " |
| 103 | $18.3 \times 10^3$ | −226 | " | $23.0 \times 10^3$ | −432 | " | $19.1 \times 10^3$ | −590 | " |

TABLE 17-continued

| | (Characteristic value corresponding to the sample in Table 9) | | | | | | | | |
|---|---|---|---|---|---|---|---|---|---|
| | Example 1 | | | Carbonate-Free | | | Carbonate & Fluoride-Free | | |
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 104 | $21.4 \times 10^3$ | −280 | " | $29.2 \times 10^3$ | −476 | " | $25.6 \times 10^3$ | −842 | " |
| 105 | $7.03 \times 10^3$ | −216 | " | $12.6 \times 10^3$ | −358 | " | $9.02 \times 10^3$ | −492 | " |
| 106 | 969 | +70 | " | 992 | +148 | " | 983 | +196 | " |
| 107 | $3.00 \times 10^3$ | −201 | " | $3.56 \times 10^3$ | −388 | " | $3.14 \times 10^3$ | −502 | " |
| 108 | $4.17 \times 10^3$ | −212 | " | $7.23 \times 10^3$ | −365 | " | $5.01 \times 10^3$ | −483 | " |
| 109 | $5.84 \times 10^3$ | −182 | " | $9.44 \times 10^3$ | −250 | " | $6.24 \times 10^3$ | −314 | " |
| 110 | $5.99 \times 10^3$ | −209 | " | $10.1 \times 10^3$ | −371 | " | $6.92 \times 10^3$ | −505 | " |
| 111 | $7.03 \times 10^3$ | −220 | " | $7.51 \times 10^3$ | −428 | " | $7.44 \times 10^3$ | −521 | " |
| 112 | $9.76 \times 10^3$ | −254 | " | $13.4 \times 10^3$ | −452 | " | $11.0 \times 10^3$ | −647 | " |
| 113 | $4.01 \times 10^3$ | −172 | " | $6.33 \times 10^3$ | −333 | " | $4.56 \times 10^3$ | −424 | " |
| 114 | $4.70 \times 10^3$ | −225 | " | $6.49 \times 10^3$ | −329 | " | $4.73 \times 10^3$ | −412 | " |
| 115 | $9.54 \times 10^3$ | −185 | " | $15.4 \times 10^3$ | −376 | " | $10.2 \times 10^3$ | −509 | " |
| 116 | $9.09 \times 10^3$ | −196 | " | $9.29 \times 10^3$ | −395 | " | $9.18 \times 10^3$ | −518 | " |
| 117 | $6.19 \times 10^3$ | −200 | " | $8.81 \times 10^3$ | −400 | " | $7.02 \times 10^3$ | −540 | " |
| 118 | $6.25 \times 10^3$ | −225 | " | $9.24 \times 10^3$ | −416 | " | $6.88 \times 10^3$ | −523 | " |
| 119 | $5.87 \times 10^3$ | −230 | " | $10.1 \times 10^3$ | −420 | " | $6.90 \times 10^3$ | −520 | " |
| 120 | $5.14 \times 10^3$ | −209 | " | $9.91 \times 10^3$ | −405 | " | $5.89 \times 10^3$ | −509 | " |

EXAMPLE 2

In accordance with Example 1, multilayered ceramic substrates were prepared, except that the molybdates, fluorides and glass powders having the compositions specified in Table 18, were used without any heat treatment, and their $R_{25}$, TCR and rate of changes in resistance were measured. The results are indicated in Table 19 with the corresponding sample numbers.

TABLE 18

| | (Ex. 2 - Composition in the case without heattreating Molybdates with others) | | | | | | | | | | |
|---|---|---|---|---|---|---|---|---|---|---|---|
| | Composition | | | | | | | | | | |
| | Molybdate | | Glass B | Fluorides (wt. %) | | | | Carbonates (wt. %) | | | |
| NOs | (wt. %) | | (wt. %) | $SrF_2$ | $BaF_2$ | $MgF_2$ | $CaF_2$ | $SrCO_3$ | $BaCO_3$ | $MgCO_3$ | $CaCO_3$ |
| 1 | $MgMoO_4$ | 40 | 59 | | | | 0.5 | | | 0.5 | |
| 2 | $CaMoO_4$ | 40 | 59 | 0.5 | | | | | | | 0.5 |
| 3 | $SrMoO_4$ | 40 | 59 | | | | 0.5 | 0.5 | | | |
| 4 | $BaMoO_4$ | 40 | 59 | | 0.5 | | | | | | 0.5 |
| 5 | $(Mg_{0.3}Ca_{0.7})MoO_4$ | 60 | 20 | 10 | | | | | | | 10 |
| 6 | $MgMoO_4$ | 30 | 20 | | | | 10 | 10 | | | |
| | $Ca_3MoO_6$ | 30 | | | | | | | | | |
| 7 | $ZnMoO_4$ | 65 | 34 | | | 0.5 | | | | | 0.5 |
| 8 | $Al_2Mo_3O_{12}$ | 60 | 39 | | 0.5 | | | 0.5 | | | |
| 9 | $ZrMo_2O_8$ | 45 | 54 | 0.5 | | | | | 0.5 | | |
| 10 | $HfMo_2O_8$ | 45 | 54 | | | | 0.5 | 0.5 | | | |
| 11 | $Y_6MoO_{12}$ | 80 | 5 | 7.5 | | | | | | | 7.5 |
| 12 | $La_6MoO_{12}$ | 80 | 5 | 7.5 | | | | | | | 7.5 |
| 13 | $Ce_6MoO_{12}$ | 80 | 5 | 7.5 | | | | | | | 7.5 |
| 14 | $Pr_6MoO_{12}$ | 80 | 5 | 7.5 | | | | | | | 7.5 |
| 15 | $Nd_6MoO_{12}$ | 80 | 5 | 7.5 | | | | | | | 7.5 |
| 16 | $Sm_6MoO_{12}$ | 80 | 5 | 7.5 | | | | | | | 7.5 |
| 17 | $Eu_6MoO_{12}$ | 80 | 5 | 7.5 | | | | | | | 7.5 |
| 18 | $Gd_6MoO_{12}$ | 80 | 5 | 7.5 | | | | | | | 7.5 |
| 19 | $Tb_6MoO_{12}$ | 80 | 5 | 7.5 | | | | | | | 7.5 |
| 20 | $Dy_6MoO_{12}$ | 80 | 5 | 7.5 | | | | | | | 7.5 |
| 21 | $Ho_6MoO_{12}$ | 80 | 5 | 7.5 | | | | | | | 7.5 |
| 22 | $Er_6MoO_{12}$ | 80 | 5 | 7.5 | | | | | | | 7.5 |
| 23 | $Tm_6MoO_{12}$ | 80 | 5 | 7.5 | | | | | | | 7.5 |
| 24 | $Yb_6MoO_{12}$ | 80 | 5 | 7.5 | | | | | | | 7.5 |
| 25 | $Lu_6MoO_{12}$ | 80 | 5 | 7.5 | | | | | | | 7.5 |
| 26 | $Nb_2Mo_3O_{14}$ | 55 | 44 | | 0.5 | | | | | 0.5 | |
| 27 | $Ta_2Mo_3O_{14}$ | 55 | 44 | | | | 0.5 | 0.5 | | | |
| 28 | $MnMoO_4$ | 65 | 34 | | | 0.5 | | 0.5 | | | |

TABLE 19

| | (Characteristic value corresponding to the sample in Table 18) | | | | | |
|---|---|---|---|---|---|---|
| | Example 2 | | | Fluoride-Free | | |
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 1 | $3.04 \times 10^3$ | −1316 | $<\pm 2$ | $4.35 \times 10^3$ | −1356 | $<\pm 2$ |
| 2 | $29.8 \times 10^3$ | −1435 | " | $35.2 \times 10^3$ | −1483 | " |

TABLE 19-continued

| | (Characteristic value corresponding to the sample in Table 18) | | | | | |
|---|---|---|---|---|---|---|
| | Example 2 | | | Fluoride-Free | | |
| Nos | Resistance value at 25° C. $R_{25}$ (Ω) | TCR (ppm/°C.) | Rate of Change in Resistance (%) | Resistance value at 25° C. $R_{25}$ (Ω) | TCR (ppm/°C.) | Rate of Change in Resistance (%) |
| 3 | 674 | −1385 | " | 823 | −1411 | " |
| 4 | 388 | +1156 | " | 524 | +1192 | " |
| 5 | $8.44 \times 10^3$ | −1384 | " | $9.83 \times 10^3$ | −1401 | " |
| 6 | $6.24 \times 10^3$ | −1309 | " | $7.29 \times 10^3$ | −1328 | " |
| 7 | $4.80 \times 10^3$ | −1370 | " | $5.63 \times 10^3$ | −1412 | " |
| 8 | $11.6 \times 10^3$ | −1462 | " | $12.5 \times 10^3$ | −1489 | " |
| 9 | $17.4 \times 10^3$ | −1615 | " | $18.9 \times 10^3$ | −1676 | " |
| 10 | $15.4 \times 10^3$ | −1468 | " | $16.2 \times 10^3$ | +1498 | " |
| 11 | $5.95 \times 10^3$ | −1216 | " | $6.82 \times 10^3$ | −1273 | " |
| 12 | $5.03 \times 10^3$ | −1206 | " | $6.23 \times 10^3$ | −1256 | " |
| 13 | $3.95 \times 10^3$ | −1195 | " | $4.36 \times 10^3$ | +1232 | " |
| 14 | $3.88 \times 10^3$ | −1192 | " | $4.21 \times 10^3$ | −1213 | " |
| 15 | $4.99 \times 10^3$ | −1312 | " | $5.36 \times 10^3$ | −1363 | " |
| 16 | $3.79 \times 10^3$ | −1369 | " | $4.31 \times 10^3$ | −1401 | " |
| 17 | $4.05 \times 10^3$ | −1287 | " | $5.01 \times 10^3$ | −1302 | " |
| 18 | $7.61 \times 10^3$ | −1305 | " | $8.34 \times 10^3$ | +1363 | " |
| 19 | $7.18 \times 10^3$ | −1269 | " | $8.05 \times 10^3$ | −1272 | " |
| 20 | $7.33 \times 10^3$ | −1050 | " | $8.65 \times 10^3$ | −1080 | " |
| 21 | $7.18 \times 10^3$ | −1182 | " | $8.23 \times 10^3$ | −1210 | " |
| 22 | $7.85 \times 10^3$ | −1324 | " | $8.41 \times 10^3$ | −1363 | " |
| 23 | $6.94 \times 10^3$ | −1306 | " | $7.81 \times 10^3$ | +1353 | " |
| 24 | $6.03 \times 10^3$ | −1244 | " | $7.03 \times 10^3$ | −1286 | " |
| 25 | $4.67 \times 10^3$ | −1195 | " | $5.63 \times 10^3$ | −1215 | " |
| 26 | 625 | +1059 | " | 725 | +1080 | " |
| 27 | $1.45 \times 10^3$ | −1345 | " | $2.03 \times 10^3$ | −1376 | " |
| 28 | 905 | +1230 | " | $1.06 \times 10^3$ | −1271 | " |

Comparison Example 1 ($MoSi_2$-$TaSi_2$ Glass Base Resistor Material)

A mixture of 16 parts by weight of $MoSi_2$ with 9 parts by weight of $TaSi_2$ was heated at 1400° C. in vacuum. The resulting product was pulverized together with ethanol by alumina balls in a pot mill for 24 hours, and was dried to obtain fine powders having a particle size of 10 μm or lower. Seventy five (75) parts by weight of glass frit consisting of BaO, $B_2O_3$, MgO, CaO and $SiO_2$ and 25 parts by weight of the organic vehicle (20 parts by weight of butyl carbitol plus 5 parts by weight of ethyl cellulose) were added to 25 parts by weight of the thus obtained fine powders, and were roll-milled to obtain a resistive paste.

Except that this resistive paste was used, a multilayered ceramic board was obtained in the same manner as in the foregoing examples.

As a result, the product obtained by forming the resistive film produced from said paste on a ceramic green sheet, heat-treating them for the decomposition of the organics and, thereafter, simultaneously sintering them could not be put to practical use, since it warped due to differences in the coefficients of expansion and shrinkage between both the sintered bodies, as illustrated in FIG. 4, and swelled due to the evolution of a gas by the decomposing reaction of $MoSi_2$ and $TaSi_2$, as illustrated in FIG. 5. It is to be noted that 11*a*, 14*a* and 13*a* are a layer corresponding to the aforesaid layer 1*a*, a layer corresponding to the aforesaid layer 4*a* and a thick-film resistor corresponding to the aforesaid thick-film resistor 3*a*, respectively.

Comparison Example 2 ($MoSi_2$-$BaF_2$ Glass Base Resistor Material

Seventy (70) parts by weight of $MoSi_2$ and 20 parts by weight of $BaF_2$ were mixed with 10 parts by weight of glass frit comprising $SiO_2$, ZnO, $ZrO_2$, CaO and $Al_2O_3$ by ball-milling, and the resulting powders were heat-treated at 1200° C. in an argon (Ar) gas atmosphere. Thereafter, the product was pulverized together with ethanol for 24 hours by alumina balls in a pot mill, and was dried to obtain fine powders having a particle size of 10 μm or lower.

Except that this resistive paste was used, a multilayered ceramic board was obtained in the same manner as in Example 1. Shown in Table 20 are the results of the $R_{25}$, TCR and rate of change in resistance value of the thick-film resistor of the multilayered ceramic substrate, which were measured in the same manner as in Example 1.

TABLE 20

| | Resistance Value $R_{25}$ at 25° C., Ohms | TCR ppm/°C. | Rate of Change in Resistance Value, % |
|---|---|---|---|
| Comp. Ex. 2 | 124.5 | +1120 | 9.7% increase |

From the above results, it has been found that the multilayered ceramic boards according to the examples all undergo neither warping nor swelling, and their rate of change in resistance value is within ±2%, and that, in particular, the TCR of those having the resistor material heat-treated does not exceed ±500 ppm/°C. in the case where the fluorides of alkaline earth metals are used and ±300 ppm/°C. in the case where the carbonates of alkaline earth metals are used. It has been noted, on the other hand, that the multilayered ceramic board of Comp. Ex. 1 undergoes warping, whereas the multilayered ceramic board of Comp. Ex. 2 has its resistor showing a rate of change in resistance value that is four times higher and a TCR that is one order of magnitude higher.

Effects of the Invention

According to the present invention, there can be provided a sintered body containing at least one molybdate selected from at least one molybdate group selected from the groups (A) to (G) defined in the foregoing, with or without the fluoride of an alkaline earth metal, and an electrical resistor paste containing a resistive material for said sintered body and the carbonate of an alkaline earth metal. Accordingly, if the resistor material or paste for this sintered body is used and sintered along with a conductor material based on, e.g. a base metal and a ceramic green sheet in a nonoxidizing atmosphere to form a resistor, it is very unlikely that the sintered body may either warp or swell due to sintering. It is further possible not only to decrease a change-with-time of the resistance value esp. at a high humidity but also to reduce the temperature dependence coefficient of the resistance value of the resistor not to exceed ±300 ppm/°C., for instance.

Hence, it is possible to meet both the demands for reductions in the size and cost of circuit boards having resistors incorporated thereinto and to provide excellent electronic parts to electronic equipment needing precise work.

Further, if the molybdate belonging to the aforesaid groups (A) to (G), preferably with the fluoride of an alkaline earth metal are heat-treated with glass, it is then possible to decrease the absolute value of the temperature dependent coefficient of the resistor and add excellent capabilities to electronic circuits needing precise performance, compared with the case where such any heat-treatment is not carried out.

What is claimed is:

1. An electrical resistor which is sintered body comprising bulk particles, acicular particles deposited onto said bulk particles, a fluoride of an alkaline earth metal represented by the formula $Me'F_2$, wherein Me is an alkaline earth metal, and a glass layer, said bulk particles comprising at least one molybdate selected from the group consisting of (A) to (G), and said acicular particles containing a reduction product of said molybdate:

(A) 30–96 weight % molybdates of alkaline earth metals, (B) 55–95 weight % molybdates of zinc, (C) 50–96 weight % molybdates of elements Y, La, Ce, Pr, Nd, Sm, Eu, Gd, Tb, Dy, Ho, Er, Tm, BYb and Lu, and complex molybdates of two or more of said elements, (D) 35–96 weight % molybdates of aluminium, (E) 40–96 weight % molybdates of elements zirconium and hafnium, and complex molybdates thereof, (F) 45–96 weight % molybdates of elements niobium and tantalum, and complex molybdates thereof, and (G) 50–96 weight % molybdates of manganese.

2. The electrical resistor as defined in claim 17, wherein said bulk and acicular particles are obtained by sintering a resistor material containing as one of the main components at least one of the molybdate or molybdates selected from the molybdate group or groups consisting of (A) to (G) and its or their precursors.

3. The electrical resistor as defined in claim 17 or 18, wherein said acicular particles are a product obtained by the reduction of the surfaces of said bulk particles.

4. The electrical resistor as defined in claim 1, wherein the molybdates of alkaline earth metals are selected from the group consisting of $MeMoO_4$, $Me_3MoO_6$, $Me_2MoO_5$, $Me_2Mo_7$, $MeMo_4O_{13}$, $MeMo_7O_{24}$, $MeMo_3O_{10}$, $Me_2MoO_5$ and $Me_2Mo_3O_{11}$, wherein Me is an alkaline earth metal.

5. The electrical resistor as defined in claim 1, wherein the molybdates of alkaline earth metals are selected from the group consisting of $MgMoO_4$, $CaMoO_4$, $SrMoO_4$, $BaMoO_4$, $BaMo_2O_7$, $BaMo_4O_{13}$, $BaMo_7O_{24}$, $BaMo_3O_{10}$, $Ca_3MoO_6$, $Sr_3MoO_6$, $BaMoO_6$, $Ba_2MoO_5$, and $Mg_2Mo_3O_{11}$.

6. The electrical resistor as defined in claim 1, wherein the molybdates of alkaline earth metals are complex molybdates selected from the group consisting of $(Mg_x Ca_y)MoO_4$, provided that $x+y=1$, $(Ca_x Sr_y)MoO_4$, provided that $x+y=1$, $(Mg_x Ba_y)MoO_4$, provided that $x+y=1$, $(Mg_x Ca_y Ba_z)MoO_4$, provided that $x+y+z=1$, $(Ca_x Sr_y Ba_z)MoO_4$, provided that $x+y+z=1$, $(Mg_x Ca_y Sr_z Ba_w)MoO_4$, provided that $x+y+z+w=1$, $(Ca_x Sr_y)MoO_6$, provided that $x+y=1$, and $(sr_x Ba_y)MoO_6$, provided that $x+y=1$.

7. The electrical resistor as defined in claim 1, wherein molybdates of zinc are selected from the group consisting of $ZnMoO_4$, $ZnMo_2O_7$ and $Zn_3Mo_2O_9$.

8. The electrical resistor as defined in claim 1, wherein complex molybdates of two or more of the elements of group (C) are selected from the group consisting of $(Y_x Ce_y)MoO_{12}$, provided that $x+y=6$, $(Pr_x Ey_y)MoO_{12}$, provided that $x+y=6$, $(Gd_x Dy_y)MoO_{12}$, provided that $x+y=6$, and $(Ho_x Tm_y Yb_z)MoO_{12}$, provided $x+y+z=6$.

9. The electrical resistor as defined in claim 1, wherein a molybdate of aluminium is $Al_2Mo_3O_{12}$.

10. The electrical resistor as defined in claim 1, wherein molybdates of group (E) are selected from the group consisting of $ZrMo_2O_3$, $HfMo_2O_8$ and $(Zr_x Hf_y)Mo_2O_3$, provided that $x+y=1$.

11. The electrical resistor as defined in claim 1, wherein molybdates of group (F) are selected from the group consisting of $Nb_2Mo_3O_{14}$, $Ta_2Mo_3O_{14}$ and $(Nb_x Ta_y)Mo_3O_{14}$, provided that $x+y=1$.

12. The electrical resistor as defined in claim 1, wherein a molybdate of manganese is $MnMoO_4$.

13. The electrical resistor as defined in claim 1, wherein the glass layer comprises glass components selected from the group consisting of 12 to 33% by weight $SiO_2$, 20 to 35% by weight $B_2O_3$, 13 to 33% by weight ZnO, 13 to 33% by weight SrO, 10 to 25% by weight Cao and 15 to 45% by weight $ZrO_2$.

14. The electrical resistor as defined in claim 1, wherein the molybdate is selected from the group consisting of 40–95 weight % (A), 65–95 weight % (B), 60–95 weight % (C), 45–95 weight % (O), 50–95 weight % (E), 55–95 weight % (F) and 65–95 weight % (G).

15. The electrical resistor as defined in claim 1, wherein the molybdate is selected from the group consisting of 30–95 weight % (A), 60–95 weight % (B), 55–95 weight % (C), 40–95 weight % (D), 40–95 weight % (E), 50–95 weight % (F) and 55–95 weight % (G).

* * * * *